US007332267B2

(12) United States Patent
Nakagawa et al.

(10) Patent No.: US 7,332,267 B2
(45) Date of Patent: Feb. 19, 2008

(54) PHOTOTHERMOGRAPHIC MATERIAL

(75) Inventors: Hajime Nakagawa, Kanagawa (JP); Seiichi Yamamoto, Kanagawa (JP); Masahiko Taniguchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/490,140

(22) Filed: Jul. 21, 2006

(65) Prior Publication Data

US 2007/0015095 A1 Jan. 18, 2007

Related U.S. Application Data

(63) Continuation-in-part of application No. 11/206,171, filed on Aug. 18, 2005, now abandoned, and a continuation-in-part of application No. 10/734,660, filed on Dec. 15, 2003, now Pat. No. 7,157,217.

(30) Foreign Application Priority Data

| | | |
|---|---|---|
| Dec. 17, 2002 | (JP) | 2002-365298 |
| Dec. 18, 2002 | (JP) | 2002-366234 |
| Dec. 27, 2002 | (JP) | 2002-379770 |
| Jan. 6, 2003 | (JP) | 2003-314 |
| Jan. 9, 2003 | (JP) | 2003-2757 |
| Sep. 16, 2004 | (JP) | 2004-270389 |

(51) Int. Cl.

| | |
|---|---|
| ***G03C 1/00*** | (2006.01) |
| ***G03C 1/005*** | (2006.01) |
| ***G03C 1/494*** | (2006.01) |
| ***G03C 1/06*** | (2006.01) |
| ***G03C 1/08*** | (2006.01) |

(52) U.S. Cl. ..... 430/617; 430/618; 430/619; 430/620; 430/631; 430/639; 430/640; 430/642; 430/517; 430/559

(58) Field of Classification Search ..... 430/617–620, 430/631, 639, 640, 642, 517, 559
See application file for complete search history.

(56) References Cited

U.S. PATENT DOCUMENTS

| | | | |
|---|---|---|---|
| 4,113,854 | A | 9/1978 | Andrews et al. |
| 6,132,950 | A | 10/2000 | Ishigaki et al. |
| 6,140,038 | A | 10/2000 | Ishizuka et al. |
| 6,150,084 | A | 11/2000 | Ito et al. |
| 6,156,491 | A | 12/2000 | Goto |
| 6,261,754 | B1 | 7/2001 | Ishigaki et al. |
| 6,344,313 | B1 | 2/2002 | Goto et al. |
| 6,359,667 | B1 | 3/2002 | Koyanagi et al. |
| 6,582,898 | B2 | 6/2003 | Morita |
| 6,821,720 | B2 | 11/2004 | Iwado |
| 6,949,333 | B2 | 9/2005 | Mifune et al. |
| 2001/0051319 | A1 | 12/2001 | Oya et al. |
| 2003/0190565 | A1 | 10/2003 | Fujiwara et al. |
| 2003/0232288 | A1 | 12/2003 | Oka et al. |
| 2004/0126717 | A1 | 7/2004 | Nakagawa et al. |
| 2004/0234909 | A1 | 11/2004 | Inoue et al. |
| 2004/0234911 | A1 | 11/2004 | Suzuki |
| 2005/0214700 | A1 | 9/2005 | Yamamoto et al. |

FOREIGN PATENT DOCUMENTS

| | | |
|---|---|---|
| JP | A 60-244945 | 12/1985 |
| JP | A 01-197739 | 8/1989 |
| JP | A 9-146220 | 6/1997 |
| JP | A 10-197985 | 7/1998 |
| JP | A 10-244762 | 9/1998 |
| JP | A 10-312038 | 11/1998 |
| JP | A 2000-187298 | 7/2000 |
| JP | A 2000-214554 | 8/2000 |
| JP | A 2000-298326 | 10/2000 |
| JP | A 2001-194744 | 7/2001 |
| JP | A 2001-272750 | 10/2001 |
| JP | A 2001-281791 | 10/2001 |
| JP | A 2001-296631 | 10/2001 |
| JP | A 2002-006445 | 1/2002 |
| JP | A 2002-196447 | 7/2002 |
| JP | A 2002-214740 | 7/2002 |

OTHER PUBLICATIONS

Dewent-Acc-No.1982-18594E.

*Primary Examiner*—Geraldina Visconti
(74) *Attorney, Agent, or Firm*—Margaret A. Burke; Sheldon J. Moss

(57) ABSTRACT

Disclosed is a photothermographic material comprising an image forming layer containing at least a light-sensitive silver halide, a light-insensitive organic silver salt, a reducing agent and a binder and a non-image forming layer on at least one surface of a support, wherein 50% by weight or more of the binder is a hydrophilic binder, the light-sensitive material further comprising a metal phthalocyanine compound represented by the following formula (PC-1):

Formula (PC-1)

wherein M represents a metal atom, $R^1$, $R^4$, $R^5$, $R^8$, $R^9$, $R^{12}$, $R^{13}$ and $R^{16}$ respectively represent a hydrogen atom or a substituent where at least one of $R^1$, $R^4$, $R^5$, $R^8$, $R^9$, $R^{12}$, $R^{13}$ and $R^{16}$ is an electron attractive group and $R^2$, $R^3$, $R^6$, $R^7$, $R^{10}$, $R^{11}$, $R^{14}$ and $R^{15}$ respectively represent a hydrogen atom or a substituent.

17 Claims, No Drawings

PHOTOTHERMOGRAPHIC MATERIAL

CROSS-REFERENCE TO RELATED APPLICATION

This application is a continuation-in-part of, and claims the benefit of priority under 35 USC 120 from, application Ser. No. 11/206,171 filed Aug. 18, 2005 now abandoned, which claims the benefit of priority under 35 USC 119 from Japanese Patent Application No. 2004-270389 all of the disclosures of which are incorporated by reference herein.

This application is a continuation-in-part of, and claims the benefit of priority under 35 USC 120 from, application Ser. No. 10/734,660 filed Dec. 15, 2003 now U.S. Pat. No. 7,157,217, now which claims the benefit of priority under 35 USC 119 from Japanese Patent Application Nos. 2002-365298, 2002-366234, 2002-379770, 2003-0314, and 2003-2757, all of the disclosures of which are incorporated by reference herein.

BACKGROUND OF THE INVENTION

1. Field of the Invention

The present invention relates to a photothermographic material, and in particular, relates to a photothermographic material using a hydrophilic binder as an image forming layer binder.

2. Description of the Related Art

In recent years, in the field of medicine, there has been a strong desire for reductions in the amount of process waste fluids in view of environmental protection and space saving. There is therefore a need for development of technologies concerning photothermographic materials for medical diagnosis and for photographic technology use which can be efficiently exposed using a laser image setter or laser imager and enable the formation of a clear black image having high resolution and sharpness. These photothermographic materials can avoid the use of solvent type processing chemicals and supply to customers a heat developing process system that is simpler and does not impair the environment.

Although there are similar demands in the field of general image forming materials, fine drawing is required for medical images. High image quality superior in sharpness and granularity is therefore necessary in medical images and a cool black tone is preferred in these medical images from the viewpoint of ease of diagnosis easiness. Various types of hard copy systems utilizing pigments and dyes such as ink jet printers and electrophotography are in circulation as general image forming systems. However, none of these satisfy the requirements for medical image output systems.

On the other hand, thermal image forming systems utilizing organic silver salts are described in many documents. Particularly, photothermographic materials generally comprise an image forming layer in which a catalytic amount of a photocatalyst (for example, silver halides), a reducing agent, a reducible silver salt (for example, organic silver salts) and as required, a tone agent that controls the tone of silver, are dispersed in a binder matrix. The photothermographic material is heated to a high temperature (for example, 80° C. or more) after imagewise exposure to form a black silver image by the redox reaction between the silver halide or the reducible silver salt (functioning as an oxidant) and the reducing agent. The redox reaction is promoted by the catalytic action of the latent image of the silver halide formed by exposure. Therefore, the black silver image is formed in the exposed area.

Heat developing treatment has the advantage that the processing solution used in wet developing treatment is unnecessary and the treatment can be carried out simply and rapidly. However, unsolved problems not seen in wet developing treatment exist in heat developing treatment. One of these problems is a problem concerning decoloring of a dye. It is common to add dyes to photosensitive materials for the purpose of making a filter and preventing halation and irradiation. The dye functions in imagewise exposure. If the dye is left in the photosensitive material after this function is finished, the image to be formed is colored with the dye and it is therefore necessary to remove the dye from the photosensitive material in the developing treatment. In wet developing treatment, a dye can be removed from a photosensitive material simply by a processing solution. In heat developing treatment, on the other hand, removal of the dye poses a significant problem.

Particularly in the case of photosensitive materials to be exposed to laser light, it is important to include a sufficient irradiation preventive effect and halation preventive effect at the exposure wavelength in the photosensitive materials in order to obtain a highly sharp image. As the laser wavelength, a wide wavelength range of from the near-infrared region, the infrared region, and the red to blue visible regions are used at present.

A method of discoloring dyes by heating in the heat developing treatment has been proposed. For example, U.S. Pat. No. 5,324,627 discloses a method of discoloring a polymethine dye having a specific structure by heating.

Also, methods by which a polymethine dye is discolored under heating by using a carbanion generating agent have been disclosed (see, for example, U.S. Pat. Nos. 5,135,842, 5,314,795 and 5,324,627).

Problems posed when using a discoloring mechanism are that a dye is insufficiently discolored or, on the contrary, the stability of a dye is insufficient so that the dye is discolored while the photothermographic material is stored. Also, when using a polymethine dye, the decomposed products of the dye left after the dye is discolored have the capability of slightly absorbing light, posing a problem concerning the residual color of an image (particularly in the highlight portion). There is also a problem concerning recoloring (particularly when the dye is brought into contact with an acid) after heat developing and there are cases where byproducts generated after the complicated reaction processes deteriorate the handling characteristics of the light-sensitive material after the photosensitive material is treated.

With regard to photosensitive materials to be exposed by a near-infrared or infrared laser, photosensitive materials have been proposed which substantially exclude a discoloring mechanism by using a dye that has an absorption maximum in the invisible near-infrared region, have a narrow half width and have small absorption in the visible region (see, for example, Japanese Patent Application Laid-Open Nos. 9-146220 and 11-228698).

However, it is commonly known that the tint of a dye is greatly changed by the binder and materials coexisting therewith in a layer having the dye. As the binder of a photothermographic material, a binder, which dissolves in an organic solvent, such as polybutyral or a water dispersion of polymer micro-particles is used. The latter method does not require any process for recovering solvents, which makes production equipment simple and has a reduced environmental load, which is advantageous in mass-production. However, this method has the problem that because the coating solution has no setting ability, the formed film is disturbed by dry air after it is applied, causing drying unevenness. In order to improve this, use of a hydrophilic binder such as a gelatin has been proposed (see, for example, U.S. Pat. Nos. 5,314,795 and 5,324,627).

SUMMARY OF THE INVENTION

According to a first aspect of the present invention, there is provided a photothermographic material comprising an image forming layer containing at least a light-sensitive silver halide, a light-insensitive organic silver salt, a reducing agent and a binder and a non-image forming layer on at least one surface of a support, wherein;

1) 50% by weight or more of the binder is a hydrophilic binder, the light-sensitive material further comprising:

2) a metal phthalocyanine compound represented by the following formula (PC-1):

Formula (PC-1)

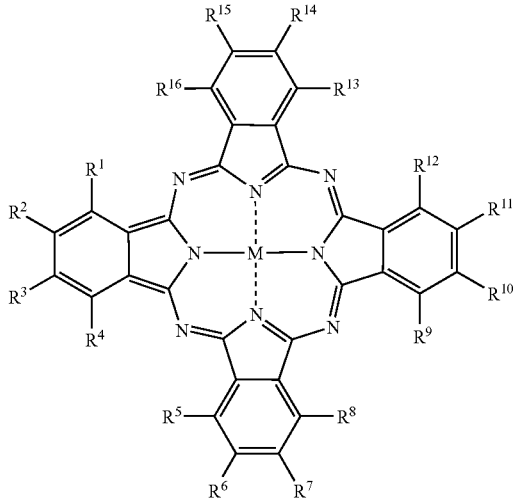

wherein M represents a metal atom, $R^1$, $R^4$, $R^5$, $R^8$, $R^9$, $R^{12}$, $R^{13}$ and $R^{16}$ respectively represent a hydrogen atom or a substituent where at least one of $R^1$, $R^4$, $R^5$, $R^8$, $R^9$, $R^{12}$, $R^{13}$ and $R^{16}$ is an electron attractive group, and $R^2$, $R^3$, $R^6$, $R^7$, $R^{10}$, $R^{11}$, $R^{14}$ and $R^{15}$ respectively represent a hydrogen atom or a substituent.

DETAILED DESCRIPTION OF THE INVENTION

The object of the invention is attained by the following photothermographic material.

<1> A photothermographic material comprising an image forming layer containing at least a light-sensitive silver halide, a light-insensitive organic silver salt, a reducing agent and a binder and a non-image forming layer on at least one surface of a support, wherein;

1) 50% by weight or more of the binder is a hydrophilic binder, the light-sensitive material further comprising:

2) a metal phthalocyanine compound represented by the following formula (PC-1):

Formula (PC-1)

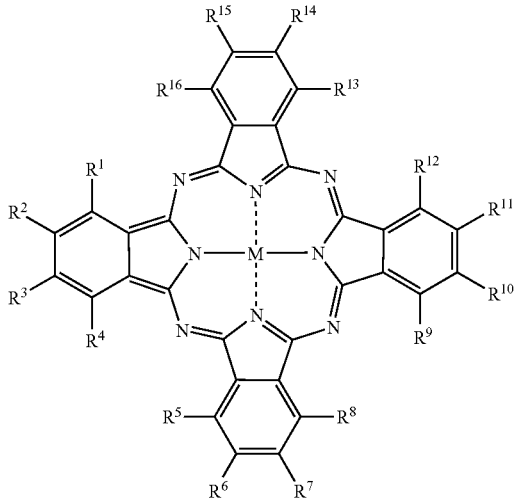

wherein M represents a metal atom, $R^1$, $R^4$, $R^5$, $R^8$, $R^9$, $R^{12}$, $R^{13}$ and $R^{16}$ respectively represent a hydrogen atom or a substituent selected from a halogen atom, alkyl group, alkenyl group, alkynyl group, aryl group, heterocyclic group, acyl group, alkoxycarbonyl group, aryloxycarbonyl group, carbamoyl group, carboxy group or its salt, sulfonylcarbamoyl group, acylcarbamoyl group, sulfamoylcarbamoyl group, carbazoyl group, oxalyl group, oxamoyl group, cyano group, thiocarbamoyl group, hydroxy group, alkoxy group, aryloxy group, heterocyclic oxy group, acyloxy group, carbonyloxy group, carbamoyloxy group, sulfonyloxy group, amino group, acylamino group, sulfonamide group, ureide group, thioureide group, imide group, carbonylamino group, sulfamoylamino group, semicarbazide group, thiosemicarbazide group, hydrazino group, ammonio group, oxamoylamino group, sulfonylureide group, acylureide group, acylsulfamoylamino group, nitro group, mercapto group, thio group, sulfonyl group, sulfinyl group, sulfo group or its salt, sulfamoyl group; acylsulfamoyl group, sulfonylsulfamoyl group or its salt, a group containing a phosphoric acid amide or phosphate structure, silyloxy group and silyl group, where at least one of $R^1$, $R^4$, $R^5$, $R^8$, $R^9$, $R^{12}$, $R^{13}$ and $R^{16}$ is an electron attractive group and $R^2$, $R^3$, $R^6$, $R^7$, $R^{10}$, $R^{11}$, $R^{14}$ and $R^{15}$ respectively represent a hydrogen atom or a substituent selected from the above-described substituents.

<2> A photothermographic material according to the <1>, wherein at least one of $R^1$, $R^4$, $R^5$, $R^8$, $R^9$, $R^{12}$, $R^{13}$ and $R^{16}$ of the metal phthalocyanine compound represented by the formula (PC-1) is a group represented by the following formula (I):

$$—L^1—R^{17}$$ Formula (I)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—* or **—$COCONR_N$—*, where ** indicates the position at which a phthalocyanine skeleton is bound and * indicates the position at which $R^{17}$ is bound, $R_N$ represents a hydrogen atom, an alkyl group, an aryl group, a heterocyclic group, an acyl group, an alkoxycarbonyl group, a carbamoyl group, a sulfonyl group or a sulfamoyl group, and $R^{17}$ represents a hydrogen atom, an alkyl group, an aryl group or a heterocyclic group.

<3> A photothermographic material according to the <1>, wherein four or more among $R^1$, $R^4$, $R^5$, $R^8$, $R^9$, $R^{12}$, $R^{13}$ and $R^{16}$ of the metal phthalocyanine compound represented by the formula (PC-1) are groups represented by the formula (I).

<4> A photothermographic material according to the <1>, wherein the metal phthalocyanine compound represented by the formula (PC-1) is soluble in water.

<5> A photothermographic material according to the <1>, wherein the metal phthalocyanine compound has an absorption maximum in a wavelength range from 620 nm to 700 nm.

<6> A photothermographic material according to the <1>, wherein the metal phthalocyanine compound is contained in the image forming layer.

<7> A photothermographic material according to the <1>, wherein the metal phthalocyanine compound is contained in the non-image forming layer.

<8> A photothermographic material according to the <1>, the light-sensitive material further comprising a magenta dye.

<9> A photothermographic material according to the <8>, wherein at least one layer among the layers containing the metal phthalocyanine compound contains the magenta dye.

<10> A photothermographic material according to the <1>, wherein the hydrophilic binder is a polyvinyl alcohol.

<11> A photothermographic material according to the <1>, wherein the hydrophilic binder is a gelatin or a gelatin derivative.

<12> A photothermographic material according to the <1>, wherein at least one layer among the layers containing the metal phthalocyanine compound contains a mordant.

<13> A photothermographic material according to the <1>, wherein the light-insensitive organic silver salt contains at least one dispersant selected from a polyacrylamide and its derivative.

<14> A photothermographic material according to the <13>, wherein the light-insensitive organic silver salt is nano-particles.

<15> A photothermographic material according to the <1>, the light-sensitive material further comprising at least one compound represented by the following formula (II) or (III):

Formula (II)

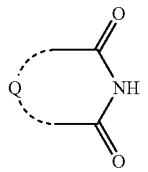

wherein Q represents an atomic group necessary to form a five or six-membered imide ring.

Formula (III)

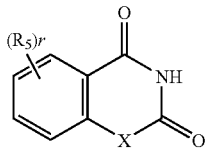

wherein $R_5$ represents a hydrogen atom, an alkyl group, a cycloalkyl group, an alkoxy group, an alkylthio group, an arylthio group, a hydroxy group, a halogen atom or a $N(R_8R_9)$ group, where $R_8$ and $R_9$ respectively represent a hydrogen atom, an alkyl group, an aryl group, a cycloalkyl group, an alkenyl group or a heterocyclic group, r denotes 0, 1 or 2, provided that $R_8$ and $R_9$ may be combined with each other to form a substituted or unsubstituted five to seven-membered hetero ring and two $R^5$s may be combined with each other to form an aromatic, hetero aromatic, alicyclic or heterocyclic condensed ring. X represents O, S, Se or $N(R_6)$, where $R_6$ represents a hydrogen atom, an alkyl group, an aryl group, a cycloalkyl group, an alkenyl group or a heterocyclic group.

<16> A photothermographic material according to the <1>, wherein the non-image forming layer is formed on the same side as the image forming layer with respect to the support and 70% by weight or more of the binder is a hydrophilic binder.

<17> A photothermographic material according to the <16>, wherein the hydrophilic binder is a gelatin or a gelatin derivative.

It has been clarified that the use of a hydrophilic binder as the binder for the image forming layer newly poses a problem also for the irradiation preventive dye.

As mentioned above, the tint of a dye is greatly varied by the binder and coexisting materials in layers containing the dye. Particularly, when a hydrophilic binder is used, the interaction between the dye and the binder is strengthened and the absorption spectrum is therefore largely changed. Therefore, dyes effective heretofore in the case of coating using an organic solvent and in the case of using a polymer latex binder are not necessarily effective. Particularly, polymers derived from animal proteins such as a gelatin have strong interaction with dyes, bringing about a large change in tint. It has been therefore desired to develop dyes which have a satisfactory irradiation preventive effect and is free from the necessity of substantial discoloring when a water-soluble binder is used.

As a result of earnest researches and studies, the dye in the above <1> and the more preferable dyes in the above <2> to <5> were found. Moreover, more preferable requirements for the photothermographic material were found to complete the inventions <6> to <17>.

The invention provides a high quality photothermographic material which is superior in coating surface condition and is reduced in residual colors.

The invention will be explained in detail.

1. Thermal Developing Light-Sensitive Material

The photothermographic material of the invention comprises an image forming layer containing at least a light-sensitive silver halide, a light-insensitive organic silver salt, a reducing agent and a binder and a non-image forming layer on at least one surface of a support. The image forming layer in the invention is constituted of one or more layers on a support and contains, as required, additional materials such as a tone agent, a coating adjuvant and other auxiliaries as desired. The non-image forming layer in the invention may be a monolayer or plural layers.

The photothermographic material will be explained.

(Metal Phthalocyanine Compound)

The phthalocyanine compounds of the formula (PC-1) in the invention will be explained.

Formula (PC-1)

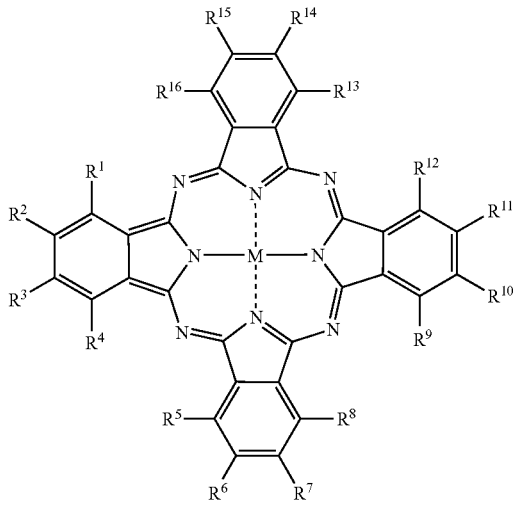

In the formula (PC-1), M represents a metal atom. In the case of representing a metal atom, the metal may be any metal insofar as it forms a stable complex. As the metal, Li, Na, K, Be, Mg, Ca, Ba, Al, Si, Cd, Hg, Cr, Fe, Co, Ni, Cu, Zn, Ge, Pd, Cd, Sn, Pt, Pb, Sr, Mn and the like may be used. Mg, Ca, Co, Zn, Pd and Cu are preferably used and Co, Pd, Zn and Cu are more preferably used and Cu is particularly preferably used.

<<Explanations of Substituents>>

In the formula (PC-1), $R^1$, $R^4$, $R^5$, $R^8$, $R^9$, $R^{12}$, $R^{13}$ and $R^{16}$ respectively represent a hydrogen atom or a substituent. At least one of $R^1$, $R^4$, $R^5$, $R^8$, $R^9$, $R^{12}$, $R^{13}$ and $R^{16}$ is an electron attractive group. The electron attractive group so-called here is one selected from halogen atoms, cyano groups, nitro groups and groups represented by —C(=O)—R, —C(=O)—C(=O)—R, —S(=O)—R, —S(=O)$_2$—R, —C(=N—R')—R, —S(=NR')—R, —S(=NR')$_2$—R, —P(=O)$R_2$, —O—R", —S—R", —N(—R')—C(=O)—R, —N(—R')—S(=O)—R, —N(—R')—S(=O)$_2$—R, —N(—R')—C(=N—R')—R, —N(—R')—S(=NR')$_2$—R and —N(—R')—P(=O)$R_2$. Here, R represents a hydrogen atom, an alkyl group, an aryl group, a heterocyclic group, an amino group, an alkyloxy group, an aryloxy group, a heterocyclic oxy group, a OH group, an alkylthio group, an arylthio group, a heterocyclic thio group, or a SH group. R' represents a hydrogen atom, an alkyl group, an aryl group, a heterocyclic group, an acyl group, a sulfonyl group, a sulfinyl group, or a phosphoryl group. R" represents a perfluoroalkyl group, a cyano group, an acyl group, a sulfonyl group or a sulfinyl group.

The group represented by R, R' or R" may be substituted with a substituent. Specific examples of the substituent include halogen atoms (a fluorine atom, chlorine atom, bromine atom or iodine atom), alkyl groups (including, for example, an aralkyl group, cycloalkyl group or active methine group), alkenyl groups, alkynyl groups, aryl groups, heterocyclic groups (any substituted position is allowed), heterocyclic groups containing a quaternary nitrogen atom (e.g., a pyridinio group, imidazolio group, quinolinio group and isoquinolinio group), acyl groups, alkoxycarbonyl groups, aryloxycarbonyl groups, carbamoyl groups, carboxy groups or their salts, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (including a group containing an ethyleneoxy group or propyleneoxy group unit repeatedly), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, acylamino groups, sulfonamide groups, ureide groups, thioureide groups, imide groups, (alkoxy or aryloxy)carbonylamino groups, sulfamoylamino groups, semicarbazide groups, thiosemicarbazide groups, hydrazino groups, ammonio groups, oxamoylamino groups, (alkyl or aryl) sulfonylureide groups, acylureide groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or their salts, sulfamoyl groups, acylsulfamoyl groups, sulfonylsulfamoyl groups or their salts, groups containing a phosphoric acid amide or a phosphate structure, silyloxy groups (e.g., trimethylsilyloxy and t-butyldimethylsilyloxy) and silyl groups (e.g., trimethylsilyl, t-butyldimethylsilyl and phenyldimethylsilyl). These substituents may be substituted with these substituents.

As the electron attractive group in the formula (PC-1), groups represented by the formula (I) are preferably used.

$$—L^1—R^{17}$$ Formula (I)

$L^1$ represents **—$SO_2$—*, **—$SO_3$—*, **—$SO_2NR_N$—*, **—SO—*, **—CO—*, **—$CONR_N$—*, **—COO—*, **—$COCO_2$—* or **—$COCONR_N$—*, where ** indicates the position at which a phthalocyanine skeleton is bound and * indicates the position at which $R^{17}$ is bound. $R_N$ represents a hydrogen atom, an alkyl group, an aryl group, a heterocyclic group, an acyl group, an alkoxycarbonyl group, a carbamoyl group, a sulfonyl group or a sulfamoyl group. $R_N$ may be further substituted with substituents which $R^1$, $R^4$, $R^5$, $R^8$, $R^9$, $R^{12}$, $R^{13}$ and $R^{16}$ of the formula (PC-1) may take. As $L^1$, **—$SO_2$—*, **—$SO_2NR_N$—*, **—CO—*, **—$CONR_N$—*, or **—COO—* is preferably used, **—$SO_2$—*, **—$SO_2NR_N$—* or **—$CONR_N$—* is more preferably used and **—$SO_2$—* or **—$SO_2NR_N$—* is particularly preferably used. As $R_N$, a hydrogen atom, alkyl group, aryl group or heterocyclic group is preferably used, a hydrogen atom, alkyl group having 1 to 20 carbon atoms, aryl group having 6 to 20 carbon atoms or heterocyclic group having 1 to 20 carbon atoms is more preferably used, a hydrogen atom, alkyl group having 1 to 10 carbon atoms, aryl group having 6 to 10 carbon atoms or heterocyclic group having 1 to 10 carbon atoms is still more preferably used and a hydrogen atom or alkyl group having 1 to 6 carbon atoms is particularly preferably used.

$R^{17}$ represents a hydrogen atom, an alkyl group, an aryl group or a heterocyclic group. When $R^{17}$ represents an alkyl group, an aryl group or a heterocyclic group, these groups may be further substituted with substituents which $R^1$, $R^4$, $R^5$, $R^8$, $R^9$, $R^{12}$, $R^{13}$ and $R^{16}$ of the formula (PC-1) may take. As $R^{17}$, an alkyl group or aryl group is preferably used and an alkyl group is particularly preferably used. As $R^{17}$, an alkyl group having 1 to 30 carbon atoms, preferably 1 to 20 carbon atoms and still more preferably 1 to 10 carbon atoms is used.

$R^{17}$ is preferably substituted with a hydrophilic group W. Here, the hydrophilic group indicates a carboxyl group, sulfo group, phosphoric acid group, group having a nitrogen quaternary salt structure, group having a phosphorous quaternary salt structure or polyethyleneoxy group. When the hydrophilic group is a carboxyl group, sulfo group or phosphoric acid group, it may have a counter cation according to the need. As the counter cation, a metal cation, ammonium ion, group having a nitrogen quaternary salt structure or group a phosphorous quaternary salt structure is used.

When W is a group having a nitrogen quaternary salt structure or group having a phosphorous quaternary salt structure, it may have a counter anion according to the need. As the counter anion, for example, a halogen ion, sulfuric acid ion, nitric acid ion, phosphoric acid ion, oxalic acid ion, alkanesulfonic acid ion, arylsulfonic acid ion, alkanecarboxylic acid ion or arylcarboxylic acid ion may be selected. As the hydrophilic group, a carboxyl group, sulfo group or phosphoric acid group is preferable and a carboxyl group or sulfo group is more preferable. In this case, as the counter cation, $Li^+$, $Na^+$, $K^+$, $Mg^{2+}$, $Ca^{2+}$ or $NH_4^+$ is preferably used, $Li^+$, $Na^+$, $K^+$ or $NH_4^+$ is more preferably used and $Li^+$ or $Na^+$ is particularly preferably used.

When $R^1$, $R^4$, $R^5$, $R^8$, $R^9$, $R^{12}$, $R^{13}$ and $R^{16}$ are respectively a substituent in the formula (PC-1), these groups may respectively take substituents selected from the same group as the substituents which R, R' or R" may take. These substituents may be substituted with these substituents.

As the substituent, a halogen atom, alkyl group, alkenyl group, alkynyl group, aryl group, heterocyclic group (any substituted position is allowed), heterocyclic group containing a quaternary nitrogen atom (e.g., a pyridinio group, imidazolio group, quinolinio group and isoquinolinio group), acyl group, alkoxycarbonyl group, aryloxycarbonyl group, carbamoyl group, carboxy group or its salt, sulfonylcarbamoyl group, acylcarbamoyl group, sulfamoylcarbamoyl group, carbazoyl group, oxalyl group, oxamoyl group, cyano group, thiocarbamoyl group, sulfonyloxy group, imide group, sulfamoylamino group, semicarbazide group, thiosemicarbazide group, nitro group, (alkyl or aryl)sulfonyl group, (alkyl or aryl)sulfinyl group, sulfo group or its salt, sulfamoyl group, acylsulfamoyl group, sulfonylsulfamoyl group or its salt or group containing a phosphoric acid amide or a phosphate structure is used. An alkyl group, aryl group, heterocyclic group, acyl group, alkoxycarbonyl group, carbamoyl group, carboxy group or its salt, oxalyl group, oxamoyl group, cyano group, imide group, sulfamoylamino group, (alkyl or aryl)sulfonyl group, (alkyl or aryl)sulfinyl group, sulfo group or its salt, sulfamoyl group, acylsulfamoyl group or sulfonylsulfamoyl group or its salt is preferably used. An aryl group, heterocyclic group, acyl group, alkoxycarbonyl group, carbamoyl group, carboxy group or its salt, (alkyl or aryl)sulfonyl group, (alkyl or aryl)sulfinyl group, sulfo group or its salt or sulfamoyl group is more preferably used.

In the compounds represented by the formula (PC-1), at least four or more of $R^1$, $R^4$, $R^5$, $R^8$, $R^9$, $R^{12}$, $R^{13}$ and $R^{16}$ are preferably groups represented by the formula (I) and at least one of each pair of $R^1$ and $R^4$, $R^5$ and $R^8$, $R^9$ and $R^{12}$ and $R^{13}$ and $R^{16}$ is more preferably a group represented by the formula (I). It is particularly preferable that one of each pair of $R^1$ and $R^4$, $R^5$ and $R^8$, $R^9$ and $R^{12}$ and $R^{13}$ and $R^{16}$ be a group represented by the formula (I) and the other is a hydrogen atom. When plural groups represented by the formula (I) are contained in the same molecule, they may be the same or different.

In the formula (PC-1), $R^2$, $R^3$, $R^6$, $R^7$, $R^{10}$, $R^{11}$, $R^{14}$ and $R^{15}$ respectively represent a hydrogen atom or a substituent. The substituent so-called here is selected from the same range of substituents that $R^1$, $R^4$, $R^5$, $R^8$, $R^9$, $R^{12}$, $R^{13}$ and $R^{16}$ represented by the formula (PC-1) may take.

As $R^1$, $R^4$, $R^5$, $R^8$, $R^9$, $R^{12}$, $R^{13}$ or $R^{16}$, a hydrogen atom, halogen atom, carboxyl group, alkoxycarbonyl group, acyl group, sulfo group, sulfamoyl group, sulfonyl group, alkyl group, aryl group or heterocyclic group is preferably used, a hydrogen atom, halogen atom, sulfo group, sulfamoyl group or sulfonyl group is more preferably used and a hydrogen atom, sulfo group or halogen atom is particularly preferably used.

Generally, in a phthalocyanine compound having plural substituents, position isomers differing in the positions at which these substituents are bonded can exist. In the compounds represented by the formula (PC-1) according to the invention, the existence of several types of isomers is inferred without exceptions as the case may be. Though the phthalocyanine compound may be used as a single compound in the invention, it may be used as a mixture of position isomers. When the phthalocyanine compound is used as a mixture of position isomers, there is no limitation to the number of position isomers to be mixed, the substitution positions of substituents in each position isomer and the ratio of position isomers to be mixed.

Examples of the compound represented by the formula (PC-1) to be used in the invention will be shown below.

However, the following examples are not intended to be limiting of the invention. In the following compound examples, a mixture of position isomers is expressed as one compound.

Compound

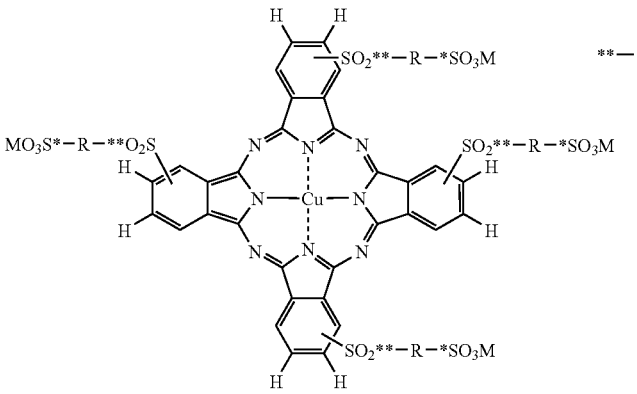

| **−R−* = | Compound M = Li | M = Na | M = K |
|---|---|---|---|
| **−$CH_2CH_2$−* | 1 | 10 | 19 |
| **−$CH_2CH_2CH_2$−* | 2 | 11 | 20 |
| **−$CH_2CH_2CH_2CH_2$−* | 3 | 12 | 21 |
| **−$CH_2CH_2CH_2CH_2CH_2$−* | 4 | 13 | 22 |
| **−$CH_2CH_2$−$(OCH_2CH_2)n$−* | | | |
| n = 1 | 5 | 14 | 23 |
| 2 | 6 | 15 | 24 |
| 3 | 7 | 16 | 25 |
| 4 | 8 | 17 | 26 |
| 5 | 9 | 18 | 27 |

-continued

| | Compound M = Li | Compound M = Na |
|---|---|---|
| 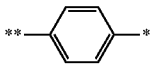 | 28 | 31 |
| 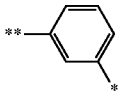 | 29 | 32 |
| 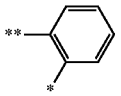 | 30 | 33 |

| | Compound M = Li | Compound M = Na |
|---|---|---|
| 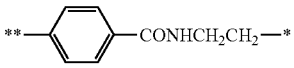 | 34 | 37 |
| 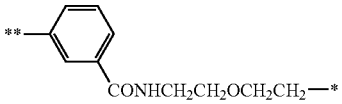 | 35 | 38 |
| 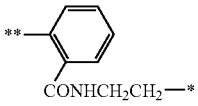 | 36 | 39 |

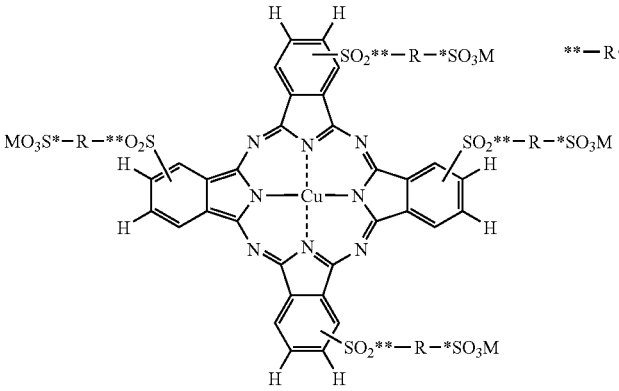

| **—R—* = | Compound | |
|---|---|---|
| **—$CH_2CH_2$—* | 40 | M = Li & $NH_4$ (Li/$NH_4$ = 3/1) |
| | 41 | M = Li & $NH_4$ (Li/$NH_4$ = 2/2) |
| | 42 | M = Na & $NH_4$ (Na/$NH_4$ = 3/1) |
| | 43 | M = Na & $NH_4$ (Na/$NH_4$ = 2/2) |
| | 44 | M = Na & $NH_4$ (Na/$NH_4$ = 1/3) |
| **—$CH_2CH_2CH_2$—* | 45 | M = Li & $NH_4$ (Li/$NH_4$ = 3/1) |
| | 46 | M = Li & $NH_4$ (Li/$NH_4$ = 2/2) |
| | 47 | M = Li & $NH_4$ (Li/$NH_4$ = 1/3) |
| | 48 | M = Na & $NH_4$ (Na/$NH_4$ = 3/1) |
| | 49 | M = Na & $NH_4$ (Na/$NH_4$ = 2/2) |
| | 50 | M = Na & $NH_4$ (Na/$NH_4$ = 1/3) |
| | 51 | M = K & $NH_4$ (K/$NH_4$ = 3/1) |
| | 52 | M = K & $NH_4$ (K/$NH_4$ = 2/2) |
| | 53 | M = K & $NH_4$ (K/$NH_4$ = 1/3) |
| | 54 | M = $Et_4N$ |
| **—$CH_2CH_2CH_2CH_2$—* | 55 | M = Li & $NH_4$ (Li/$NH_4$ = 3/1) |
| | 56 | M = Li & $NH_4$ (Li/$NH_4$ = 2/2) |
| | 57 | M = Na & $NH_4$ (Na/$NH_4$ = 3/1) |
| | 58 | M = Na & $NH_4$ (Na/$NH_4$ = 2/2) |
| | 59 | M = Na & $NH_4$ (Na/$NH_4$ = 1/3) |

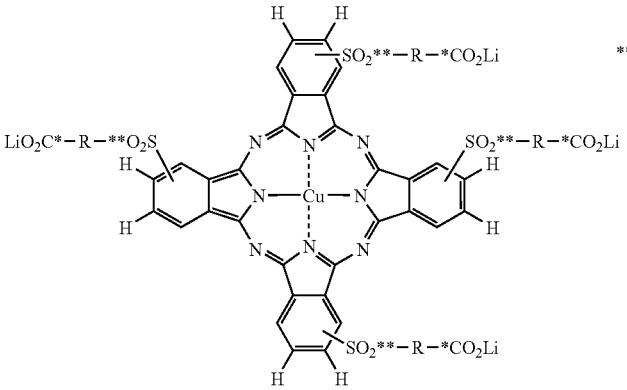

| **—R—* = | Compound |
|---|---|
| **—$CH_2CH_2$—* | 60 |
| **—$CH_2CH_2CH_2$—* | 61 |
| **—$CH_2CH_2CH_2CH_2$—* | 62 |
| **—$CH_2CH_2CH_2CH_2CH_2$—* | 63 |
| **—$CH_2CH_2$—$(OCH_2CH_2)n$—* | 64 |
| n = 1 | 65 |
| 2 | 66 |
| 3 | 67 |
| 4 | 68 |
| 5 | 69 |

| | Compound |
|---|---|
| 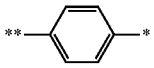 | 70 |
| 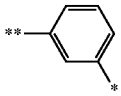 | 71 |
| 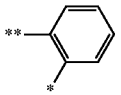 | 72 |

| | Compound |
|---|---|
| 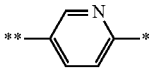 | 73 |
| 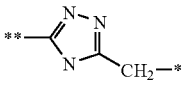 | 74 |
| 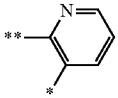 | 75 |

-continued
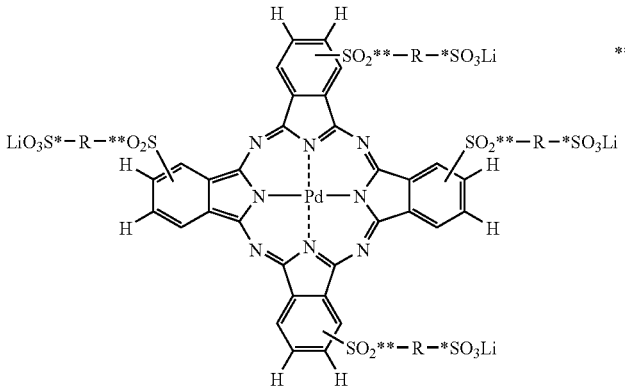
| **—R—* = | Compound |
|---|---|
| **—$CH_2CH_2$—* | 76 |
| **—$CH_2CH_2CH_2$—* | 77 |
| **—$CH_2CH_2CH_2CH_2$—* | 78 |
| **—$CH_2CH_2CH_2CH_2CH_2$—* | 79 |
| **—$CH_2CH_2$—$(OCH_2CH_2)n$—* | |
| n = 1 | 80 |
| 2 | 81 |
| 3 | 82 |
| 4 | 83 |
| 5 | 84 |
| | Compound |
|---|---|
| 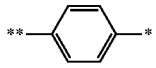 | 85 |
| 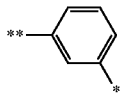 | 86 |
| 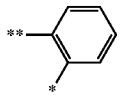 | 87 |
| | Compound |
|---|---|
| 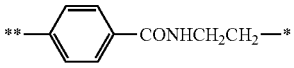 | 88 |
| 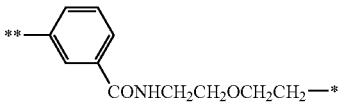 | 89 |
| 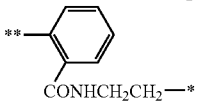 | 90 |
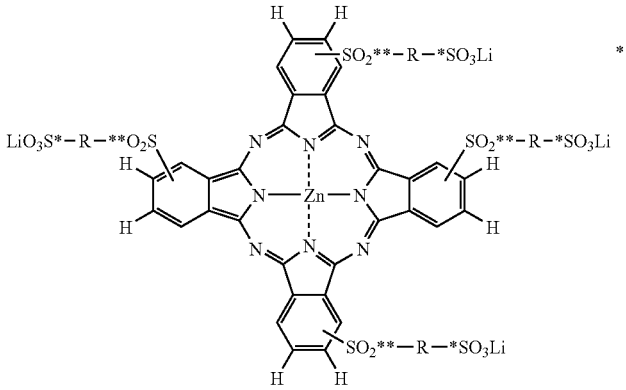
| **—R—* = | Compound |
|---|---|
| **—$CH_2CH_2$—* | 91 |
| **—$CH_2CH_2CH_2$—* | 92 |
| **—$CH_2CH_2CH_2CH_2$—* | 93 |
| **—$CH_2CH_2CH_2CH_2CH_2$—* | 94 |
| **—$CH_2CH_2$—$(OCH_2CH_2)n$—* | |
| n = 1 | 95 |
| 2 | 96 |
| 3 | 97 |
| 4 | 98 |
| 5 | 99 |
| | Compound |
|---|---|
| 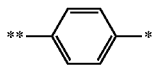 | 100 |
| 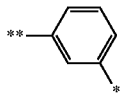 | 101 |
| 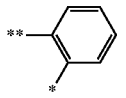 | 102 |
| | Compound |
|---|---|
| 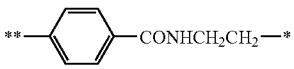 | 103 |
| 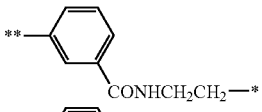 | 104 |
| 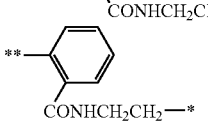 | 105 |

-continued
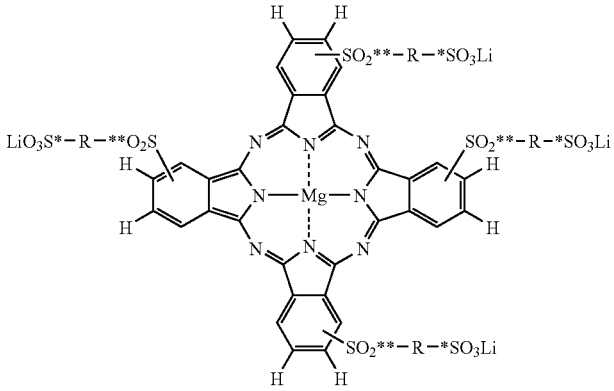
| **—R—* = | Compound |
|---|---|
| **—$CH_2CH_2$—* | 106 |
| **—$CH_2CH_2CH_2$—* | 107 |
| **—$CH_2CH_2CH_2CH_2$—* | 108 |
| **—$CH_2CH_2CH_2CH_2CH_2$—* | 109 |
| **—$CH_2CH_2$—$(OCH_2CH_2)n$—* | |
| n = 1 | 110 |
| 2 | 111 |
| 3 | 112 |
| 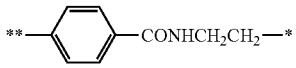 | 113 |
| 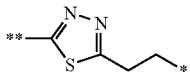 | 114 |
| 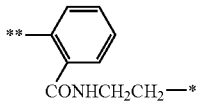 | 115 |
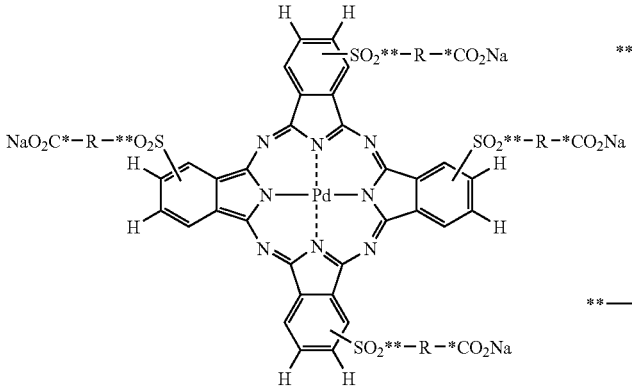
| **—R—* = | Compound |
|---|---|
| **—$CH_2CH_2CH_2$—* | 116 |
| **—$CH_2CH_2CH_2CH_2$—* | 117 |
| **—$CH_2CH_2CH_2CH_2CH_2$—* | 118 |
| **—$CH_2CH_2$—$(OCH_2CH_2)n$—* | |
| n = 1 | 119 |
| 2 | 120 |
| 3 | 121 |
| | Compound |
|---|---|
| 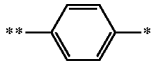 | 122 |
| 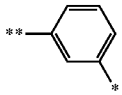 | 123 |
| | Compound |
|---|---|
| 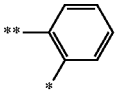 | 124 |
| 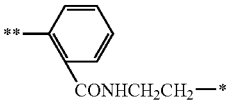 | 125 |
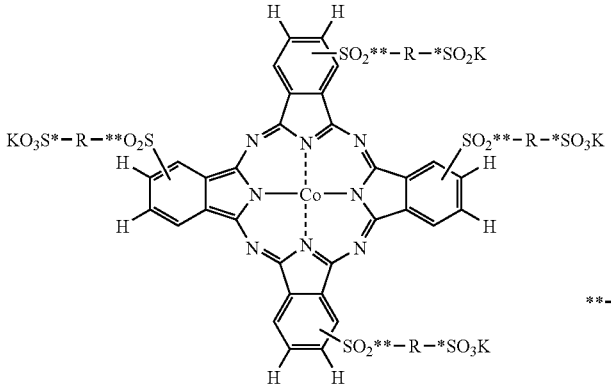
| **—R—* = | Compound |
|---|---|
| **—$CH_2CH_2CH_2$—* | 126 |
| **—$CH_2CH_2CH_2CH_2$—* | 127 |
| **—$CH_2CH_2CH_2CH_2CH_2$—* | 128 |
| **—$CH_2CH_2$—$(OCH_2CH_2)n$—* | |
| n = 1 | 129 |
| 2 | 130 |
| 3 | 131 |
| | Compound |
|---|---|
| 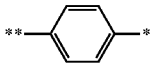 | 132 |
| 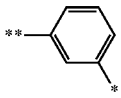 | 133 |
| | Compound |
|---|---|
| 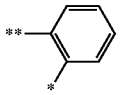 | 134 |
| 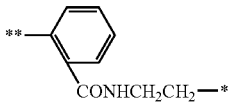 | 135 |

-continued
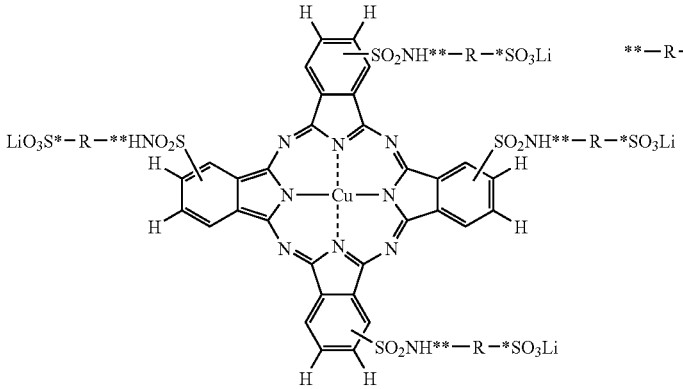
| **—R—* = | Compound |
|---|---|
| **—$CH_2CH_2$—* | 136 |
| **—$CH_2CH_2CH_2$—* | 137 |
| **—$CH_2CH_2CH_2CH_2$—* | 138 |
| **—$CH_2CH_2CH_2CH_2CH_2$—* | 139 |
| **—$CH_2CH_2$—$(OCH_2CH_2)n$—* | |
| n = 1 | 140 |
| 2 | 141 |
| 3 | 142 |
| | Compound |
|---|---|
| 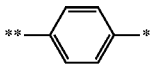 | 143 |
| 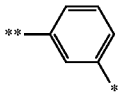 | 144 |
| 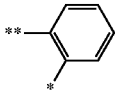 | 145 |
| | Compound |
|---|---|
| 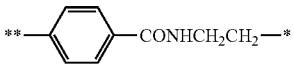 | 146 |
| 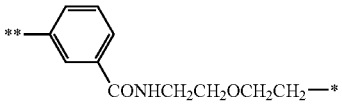 | 147 |
| 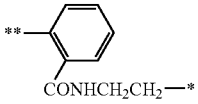 | 148 |
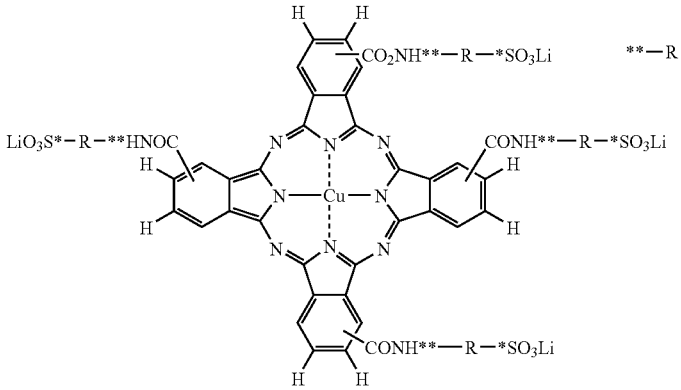
| **—R—* = | Compound |
|---|---|
| **—$CH_2CH_2$—* | 149 |
| **—$CH_2CH_2CH_2$—* | 150 |
| **—$CH_2CH_2CH_2CH_2$—* | 151 |
| **—$CH_2CH_2CH_2CH_2CH_2$—* | 152 |
| **—$CH_2CH_2$—$(OCH_2CH_2)n$—* | |
| n = 1 | 153 |
| 2 | 154 |
| 3 | 155 |
| | Compound |
|---|---|
| 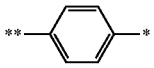 | 156 |
| 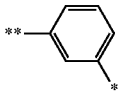 | 157 |
| 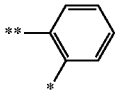 | 158 |
| | Compound |
|---|---|
| 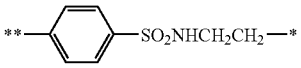 | 159 |
| 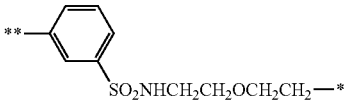 | 161 |
| 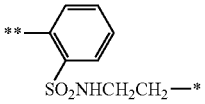 | 162 |

-continued
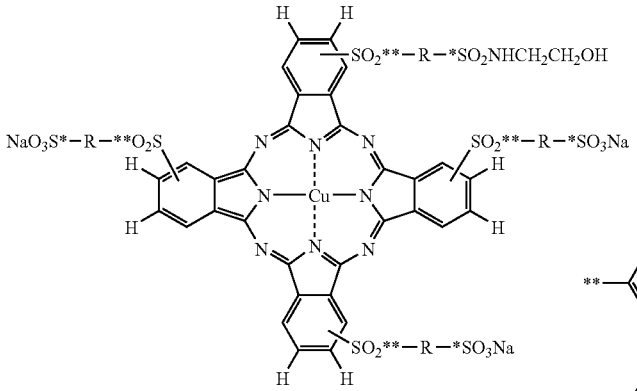
| **—R—* = | Compound |
|---|---|
| **—$CH_2CH_2CH_2$—* | 163 |
| **—$CH_2CH_2CH_2CH_2$—* | 164 |
| **—$CH_2CH_2CH_2CH_2CH_2$—* | 165 |
| **—$CH_2CH_2$—$(OCH_2CH_2)n$—* | |
| n = 1 | 166 |
| 2 | 167 |
| 3 | 168 |
| | Compound |
|---|---|
| 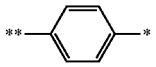 | 169 |
| 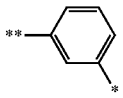 | 170 |
| 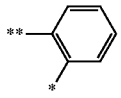 | 171 |
| 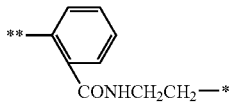 | 172 |
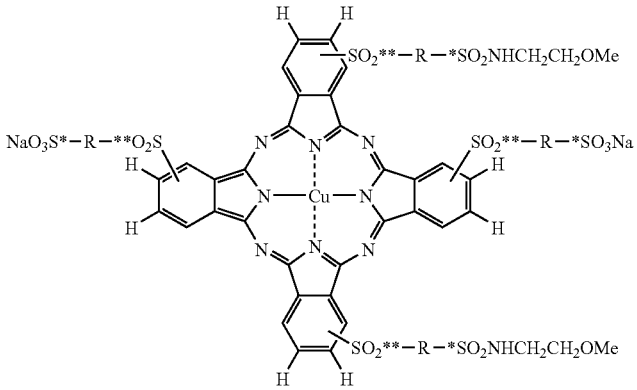
| **—R—* = | Compound |
|---|---|
| **—$CH_2CH_2CH_2$—* | 173 |
| **—$CH_2CH_2CH_2CH_2$—* | 174 |
| **—$CH_2CH_2CH_2CH_2CH_2$—* | 175 |
| **—$CH_2CH_2$—$(OCH_2CH_2)n$—* | |
| n = 1 | 176 |
| 2 | 177 |
| 3 | 178 |
| 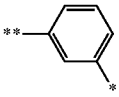 | 179 |
| 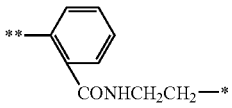 | 180 |
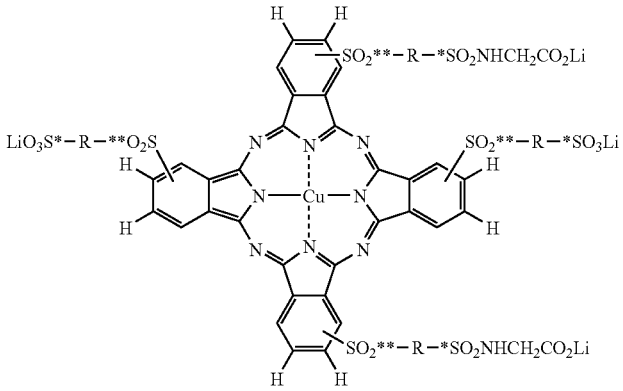
| **—R—* = | Compound |
|---|---|
| **—$CH_2CH_2CH_2$—* | 181 |
| **—$CH_2CH_2CH_2CH_2$—* | 182 |
| **—$CH_2CH_2CH_2CH_2CH_2$—* | 183 |
| **—$CH_2CH_2$—$(OCH_2CH_2)n$—* | |
| n = 1 | 184 |
| 2 | 185 |
| 3 | 186 |
| 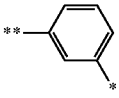 | 187 |
| 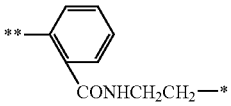 | 188 |

-continued
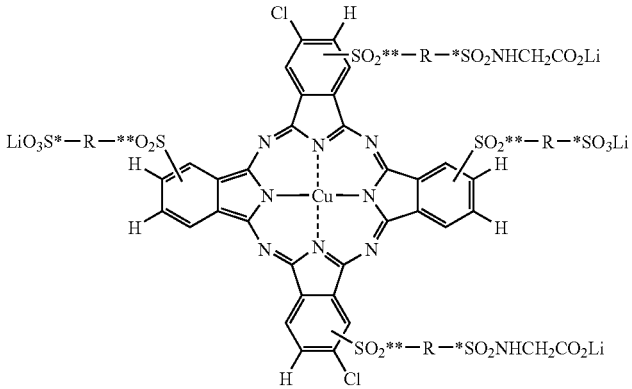
| Compound | |
|---|---|
| **—R—* = **—$CH_2CH_2CH_2$—* | 189 |
| **—$CH_2CH_2CH_2CH_2$—* | 190 |
| **—$CH_2CH_2CH_2CH_2CH_2$—* | 191 |
| 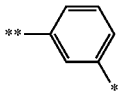 | 192 |
| 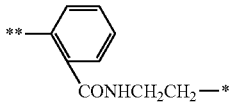 | 193 |
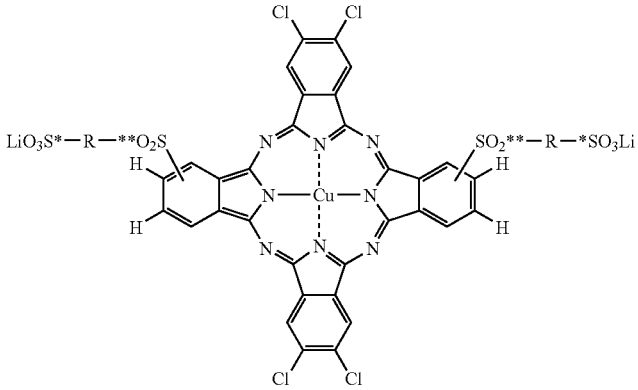
| Compound | |
|---|---|
| **—R—* = **—$CH_2CH_2CH_2$—* | 194 |
| **—$CH_2CH_2CH_2CH_2$—* | 195 |
| **—$CH_2CH_2CH_2CH_2CH_2$—* | 196 |
| 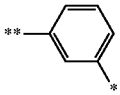 | 197 |
| 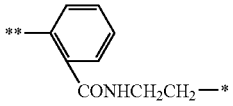 | 198 |
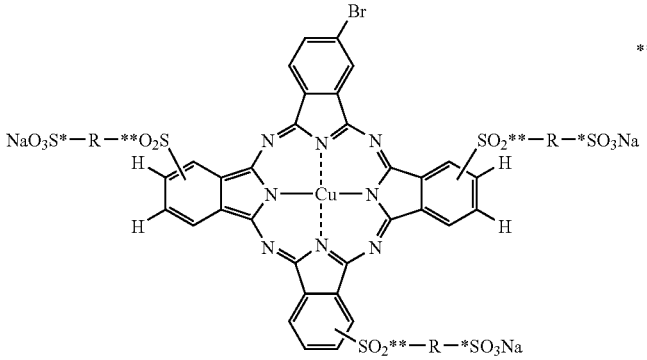
| Compound | |
|---|---|
| **—R—* = **—$CH_2CH_2CH_2$—* | 199 |
| **—$CH_2CH_2CH_2CH_2$—* | 200 |
| **—$CH_2CH_2CH_2CH_2CH_2$—* | 201 |
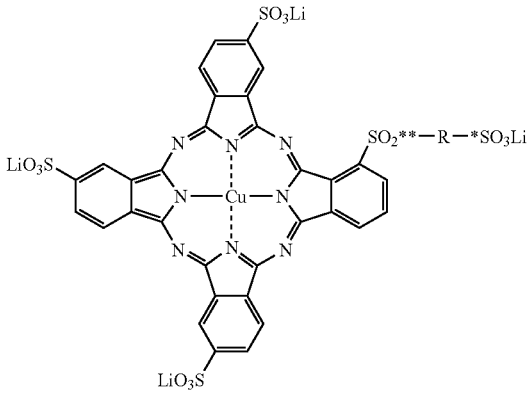
| Compound | |
|---|---|
| **—R—* = **—$CH_2CH_2CH_2$—* | 202 |
| **—$CH_2CH_2CH_2CH_2$—* | 203 |
| **—$CH_2CH_2CH_2CH_2CH_2$—* | 204 |
| 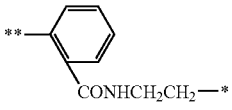 | 205 |

-continued
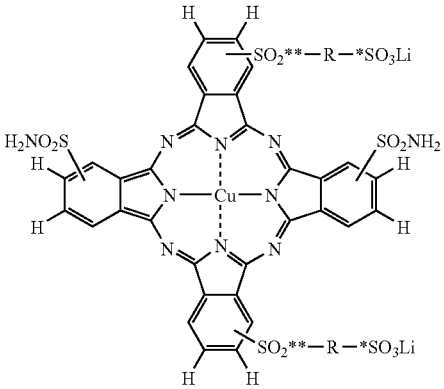
| **—R—* = | Compound |
|---|---|
| **—$CH_2CH_2$—* | 206 |
| **—$CH_2CH_2CH_2$—* | 207 |
| **—$CH_2CH_2CH_2CH_2$—* | 208 |
| **—$CH_2CH_2CH_2CH_2CH_2$—* | 209 |
| **—$CH_2CH_2$—$(OCH_2CH_2)n$—* | |
| n = 1 | 210 |
| 2 | 211 |
| 3 | 212 |
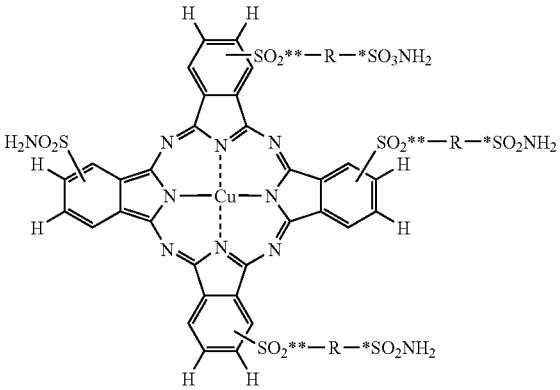
| **—R—* = | Compound |
|---|---|
| **—$CH_2CH_2$—* | 213 |
| **—$CH_2CH_2CH_2$—* | 214 |
| **—$CH_2CH_2CH_2CH_2$—* | 215 |
| **—$CH_2CH_2CH_2CH_2CH_2$—* | 216 |
| **—$CH_2CH_2$—$(OCH_2CH_2)n$—* | |
| n = 1 | 217 |
| 2 | 218 |
| 3 | 219 |
<<Synthesis of the Exemplified Compound 2>>
Synthesis of Compound 2
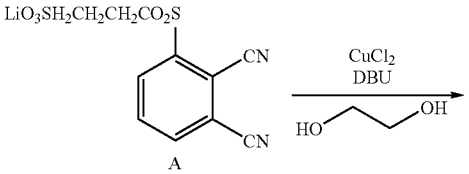
A
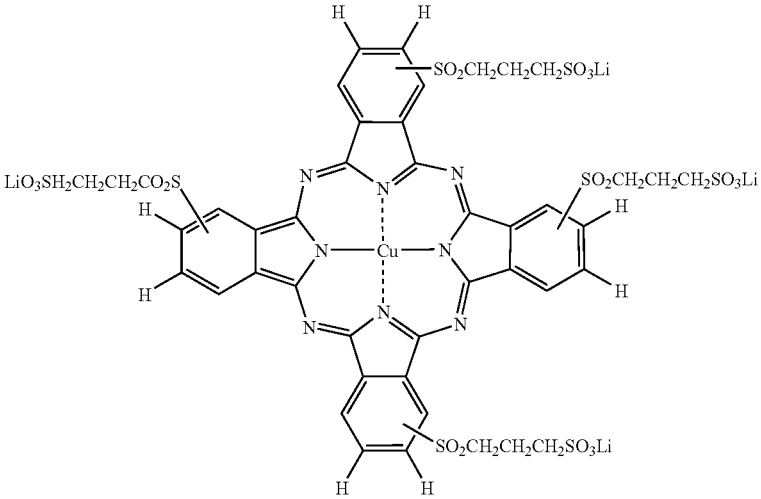
Compound 2

$CuCl_2$ (134 mg, 1 mmol) was added to an ethylene glycol solution (10 ml) of a synthetic intermediate A (1.26 g, 4 mmol) and the mixture was heated to 100° C. DBU (1.52 g, 10 mmol) was added to the reaction mixture, which was then stirred at 100° C. for 10 hours. The reaction mixture was acidified by hydrochloric acid and LiCl was added to the reaction mixture to precipitate a crude product of phthalocyanine. The crude product obtained here was purified by column chromatography using Sephadex G-15 as a carrier to obtain 67 mg (yield: 5%) of a mixture of the exemplified compound 2.

The phthalocyanine compound in the invention is preferably those which are reduced in residual color, provide high image quality and have a halation preventive effect. When the phthalocyanine compound is contained in the photothermographic material, the ratio of the light absorption density of the light-sensitive material at 610 nm to the light absorption density of the light-sensitive material at the wavelength of exposure light is 0.2 or more and 0.8 or less.

It is preferable that the light absorption density of the light-sensitive material at 610 nm be 0.1 or more and 0.3 or less and the light absorption density of the light-sensitive material at the wavelength of exposure light is 0.3 or more and 0.8 or less. It is more preferable that the ratio of the light absorption density of the light-sensitive material at 610 nm to the light absorption density of the light-sensitive material at the wavelength of exposure light is 0.3 or more and 0.6 or less.

<<Addition Method>>

The phthalocyanine compound in the invention is preferably soluble in water and is preferably used in the form of aqueous solution prepared in advance using water as a medium in the production of the light-sensitive material. The water-soluble phthalocyanine compound according to the invention is contained in the aqueous solution in an amount of about 0.1% by weight to about 30% by weight, preferably about 0.5% by weight to about 20% by weight and more preferably about 1% by weight to about 8% by weight. The aqueous solution may further contain an aqueous organic solvent and an auxiliary additive. As to each content, the content of the water-soluble organic solvent is about 0% by weight to about 30% by weight and preferably about 5% by weight to about 30% by weight and the content of the auxiliary additive is about 0% by weight to about 5% by weight and preferably about 0% by weight to about 2% by weight.

Specific examples of water-soluble organic solvent, which can be used at preparing an aqueous solution of water-soluble phthalocyanine compound according to the invention, include alkanols having 1 to 4 carbon atoms such as methanol, ethanol, propanol, isopropanol, butanol, isobutanol, sec-butanol, tert-butanol and the like, carboxylic amides such as N,N-dimethylformamide, N,N-dimethylacetamide and the like, lactams such as □-caprolactam, N-methylpyrrolidine-2-one and the like, ureas, cyclic ureas such as 1,3-dimethylimidazolidine-2-one, 1,3-dimethylhexahydropyrimide-2-one and the like, ketones or ketoalcohols such as acetone, methylethylketone, 2-methyl-2-hydroxypentan-4-one and the like, ethers such as tetrahydrofuran, dioxane and the like, monomers, oligomer or polyalkylene glycol or thioglycol having alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol and the like, polyol(triol) such as glycerin, hexane-1,2,6-triol and the like, alkylether having 1 to 4 carbon atoms of polyhydric alcohol such as ethylene glycol monomethyl ether, ethylene glycol monoethyl ether, diethylene glycol monomethyl ether, diethylene glycol monoethyl ether, triethylene glycol monomethyl ether, triethylene glycol monoethyl ether and the like, □-butylolactone, dimethyl sulfoxide, and the like. Two or more kinds of these water-soluble organic solvents may be used in combination.

Among the aforementioned water-soluble organic solvents, urea, N-methylpyrrolizine-2-one, and mono, di, or trialkylene glycol having an alkylene unit with 2 to 6 carbon atoms are preferable, and more preferably used are mono, di, or triethylene glycol, dipropylene glycol, dimethyl sulfoxide and the like. Particularly, N-methylpyrrolidine-2-one, diethylene glycol, dimethyl sulfoxide, and urea are used preferably, and urea is especially preferable.

It is to be noted that the water-soluble phthalocyanine compound of the invention will be diluted by mixing the aqueous solution further with various chemicals when the light-sensitive material is manufactured. It is therefore preferable to use a method in which a water-soluble organic solvent is contained in an amount range from 1 mol to 500 mol based on 1 mol of the content of the water-soluble metal phthalocyanine compound separately from the aqueous solution.

As the auxiliary additive, for example, an antiseptic agent, a pH control agent, a chelating agent, an anti-stain agent, a water-soluble ultraviolet ray absorbent, a water-soluble polymer, a dye solvent, a surfactant, and the like are added respectively, when necessary.

As the antiseptic agent, for example, sodium dihydroacetate, sodium sorbinate, sodium 2-pyridinethiol-1-oxide, sodium benzoate, sodium pentachloro phenol, benzoisothiazolinone and a salt thereof, p-hydroxybenzoic acid esters and the like can be used.

As the pH control agent, any compounds can be applied so long as they can control the pH of the prepared solution in a range of 4 to 11 without any bad effect. Preferred examples of the pH control agent include alkanolamines such as diethanolamine and triethanol amine, hydroxide of alkali metal such as lithium hydroxide, sodium hydroxide, and potassium hydroxide, and carbonate of alkali metal such as lithium carbonate, sodium carbonate, and potassium carbonate.

As the chelating agent, for example, sodium salts of ethylenediaminetetraacetic acid, sodium salts of nitrilotriacetic acid, sodium salts of hydroxyethyl ethylenediaminetriacetic acid, sodium salts of diethylene triaminepentaacetic acid, sodium salts of uracil diacetic acid and the like can be described. As the antistain agent, for example, hyposulfites, sodium thiosulfate, thioglycolic acid ammonium salt, diisopropyl ammonium nitrite, pentaerythrithol tetranitrate, and dicyclohexylammonium nitrite and the like can be described. As the water-soluble polymer, for example, polyvinyl alcohol, cellulose derivatives, polyamines, and polyimines and the like can be described. As the water-soluble ultraviolet ray absorbent, for example, sulfonated benzophenones, sulfonated benzotriazoles and the like can be described. As for the dye solvent, for example, ocaprolactam, ethylene carbonate, urea and the like can be described. As the surfactant, for example, known surfactants such as anionic, cationic and nonionic surfactant and the like can be described, and surfactant of acetyleneglycols and the like are also used preferably.

<<Layer to which the Metal Phthalocyanine Compound is to be Added>>

The metal phthalocyanine compound in the invention may be contained in at least one layer formed on the side of the support on which side the image forming layer is formed by application or in at least one layer formed on the opposite side of the support. It is preferable that the metal compound be contained in layers formed on both sides of the support. At this time, an embodiment is preferable in which the polyhalogen compound is contained in at least one layer formed on the side on which the image forming layer is formed by application.

<<Range of the Amount to be Added>>

As to the amount of the dye, it is preferable to use the dye in such an amount that the optical density (absorbance) measured at the wavelength to be intended does not exceed 1.5. The optical density is preferably 0.01 to 1.2, more preferably 0.05 to 1.0 and still more preferably 0.1 to 0.8. The amount of the dye used to obtain such a density is usually about 0.5 $mg/m^2$ to 200 $mg/m^2$, preferably about 1 $mg/m^2$ to 160 $mg/m^2$ and more preferably about 5 $mg/m^2$ to 120 $mg/m^2$.

(Magenta Dye)

In the invention, it is preferable to use a magenta dye together with the aforementioned metal phthalocyanine dye. Specific examples of the magenta dye may include azo dyes, azomethine dyes, quinone type dyes (e.g., anthraquinone dyes and naphthoquinone dyes), quinoline dyes (e.g., quinophthalone dyes), methine dyes (e.g., cyanine, merocyanine, allylidene, styryl or oxonol dyes), carbonium dyes (e.g., cationic dyes such as diphenylmethane dyes, triphenylmethane dyes, xanthene dyes and acridine dyes), indoaniline dyes, azine dyes (e.g., cationic dyes such as thiazine dyes, oxazine dyes and phenazine dyes), aza[18]π-electron type dyes (e.g., porphine dyes, tetraazaporphine dyes and phthalocyanine dyes), indigoid dyes (e.g., indigo or thioindigo dyes), squarilium dyes, croconium dyes, pyromethene dyes (may form a metal complex) and nitro•nitroso dyes. Any method including methods in which these dyes are added in the form of a solution, emulsion, solid fine particle dispersion and in the state of dye dipped in a mordant may be used to add these dyes.

Among these dyes, preferable examples include azo dyes, azomethine dyes, carbonium dyes and polymethine dyes and more preferable examples include azomethine dyes.

The azomethine dyes are preferably compounds represented by the following formula (IV).

Explanations will be furnished as to the compound represented by the formula (IV).

Formula (IV)

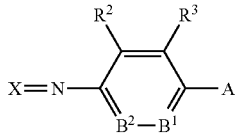

<<Explanations of Substituent and the Like>>

In the formula (IV), X represents a residual group of a color photographic coupler, A represents —$NR^4R^5$ or a hydroxy group, where $R^4$ and $R^5$ respectively represent a hydrogen atom, an aliphatic group, an aromatic group or a heterocyclic group. A is preferably —$NR^4R^5$. The above $R^4$ and $R^5$ are respectively preferably a hydrogen atom or an aliphatic group, more preferably a hydrogen atom, an alkyl group or a substituted alkyl group and still more preferably a hydrogen atom, an alkyl group having 1 to 18 carbon atoms or a substituted alkyl group having 1 to 18 carbon atoms. To describe in more detail, it is most preferable that $R^4$ and $R^5$ be both methyl groups or ethyl groups, $R^4$ be an ethyl group and $R^5$ be a 2-hydroxyethyl group or $R^4$ be an ethyl group and $R^5$ be a (2-methanesulfonylamino)ethyl group.

In the above formula (IV), $B^1$ represents =$C(R^6)$— or =N— and $B^2$ represents —$C(R^7)$= or —N=. The case where $B^1$ and $B^2$ are not both —N= at the same time is preferable and the case where $B^1$ is =$C(R^6)$— and $B^2$ is —$C(R^7)$= is more preferable. In the formula (IV) in this case, $R^2$, $R^3$, $R^6$ and $R^7$ respectively represent a halogen atom, an aliphatic group, an aromatic group, a heterocyclic group, a cyano group, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$ or —$NR^{70}SO_2R^{71}$ wherein $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$ and $R^{71}$ respectively represent a hydrogen atom, an aliphatic group or an aromatic group.

The above $R^2$ and $R^7$ are respectively preferably a hydrogen atom, a halogen atom, an aliphatic group, —$OR^{51}$, —$NR^{62}CONR^{63}R^{64}$, —$NR^{65}C_2R^{66}$, —$NR^{68}COR^{69}$ or —$NR^{70}SO_2R^{71}$, more preferably a hydrogen atom, a fluorine atom, a chlorine atom, an alkyl group, a substituted alkyl group, —$NR^{62}CONR^{63}R^{64}$ or —$NR^{68}COR^{69}$, still more preferably a hydrogen atom, a chlorine atom, an alkyl group having 1 to 10 carbon atoms or a substituted alkyl group having 1 to 10 carbon atoms and particularly preferably a hydrogen atom, an alkyl group having 1 to 4 carbon atoms or a substituted alkyl group having 1 to 4 carbon atoms. To describe in more detail, it is most preferable that $R^2$ be a hydrogen atom or a methyl group and $R^7$ be a hydrogen atom.

The above $R^3$ and $R^6$ are respectively preferably a hydrogen atom, a halogen atom or an aliphatic group, more preferably a hydrogen atom, a fluorine atom, a chlorine atom, an alkyl group or a substituted alkyl group, still more preferably a hydrogen atom, a chlorine atom, an alkyl group having 1 to 10 carbon atoms or a substituted alkyl group having 1 to 10 carbon atoms and most preferably a hydrogen atom, an alkyl group having 1 to 4 carbon atoms or a substituted alkyl group having 1 to 4 carbon atoms. To describe in more detail, it is most preferable that $R^3$ and $R^7$ be both hydrogen atoms.

In the aforementioned formula (IV), $R^2$ and $R^3$, $R^3$ and $R^4$, $R^4$ and $R^5$, $R^5$ and $R^6$, and $R^6$ and $R^7$ may bind each other to form a ring. The combination to form a ring is preferably $R^3$ and $R^4$, $R^4$ and $R^5$, or $R^5$ and $R^6$. The ring which is formed by bonding the aforementioned $R^2$ and $R^3$, or $R^6$ and $R^7$, is preferably a 5 or 6 membered ring. The rings are preferably an aromatic ring (for example, a benzene ring) or unsaturated heterocyclic ring (for example, a pyridine ring, an imidazole ring, a pyrimidine ring, a thiazole ring, a pyrimidine ring, a pyrrole ring or a furan ring).

The ring which is formed by bonding the aforementioned $R^3$ and $R^4$, or $R^5$ and $R^6$, is preferably a 5 or 6 membered ring. Examples of the ring include a tetrahydroquinoline ring and a dihydroindole ring. The ring, which is formed by bonding the aforementioned $R^4$ and $R^5$, is preferably a 5 or 6 membered ring. Examples of rings include a pyrrolizine ring, a piperidine ring, and a morpholine ring.

In the present specification, the aliphatic group means an alkyl group, a substituted alkyl group, an alkenyl group, a substituted alkenyl group, an alkynyl group, a substituted alkynyl group, an aralkyl group, and a substituted aralkyl group. The aforementioned alkyl group may have a branch or may form a ring. The alkyl group preferably has 1 to 20 carbon atoms, and more preferably 1 to 18 carbon atoms. The alkyl moiety in the aforementioned substituted alkyl group is similar to the above mentioned alkyl group.

The aforementioned alkenyl group may have a branch or may form a ring. The alkenyl group has preferably 2 to 20 carbon atoms, and more preferably 2 to 18 carbon atoms. The alkenyl moiety in the aforementioned substituted alkenyl group is similar to the above mentioned alkenyl group. The aforementioned alkynyl group may have a branch or may form a ring. The alkynyl group has preferably 2 to 20 carbon atoms, and more preferably 2 to 18 carbon atoms. The alkynyl moiety in the aforementioned substituted alkynyl group is similar to the above mentioned alkynyl group.

The alkyl moiety in the aforementioned aralkyl group and in the aforementioned substituted aralkyl group is similar to the above mentioned alkyl group. The aryl moiety in the aforementioned aralkyl group and in the aforementioned substituted aralkyl group is similar to the aryl group mentioned below. Examples of the substituent of the alkyl moiety in the aforementioned substituted alkyl group, substituted alkenyl group, substituted alkynyl group and substituted aralkyl group include a halogen atom, cyano, nitro, a heterocyclic group, $—OR^{141}$, $—SR^{142}$, $—CO_2R^{143}$, $—NR^{144}R^{145}$, $—CONR^{146}R^{147}$, $—SO_2R^{148}$, $—SO_3R^{149}$, and $—SO_2NR^{150}R^{151}$. $R^{141}$, $R^{142}$, $R^{143}$, $R^{144}$, $R^{145}$, $R^{146}$, $R^{147}$, $R^{148}$, $R^{149}$, $R^{150}$, and $R^{151}$ are each independently a hydrogen atom, an aliphatic group, or an aromatic group. In addition to these, R143 and R149 may be a metal atom selected from Li, Na, K, Mg and Ca. In this case, Li, Na, and K are preferable, and Na is more preferable. Examples of the substituent of the aryl moiety in the aforementioned substituted aralkyl group are similar to the examples of the substituent of the substituted aryl group described below.

In the present specification, an aromatic group means an aryl group and a substituted aryl group.

The aryl group is preferably phenyl or naphthyl, and particularly preferably phenyl. The aryl moiety of the aforementioned substituted aryl group is similar to the above-mentioned aryl group. Examples of the substituent of the aforementioned substituted aryl group include a halogen atom, cyano, nitro, an aliphatic group, a heterocyclic group, $—OR^{161}$, $—SR^{162}$, $—CO_2R^{163}$, $—NR^{164}R^{165}$, $—CONR^{166}R^{167}$, $—SO_2R^{168}$, $—SO_3R^{169}$ and $SO_2NR^{170}R^{171}$. $R^{161}$, $R^{162}$, $R^{163}$, $R^{164}$, $R^{165}$, $R^{166}$, $R^{167}$, $R^{168}$, $R^{169}$, $R^{170}$, and $R^{171}$ are each independently a hydrogen atom, an aliphatic group, or an aromatic group. In addition to these, $R^{163}$ and $R^{169}$ may be a metal atom selected from Li, Na, K, Mg, and Ca. In this case, Li, Na, and K are preferable, and Na is more preferable.

In the present specification, a heterocyclic group preferably contains a 5 or 6 membered saturated or unsaturated heterocycle. A heterocycle may be condensed with an aliphatic ring, aromatic ring, or other heterocycle. Examples of the heteroatom in the heterocycle include B, N, O, S, Se and Te. As a heteroatom, N, O, and S are preferable. The heterocycle preferably has a free monovalent carbon atom (the heterocyclic group binds at a carbon atom).

Examples of the saturated heterocycle include a pyrrolidine ring, a morpholine ring, 2-bora-1,3-dioxolane ring, and 1,3-thiazoline ring. Examples of the unsaturated heterocycle include an imidazole ring, a thiazole ring, a benzothiazole ring, a benzoxazole ring, a benzotriazole ring, a benzoselenazole ring, a pyridine ring, a pyrimidine ring, and a quinoline ring. The heterocyclic group may have a substituent. Examples of the substituent include a halogen atom, cyano, nitro, an aliphatic group, an aromatic group, a heterocyclic group, $—OR^{172}$, $—SR^{173}$, $—CO_2R^{174}$, $—NR^{175}R^{176}$, $—CONR^{177}R^{178}$, $—SO_3R^{179}$, and $SO_2NR^{180}R^{181}$. $R^{172}$, $R^{173}$, $R^{174}$, $R^{175}$, $R^{176}$, $R^{177}$, $R^{178}$, $R^{179}$, $R^{180}$, and $R^{181}$ are each independently a hydrogen atom, an aliphatic group, or an aromatic group.

In the azomethine dye (IV), a coupler represented by X is preferably the coupler mention below. U.S. Pat. Nos. 4,310,619 and 4,351,897, European Patent (EP) No. 73636, U.S. Pat. Nos. 3,061,432 and 3,725,067, Research Disclosure Nos. 24220 (June, 1984) and 24230 (June, 1984), JP-A Nos. 60-33552, 60-43659, 61-72238, 60-35730, 55-118034, and 60-185951, U.S. Pat. Nos. 4,500,630, 4,540,654, and 4,556,630, WO No. 88/04795, JP-A No. 3-39737 {L-57 (page 11, at the lower right), L-68 (page 12, at the lower right), L-77 (page 13, at the lower right)}, EP No. 456257 {[A-4]-63 (page 134), [A-4]-73, -75 (page 139){, EP No. 486965 {M-4, -6 (page 26), M-7 (page 27)}, EP No. 571959A {M-45 (page 19), JP-A No. 5-204106 (M–1) (page 6)}, JP-A No. 4-362631 (paragraph No. 0237, M-22), and U.S. Pat. Nos. 3,061,432 and 3,725,067.

Specific compound examples will be shown below: however, these examples are not intended to be limiting of the invention.

(1)

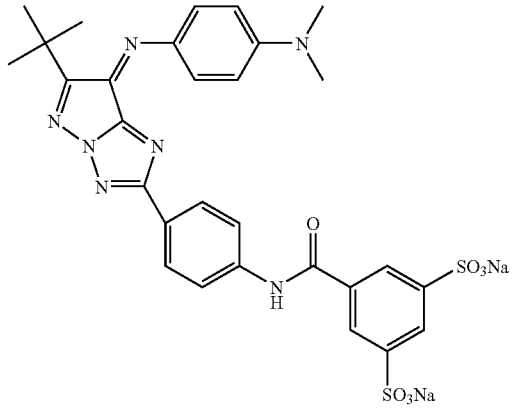

(2)

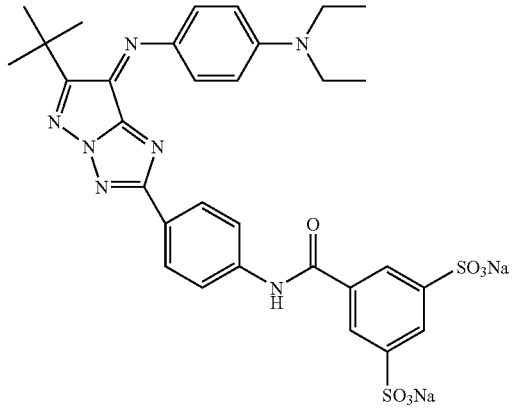

-continued
(3)
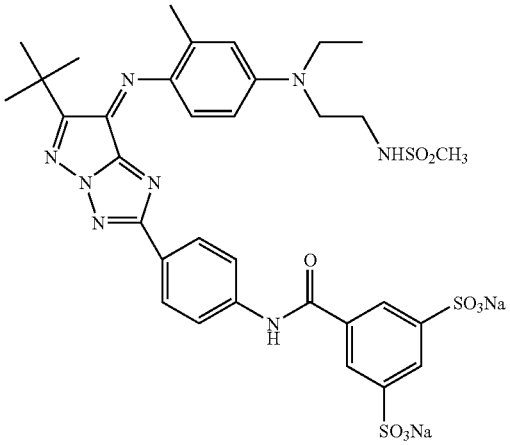
(4)
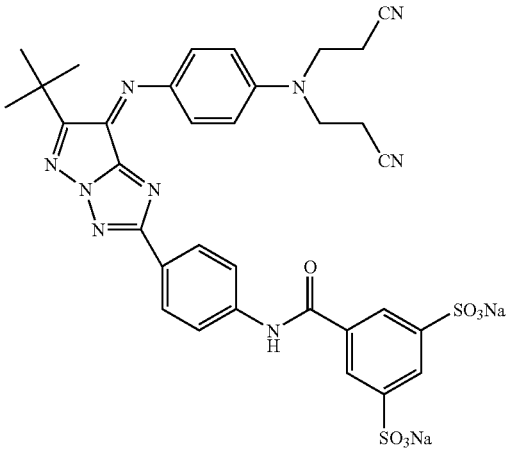
(5)
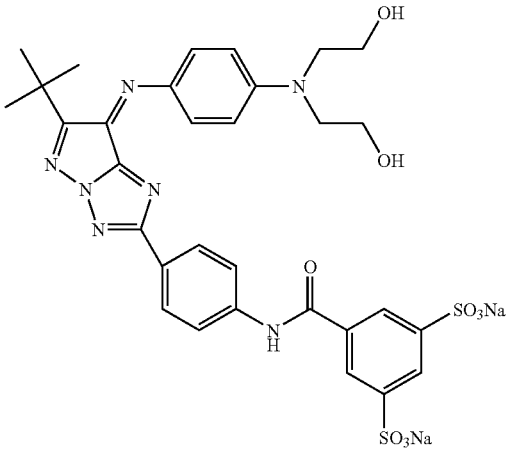
-continued
(6)
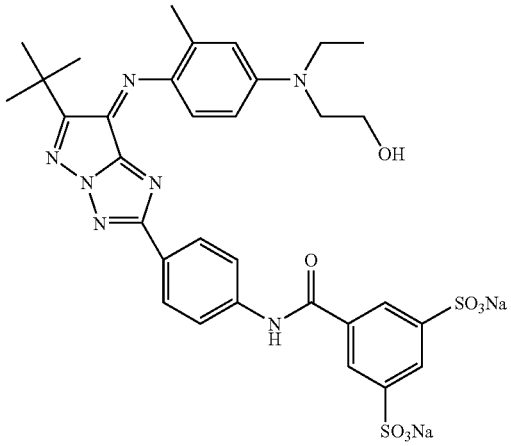
(7)
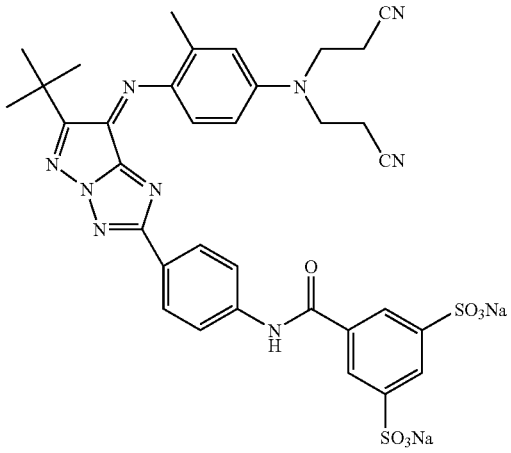
(8)
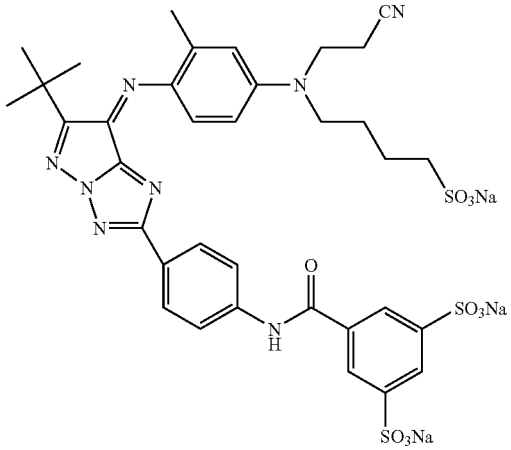

-continued
(9)
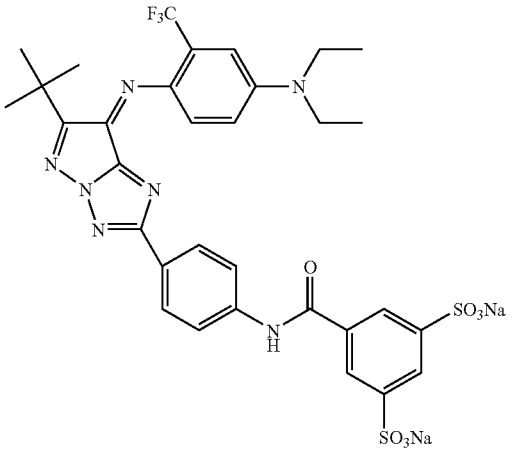
(10)
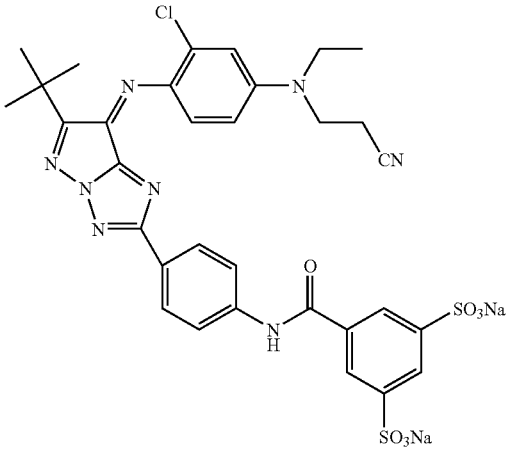
(11)
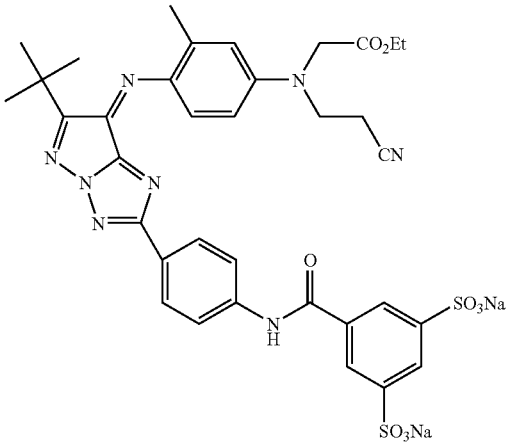
-continued
(12)
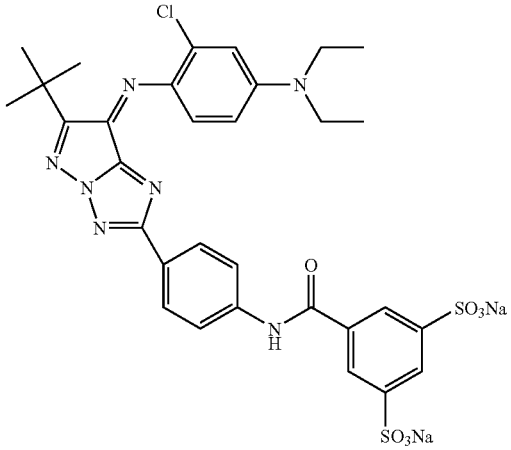
(13)
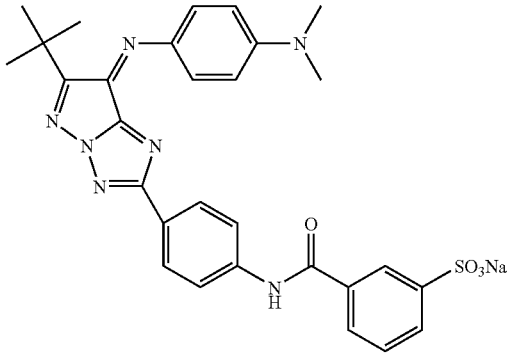
(14)
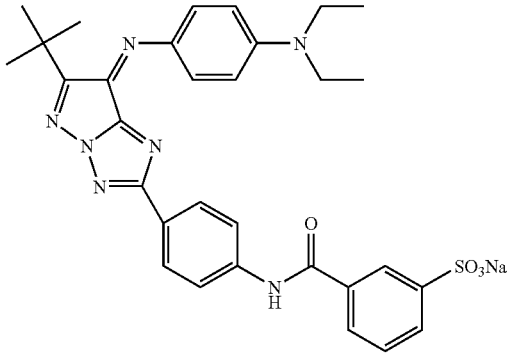
(15)
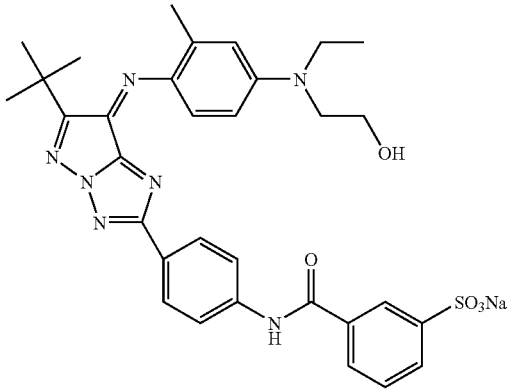

-continued
(16)
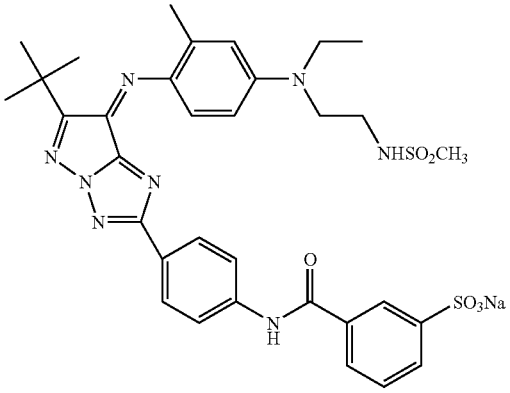
(17)
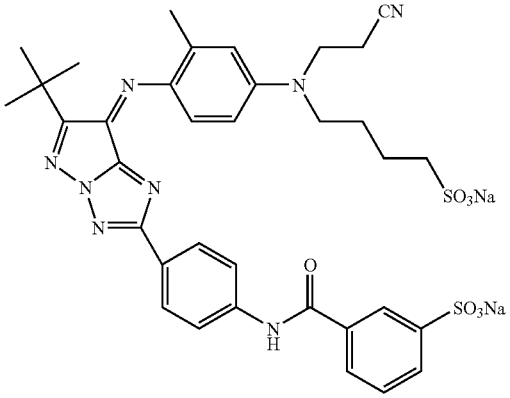
(18)
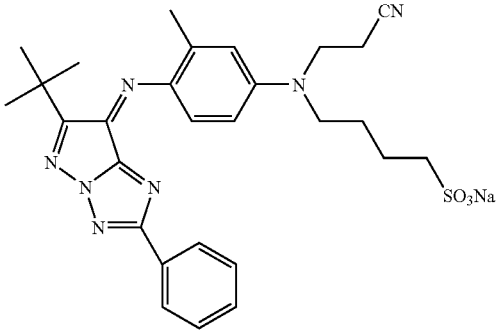
-continued
(19)
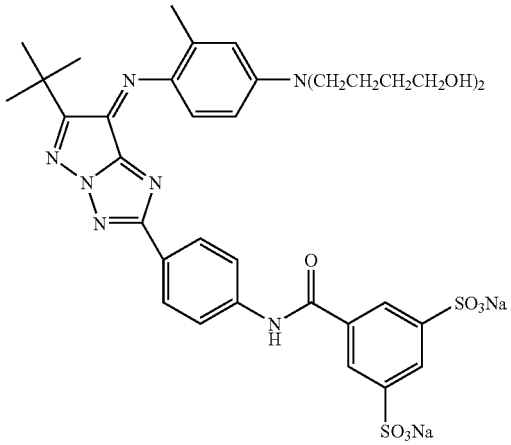
(20)
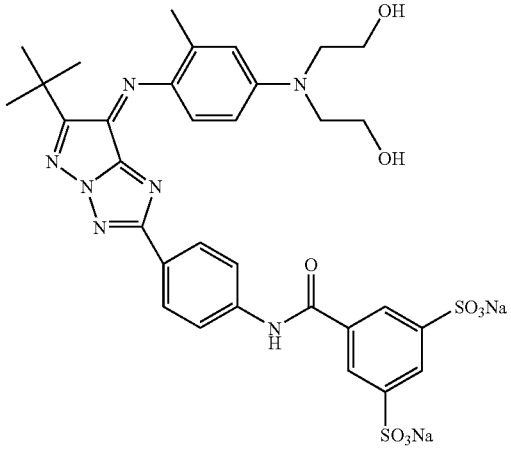
(21)
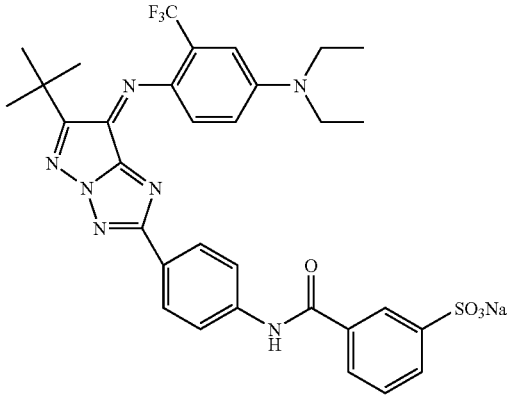

-continued
(22)
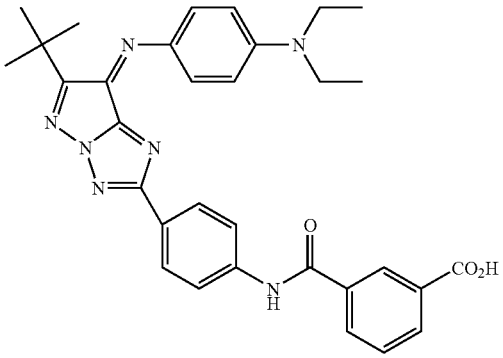
(23)
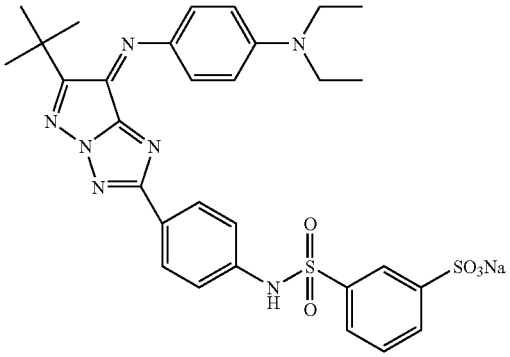
(24)
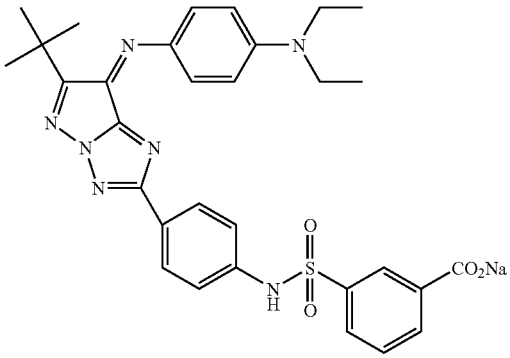
(25)
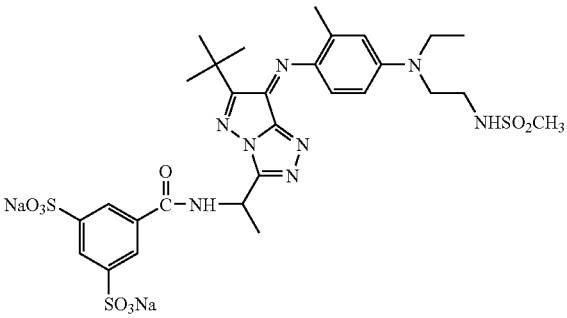
-continued
(26)
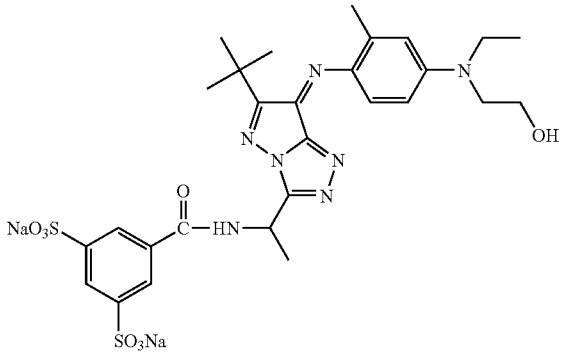
(27)
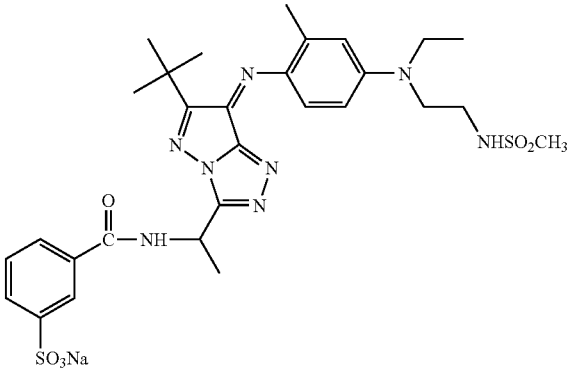
(28)
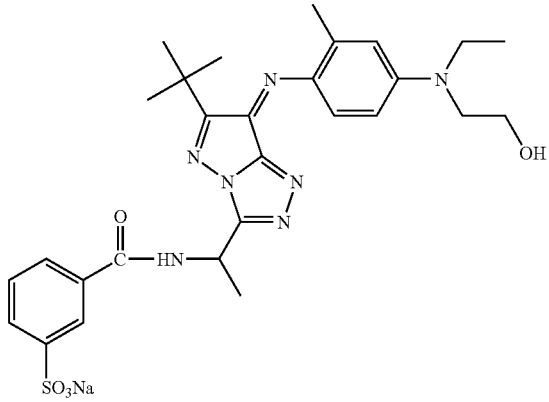
(29)
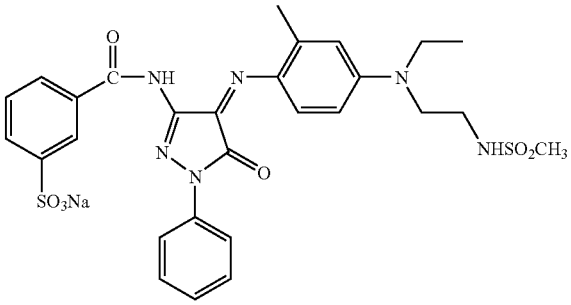

-continued (30)

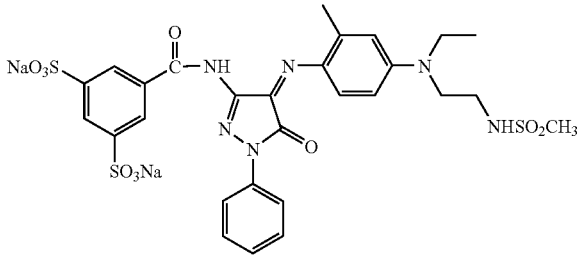

(31)

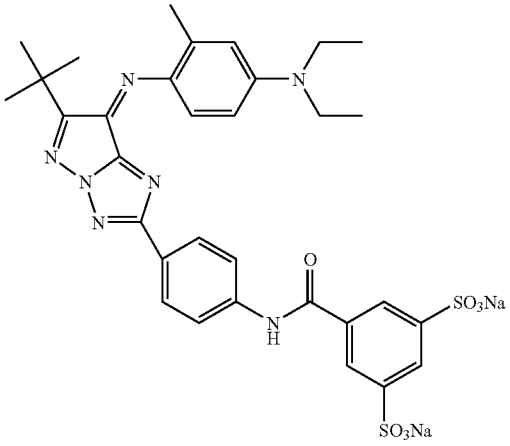

(32)

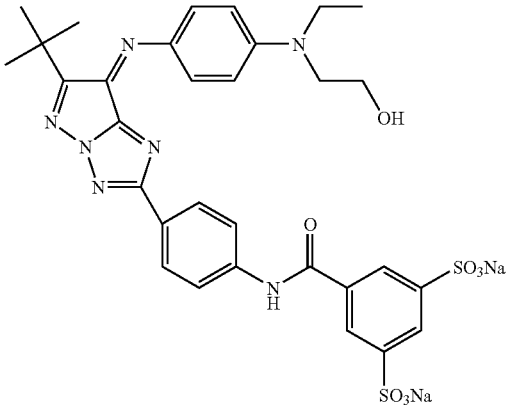

(33)

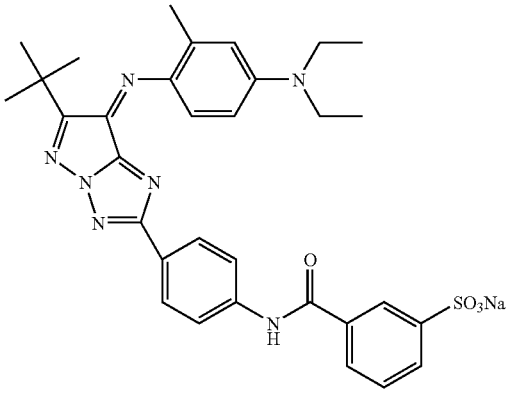

-continued (34)

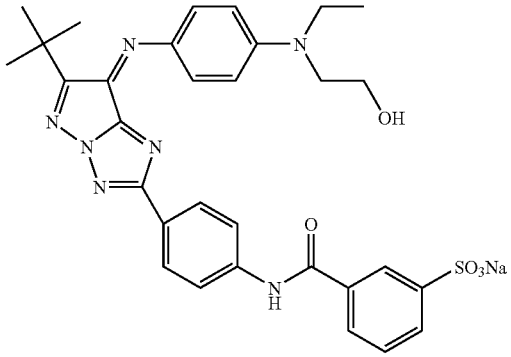

The dye represented by the formula (V) may be synthesized on reference to, for example, the methods described in the publication of JP-A No. 4-126772, the publication of Japanese Patent Publication (JP-B) No. 7-94180 and the publication of Japanese Patent Application No. 11-365187.

Other than the above, examples of the azomethine dyes which may be used in the invention include the examples represented by the formula (I) in the publication of JP-A No. 4-247449, the examples represented by the formula (I) in the publication of JP-A No. 63-145281, the examples represented by the formula (1) in the publication of JP-A No. 2002-256164, the examples represented by the formula (I) in the publication of JP-A No. 3-244593, the examples represented by the formula (I) in the publication of JP-A No. 3-7386, the examples represented by the formulae (II), (III) and (WV) in the publication of JP-A No. 2-252578, the examples represented by the formulae (I) and (II) in the publication of JP-A No. 4-359967 and the examples represented by the formulae (I) and (II) in the publication of JP-A No. 4-359968. Specific examples may include the dyes described in these patents.

The dyes according to this purpose are preferably added in the light-insensitive layer on the image forming layer side or the back surface side though it may be added in any layer.

(Explanations of a Mordant)

The layer containing the metal phthalocyanine dye according to the invention preferably contains a mordant. Although no particular limitation to the mordant, a polymer containing a vinyl monomer unit having a tertiary amino group represented by the following formula (FX-1) or (FX-2) is preferable.

Formula (FX-1)

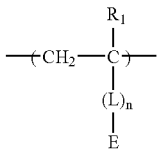

In the formula, $R_1$ represents a hydrogen atom or a lower alkyl group having 1 to 6 carbon atoms. L represents a divalent connecting group having 1 to 20 carbon atoms. E represents a hetero ring containing, as its structural component, a nitrogen atom having a double bond with a carbon atom. n denotes 0 or 1.

Formula (FX-2)

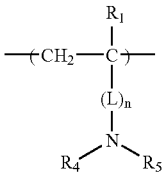

In the formula, $R_1$, L and n have the same meanings as those in the formula (FX-1). $R_4$ and $R_5$ respectively represent an alkyl group having 1 to 12 carbon atoms or an aralkyl group having 7 to 20 carbon atoms, provided that $R_4$ and $R_5$ may be combined with each other to form a cyclic structure in combination with a nitrogen atom.

In the formulae (FX-1) and (FX-2), $R_1$ is preferably a methyl group, an ethyl group, a n-butyl group, a n-amyl group or a n-hexyl group and more preferably a hydrogen atom or a methyl group.

L preferably represent an alkylene group (e.g., a methylene group, ethylene group, trimethylene group and hexamethylene group), a phenylene group (e.g., an o-phenylene group, p-phenylene group and m-phenylene group) or an arylenealkylene group represented by the following formula (in the formula, $R_2$ represents an alkylene group having 1 to about 12 carbon atoms),

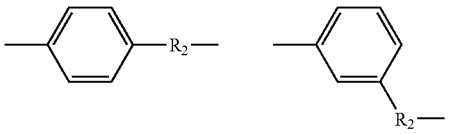

a —$CO_2$— group, a —$CO_2$—$R_3$— group (where $R_3$ represents an alkylene group, a phenylene group or an arylenealkylene group), a —CONH—$R_3$— group (where $R_3$ has the same meaning as above) or an acylamino group represented by the following formula (where $R_1$ and $R_3$ have the same meanings as above).

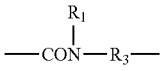

L is more preferably the following divalent group:

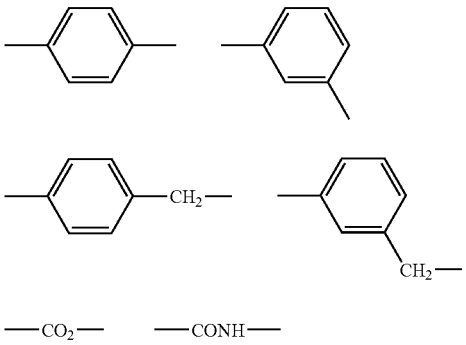

—$CO_2$—$CH_2CH_2$—, —$CO_2$—$CH_2CH_2CH_2$—, —CONH$CH_2$—, —CONH$CH_2CH_2$—and —CONH$CH_2CH_2CH_2$—.

In the formula (FX-1), E represents a hetero ring containing, as its structural component, a nitrogen atom having a double bond with a carbon atom, preferably an imidazole ring, a triazole ring, a pyrazole ring, a pyridine ring or a pyrimidine ring and more preferably an imidazole ring or a pyridine ring which are shown below.

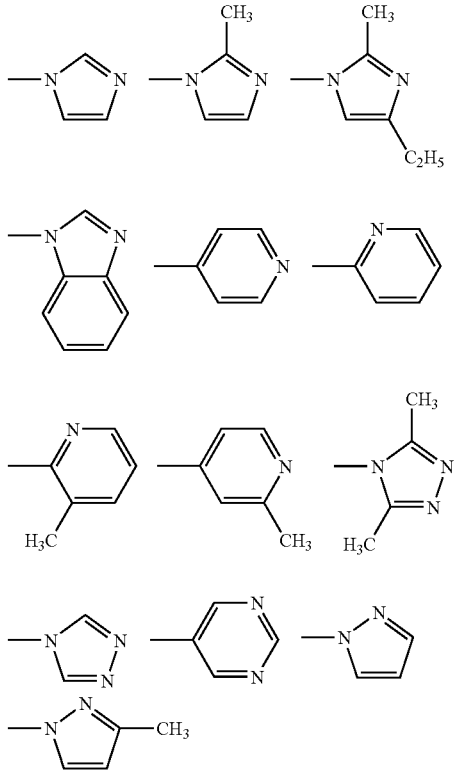

Preferable and specific examples of the polymer containing a vinyl monomer unit having a tertiary amino group represented by the formula (FX-1) include polymers as described in U.S. Pat. Nos. 4,282,305, 4,115,124 and 3,148,061 and the following compounds, which are, however, not intended to be limiting of the invention.

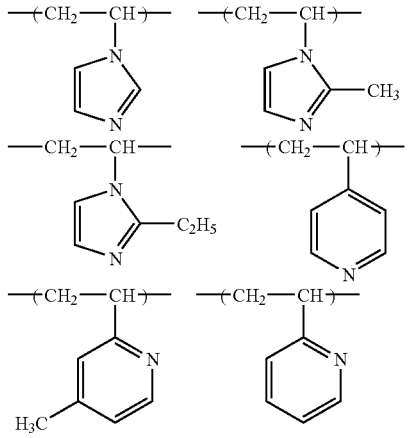

-continued

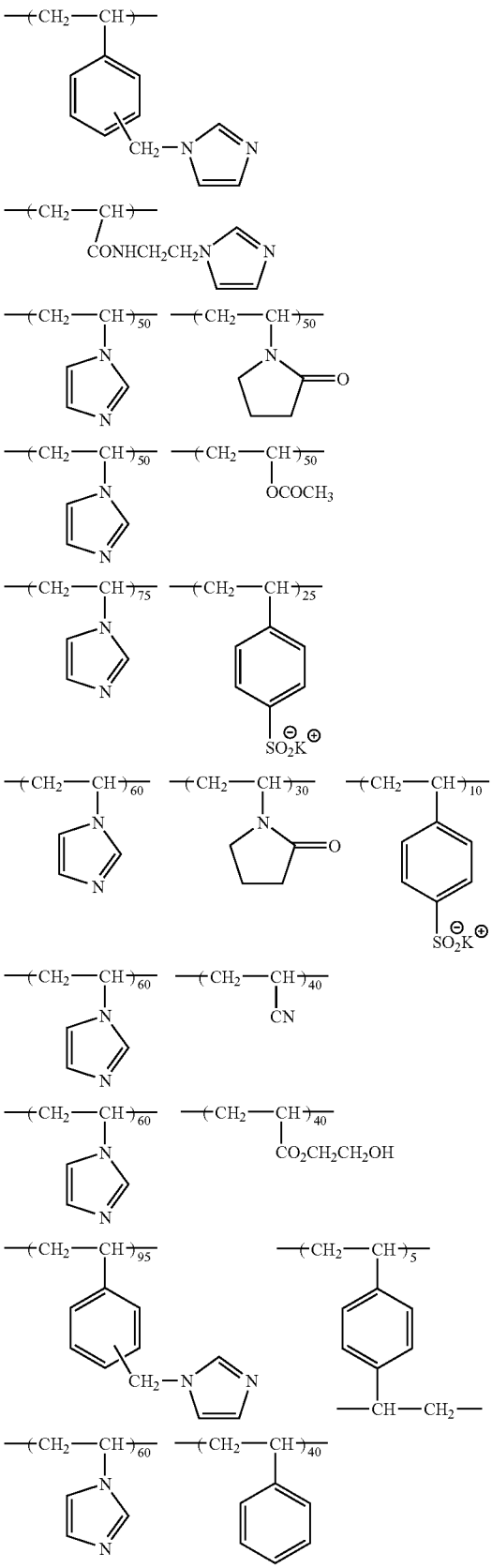

-continued

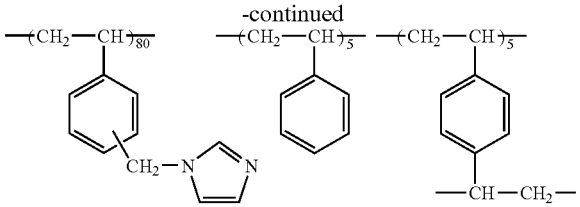

(figure: mol %)

In the formula (FX-2), $R_4$ and $R_5$ preferably represent an unsubstituted alkyl group (e.g., a methyl group, ethyl group, n-propyl group, n-butyl group, n-amil group, hexyl group, n-nonyl group, n-decyl group or n-dodecyl group), a substituted alkyl group (e.g., a methoxyethyl group, 3-cyanopropyl group, ethoxycarbonylethyl group, acetoxyethyl group, hydroxyethyl group or 2-butenyl group), an unsubstituted aralkyl group (e.g., a benzyl group, phenethyl group, diphenylmethyl group or naphthylmethyl group) or a substituted aralkyl group (4-methylbenzyl group, 4-isopropylbenzyl group, 4-methoxybenzyl group, 4-(4-methoxyphenyl)benzyl group or 3-chlorobenzyl group).

Also, the following examples may be given as examples in which $R_4$ and $R_5$ are combined with each other to form a cyclic structure.

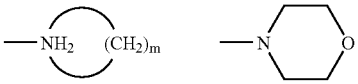

Preferable and specific examples of the polymer containing a vinyl monomer unit having a tertiary amino group represented by the formula (FX-2) include the following compounds.

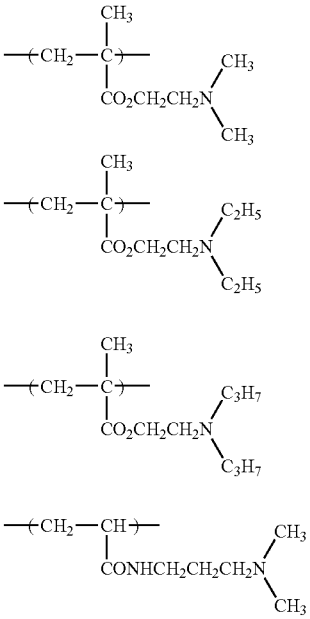

-continued

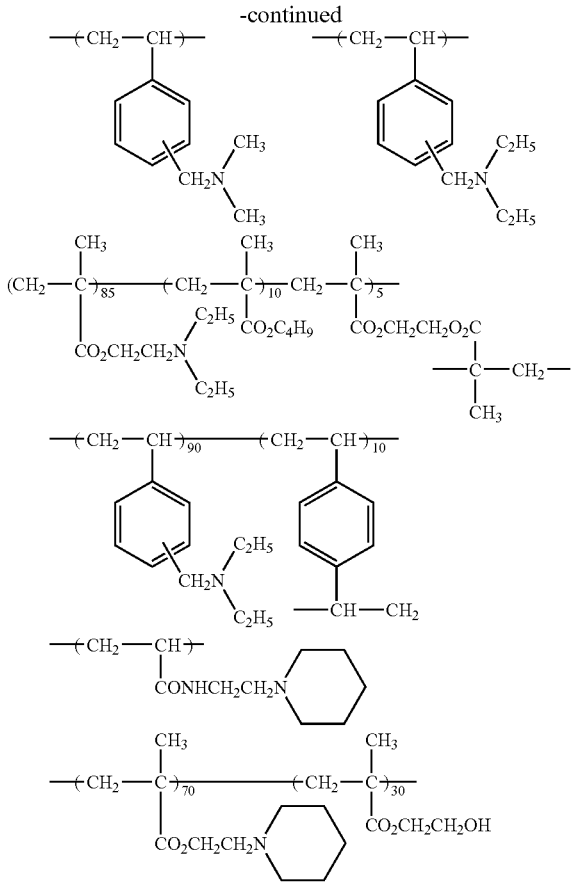

(figure: mol %)

In addition, examples of the mordant which may be used may include vinylpyridine polymers as disclosed in, for example, each specification of U.S. Pat. Nos. 2,548,564, 2,484,430, 3,148,061 and 3,756,814; mordants crosslinkable with gelatins as disclosed in, for example, each specification of U.S. Pat. Nos. 3,625,694, 3,859,096 and 4,128,538 and U.K. Patent No. 1,277,453; aqueous sol type mordants as disclosed in each publication of U.S. Pat. Nos. 3,958,995, 2,721,852 and 2,798,063 and JP-A Nos. 54-115228, 54-145529 and 54-126027; water-insoluble mordants as disclosed in the specification of U.S. Pat. No. 3,898,088; reactive mordants capable of combining with dyes by a covalent bond as disclosed in, for example, the specification of U.S. Pat. No. 4,168,976 (JP-A No. 54-137333); mordants as disclosed in each specification of U.S. Pat. Nos. 3,709,690, 3,788,855, 3,642,482, 3,488,706, 3,557,066, 3,271,147 and 3,271,148 and JP-A Nos. 50-71332, 53-30328, 52-155528, 53-125 and 53-1024 and mordants as described in each specification of U.S. Pat. Nos. 2,675,316 and 2,882,156.

The molecular weight of the mordant used in the invention is preferably 1,000 to 1,000,000 and particularly 10,000 to 200,000.

Such a mordant is used in combination with a hydrophilic colloidal as the binder in a solution containing a water-soluble dye. Given as typical examples of the hydrophilic colloid are natural materials including proteins such as a gelatin and gelatin derivatives and polysaccharides such as cellulose derivatives, starches and gum arabic and synthetic polymers such as polyvinyl alcohols, polyvinyl pyrrolidone and polyacrylamide. Among these compounds, a gelatin and polyvinyl alcohol are particularly preferable.

The mixing ratio of the mordant to the hydrophilic colloid and the coating amount of the mordant can be determined easily by a person skilled in the art corresponding to the amount of the water-soluble dye to be fixed and the type and composition of the mordant. However, the mordant and the hydrophilic colloid are used such that the ratio of the mordant/the hydrophilic colloid is 20/80 to 80/20 (weight ratio) and the coating amount of the mordant is appropriately about 0.2 g/m$^2$ to about 15 g/m$^2$ and preferably 0.5 g/m$^2$ to 8 g/m$^2$.

In the invention, a polyvalent metal salt may be used as the mordant. At this time, the polyvalent metal salt is dissolved in water and ionized to become a compound having two or more valences. Such a metal cation interacts with the water-soluble dye to suppress the movement of the dye in the film. Alkali earth metals, typical metals and transition metals of the Ia to VIII groups and Ib to IIIb groups in the periodic chart are applied to the type of metal used in the polyvalent metal salts. Preferable examples of the type of metal include magnesium, calcium, strontium, iron and zinc. Among these metals, calcium and strontium are particularly preferable. These metals may take, for example, a halogen ion, hydroxide ion, sulfuric ion, nitric acid ion, phosphoric acid ion, carbonic acid ion, oxalic acid ion, alkanesulfonic acid ion, arylsulfonic acid ion, alkanecarboxylic acid ion or arylcarboxylic acid ion as the counter anion. As the counter anion, a carbonic acid ion, nitric acid ion, sulfuric acid ion or alkanecarboxylic acid ion is preferable and a carbonic acid ion, nitric acid ion or alkanecarboxylic acid ion is more preferable. Particularly, calcium nitrate is preferable because it is soluble in water and is therefore easily used, and is also inert to other materials in the light-sensitive material.

Specific examples of the polyvalent metal salt to be used in the invention will be described hereinbelow.

MM-1 $Ca(NO_3)_2$
MM-2 $Mg(NO_3)_2$
MM-3 $BaSO_4$
MM-4 Zinc stearate
MM-5 $St(NO_3)_2$
MM-6 $Ca(CH_3CO_2)_2$
MM-7 $Ni(CH_3CO_2)_2$
MM-8 $Zn(CH_3CO_2)_2$
MM-9 $FeCl_3$
MM-10 $MgCl_2$
MM-11 $SrCl_2$
MM-12 $CaCl_2$ The amount of the polyvalent metal salt to be added must be $1.5\times10^{-5}$ mol/m$^2$ or more and is preferably $2\times10^{-5}$ mol/m$^2$ to $1\times10^{-2}$ mol/m$^2$. When the polyvalent metal salt is calcium nitrate, the amount of the metal salt is preferably $1\times10^{-5}$ mol/m$^2$ to $1\times10^{-2}$ mol/m$^2$.

As to a method used to add the polyvalent metal, an aqueous solution of the metal salt may be prepared and added or particles of the metal salt are fined and added in a fine particle state: however, the metal salt is preferably added in a solution state.

(Non-Photosensitive Organic Silver Salt)

1) Composition

The organic silver salt which can be used in the present invention is relatively stable to light but serves as to supply silver ions and forms silver images when heated to 80° C. or higher under the presence of an exposed photosensitive silver halide and a reducing agent. The organic silver salt may be any organic material containing a source capable of supplying silver ions that are reducible by a reducing agent. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained aliphatic carboxylic acid (having 10 to 30 carbon atoms, and preferably having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. In the invention, among these silver salts of fatty acid, it is preferred to use a silver salt of fatty acid with a silver behenate content of 50 mol % or more, more preferably, 85 mol % or more, and further preferably, 95 mol % or more. Further, it is preferred to use a silver salt of fatty acid with a silver erucate content of 2 mol % or less, more preferably, 1 mol % or less, and further preferably, 0.1 mol % or less.

It is preferred that the content of silver stearate is 1 mol % or less. When the content of silver stearate is 1 mol % or less, a silver salt of organic acid having low Dmin, high sensitivity and excellent image storability can be obtained. The above-mentioned content of silver stearate is preferably 0.5 mol % or less, and particularly preferably, silver stearate is not substantially contained.

Further, in the case where the silver salt of organic acid includes silver arachidinate, it is preferred that the content of silver arachidinate is 6 mol % or less in order to obtain a silver salt of organic acid having low Dmin and excellent image storability. The content of silver arachidinate is more preferably 3 mol % or less.

2) Shape

The organic silver salt in the invention is preferably nano-particles and has an average particle size of preferably 10 nm or more and 1,000 nm or less and more preferably 30 nm or more and 400 nm or less.

If the average particle diameter is smaller than this range, this causes a rise in fogging, a rise in fogging when an unused photothermographic material is stored and deterioration in fogging when the treated image is stored.

If the average particle diameter is larger than this range, this brings about harmful effects such as deterioration in the haze of a coating film, a delay of developing and deterioration in solid sedimentation when a dispersion of the organic silver salt is stored for a long period of time.

There is no particular restriction on the shape of the organic silver salt usable in the invention and it may needle-like, bar-like, tabular or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average) □ 1.5 as an average value x is defined as a flaky shape. The relation is preferably: 30 □ x (average) □ 1.5 and, more preferably, 15 □ x (average) □ 1.5. By the way, needle-like is expressed as 1 □ x (average)<1.5.

In the flaky shaped particle, a can be regarded as a thickness of a tabular particle having a main plate with b and c being as the sides. a in average is preferably 1 nm to 300 nm and, more preferably, 5 nm to 100 nm. c/b in average is preferably 1 to 9, more preferably 1 to 6, further preferably 1 to 4 and, most preferably 1 to 3.

In the invention, an equivalent spherical diameter can be measured by a method of photographing a sample directly by using an electron microscope and then image processing the negative images.

In the flaky shaped particle, the equivalent spherical diameter of the particle/a is defined as an aspect ratio. The aspect ratio of the flaky particle is, preferably, 1.1 to 30 and, more preferably, 1.1 to 15 with a viewpoint of causing less agglomeration in the photothermographic material and improving the image storability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art may be applied to the method for producing the organic silver salt used in the invention and to the dispersing method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-31870, 2002-107868, and the like.

The organic acid silver to be used in the invention is preferably prepared in the presence of a dispersant represented by any one of the following formulae (W1) and (W2).

These compounds may be added either when the organic silver salt is prepared or when the organic silver salt is dispersed.

Formula (W1)

Formula (W2)

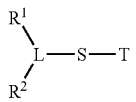

R represents a hydrophobic group. At least one of $R_1$ and $R_2$ is a hydrophobic group. L represents a connecting group. T represents an oligomer part, where L (connecting group) and T (oligomer part) are bound through a thio bond (—S—). In the formula (W1), L may not be present.

The number of the hydrophobic groups is defined by the connecting group L. The hydrophobic group is selected from saturated or unsaturated alkyl groups, arylalkyl groups or alkylaryl groups, where the alkyl part of each group may be straight-chain or branched. The hydrophobic R, $R_1$ and $R_2$ respectively have 8 to 21 carbon atoms. The typical connecting groups of the compound represented by the formula (W1) are described in italics in the following formula.

Formula (Wa)

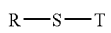

Formula (Wb)

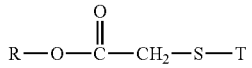

Formula (Wc)

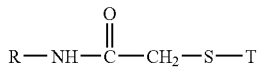

The typical connecting groups of the compound represented by the formula (W2) are described in italics in the following formula.

Formula (Wd)

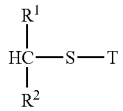

Formula (We)

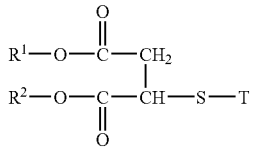

Formula (Wf)

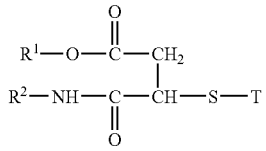

The oligomer group T is a group of an oligomer unit obtained by polymerizing a vinyl monomer having an amide group. After the vinyl monomer is polymerized at a vinyl part to form an oligomer, the amide part becomes a nonionic polar group constituting a hydrophilic functional group. This oligomer group T may be not only a polymer obtained using only one monomer but also an oligomer copolymerized using plural different monomers.

Typical examples of the monomer used to produce the oligomer chain T include acrylamides, methacrylamides, acrylamide derivatives, methacrylamide derivatives and 2-vinylpyrrolidone.

These monomers may be represented by the following two formulae.

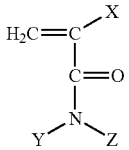

Acrylamide, Methacrylamide, or Derivatives thereof

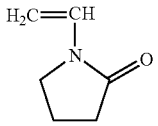

2-Vinyl Pyrrolidone

X represents hydrogen or an alkyl group having 1 to 10 carbon atoms and is preferably hydrogen or a methyl group. Y and Z respectively represent hydrogen, an alkyl group having 1 to 10 carbon atoms or a substituted alkyl group having 1 to 10 carbon atoms and are respectively preferably hydrogen, a methyl group, an ethyl group or $—C(CH_2OH)_3$, where X and Y may be the same or different.

The number of the repeat units of the oligomer group T is 20 or less and preferably 5 to 15. Specific examples of the oligomer group T will be shown below: however, these examples are not intended to be limiting of the invention.

BUN-1

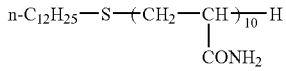

BUN-2

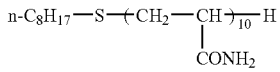

BUN-3

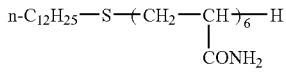

BUN-4

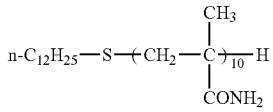

BUN-5

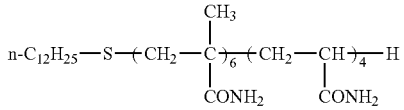

BUN-6

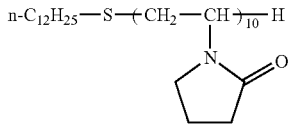

BUN-7

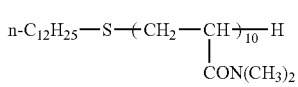

BUN-8

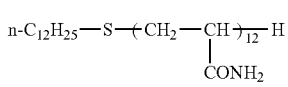

-continued

BUN-9

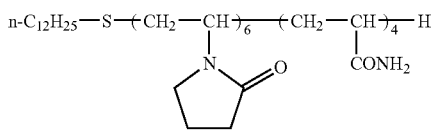

BUN-10

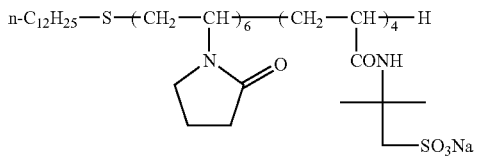

The aforementioned oligomer surfactant obtained using, as a major component, a vinyl polymer with an amide functional group may be produced by a known method in the technical fields concerned or by simple modifications of these known methods. Illustrative preparations are shown below. An aqueous base dispersion of silver carboxylate nano-particles can be produced by a medium grinding method involving the following steps:

(A) a step of preparing a silver carboxylate dispersion containing silver carboxylate, water which is a carrier of the carboxylate and the aforementioned surface modifier;

(B) a step of mixing the above carboxylate dispersion with a hard grinding medium having an average particle diameter less than 500 μm;

(C) a step of pouring the mixture obtained in the above step (B) into a high-speed mill;

(D) a step of grinding the mixture obtained in the above step (C) until such a distribution of particle diameter of carboxylate is obtained that 90% by weight of the carboxylate particles have a particle diameter less than 1 μm; and (E) a step of separating the grinding medium from the mixture ground in the step (D).

It is to be noted that when the organic silver salt is dispersed, the coexistence of the light-sensitive silver salt causes increased fogging and significantly reduced sensitivity and it is therefore preferable to substantially exclude the light-sensitive silver salt when the organic silver salt is dispersed. In the invention, the amount of the light-sensitive silver salt dispersed in the aqueous dispersion solution is preferably 1 mol % or less and more preferably 0.1 mol % or less based on 1 mol of the organic acid silver salt in the solution, and it is more preferable that the light-sensitive silver salt is not added positively.

It is possible to produce a photothermographic material by mixing the organic silver salt dispersion solution with the aqueous dispersion solution of the light-sensitive silver salt in the invention. Although the mixing ratio of the organic silver salt to the light-sensitive silver salt may be selected corresponding to the object, the ratio of the light-sensitive silver salt to the organic silver salt is preferably in a range from 1 mol % to 30 mol %, more preferably in a range from 2 mol % to 20 mol % and particularly preferably from 3 mol % to 15 mol %. A method in which two or more aqueous organic silver salt dispersion solutions are mixed with two or more aqueous light-sensitive silver salt dispersion solutions is preferably used for controlling photographic characteristics.

4) Amount to be Added

Although the organic silver salt in the invention may be used in a desired amount, the total coating amount of silver including the silver in the silver halide is preferably 0.1 $g/m^2$ or more and 5.0 $g/m^2$ or less, more preferably 0.3 $g/m^2$ or more and 3.0 $g/m^2$ or less and still more preferably 0.5 $g/m^2$ or more and 2.0 $g/m^2$ or less. In order to improve, particularly, image reserving characteristics, the total coating amount of silver is preferably 1.8 $g/m^2$ or less and more preferably 1.6 $g/m^2$ or less. If a reducing agent preferable in the invention is used, it is possible to obtain satisfactory image density even in the case where such a small amount of silver is used.

(Explanations of the Reducing Agent)

The photothermographic material of the invention contains a heat developing agent which is a reducing agent used for the organic silver salt. The reducing agent in the invention is preferably a so-called hindered phenol type reducing agent or bisphenol type reducing agent which has a substituent at the ortho position with respect to the phenolic hydroxyl group and compounds represented by the following formula (R) are particularly preferable.

Formula (R)

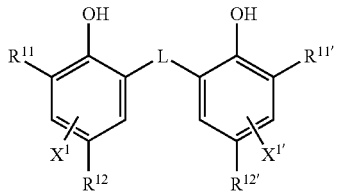

In the formula (R), $R^{11}$ and $R^{11'}$ respectively represent an alkyl group, where at least one of them is a secondary or tertiary alkyl group. $R^{12}$ and $R^{12'}$ respectively represent a hydrogen atom or a substituent with which a benzene ring can be substituted. L represents a —S— group or a —$CHR^{13}$— group. $R^{13}$ represents a hydrogen atom or an alkyl group. $X^1$ and $X^{1'}$ respectively represent a hydrogen atom or a group with which a benzene ring can be substituted.

The formula (R) will be explained in detail.

Any group called an alkyl group hereinbelow includes a cycloalkyl group unless otherwise noted.

1) $R^{11}$ and $R^{11'}$ $R^{11}$ and $R^{11'}$ respectively represent a substituted or unsubstituted alkyl group having 1 to 20 carbon atoms, where at least one of them is a secondary or tertiary alkyl group. Preferable examples of the substituent of the alkyl group include, though not limited to, an aryl group, hydroxy group, alkoxy group, aryloxy group, alkylthio group, arylthio group, acylamino group, sulfonamide group, sulfonyl group, phosphoryl group, acyl group, carbamoyl group, ester group, ureide group, urethane group and halogen atom.

2) $R^{12}$ and $R^{12'}$, $X^1$ and $X^{1'}$ $R^{12}$ and $R^{12'}$ respectively represent a hydrogen atom or a substituent with which a benzene ring can be substituted and $X^1$ and $X^{1'}$ also respectively represent a hydrogen atom or a group with which a benzene ring can be substituted. Examples of the group with which a benzene ring can be substituted include an alkyl group, aryl group, halogen atom, alkoxy group and acylamino group.

3) L

L represents a —S— group or a —$CHR^{13}$—. $R^{13}$ represents a hydrogen atom or an alkyl group having 1 to 20 carbon atoms, where the alkyl group may have a substituent. Specific examples of the unsubstituted alkyl group of $R^{13}$ include a methyl group, ethyl group, propyl group, butyl group, heptyl group, undecyl group, isopropyl group, 1-ethylpentyl group, 2,4,4-trimethylpentyl group, cyclohexyl group, 2,4-dimethyl-3-cyclohexenyl group and 3,5-dimethyl-3-cyclohexenyl group. Examples of the substituent of the alkyl group are the same as those of the substituent of $R^{11}$ and include a halogen atom, alkoxy group, alkylthio group, aryloxy group, arylthio group, acylamino group, sulfonamide group, sulfonyl group, phosphoryl group, oxycarbonyl group, carbamoyl group and sulfamoyl group.

4) Desirable Substituent $R^{11}$ and $R^{11'}$ are respectively preferably a secondary or tertiary alkyl group having 1 to 15 carbon atoms and specific examples of the alkyl group include an isopropyl group, t-butyl group, t-amyl group, t-octyl group, cyclohexyl group, cyclopentyl group, 1-methylcyclohexyl group and 1-methylcyclopropyl group. $R^{11}$ and $R^{11'}$ are respectively more preferably a t-butyl group, t-amyl group and 1-methylcyclohexyl group and most preferably a t-butyl group.

$R^{12}$ and $R^{12'}$ respectively preferably represent an alkyl group having 1 to 20 carbon atoms. Specific examples include a methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferable examples of $R^{12}$ and $R^{12'}$ are more preferably a methyl group, ethyl group, propyl group, isopropyl group and t-butyl group and particular preferably a methyl group and ethyl group.

$X^1$ and $X^{1'}$ are respectively preferably a hydrogen atom, a halogen atom or an alkyl group and more preferably a hydrogen atom.

L is preferably a —$CHR^{13}$— group.

$R^{13}$ is preferably a hydrogen atom or an alkyl group having 1 to 15 carbon atoms. As the alkyl group, a cyclic alkyl group besides a chain alkyl group is preferably used. Also, among these alkyl groups, those having a C═C bond are preferably used. As the alkyl group, a methyl group, ethyl group, propyl group, isopropyl group, 2,4,4-trimethylpentyl group, cyclohexyl group, 2,4-dimethyl-3-cyclohexenyl group, 3,5-dimethyl-3-cyclohexenyl group or the like is preferable. Particularly preferable examples of $R^{13}$ include a hydrogen atom, methyl group, ethyl group, propyl group, isopropyl group and 2,4-dimethyl-3-cyclohexenyl group.

When $R^{11}$ and R''' are respectively a tertiary alkyl group and $R^{12}$ and $R^{12'}$ are respectively a methyl group, $R^{13}$ is preferably a primary or secondary alkyl group having 1 to 8 carbon atoms (e.g., a methyl group, ethyl group, propyl group, isopropyl group or 2,4-dimethyl-3-cyclohexenyl group).

When $R^{11}$ and $R^{11'}$ are respectively a tertiary alkyl group and $R^{12}$ and $R^{12'}$ are respectively an alkyl group other than a methyl group, $R^{13}$ is preferably a hydrogen atom.

When $R^{11}$ and $R^{11'}$ are not respectively a tertiary alkyl group, $R^{13}$ is preferably a hydrogen atom or a secondary alkyl group and particularly preferably a secondary alkyl group. Preferable examples of the secondary alkyl group of $R^{13}$ include an isopropyl group or 2,4-dimethyl-3-cyclohexenyl group.

The above reducing agent differs in heat developing characteristics, developed silver tone and the like corresponding to the combinations of $R^{11}$, $R^{11'}$, $R^{12}$, $R^{12'}$ and $R^{13}$. These characteristics can be controlled by combining two or more reducing agents and it is therefore preferable to use a combination of two or more reducing agents according to the object.

Specific examples of the reducing agent including the compounds represented by the formula (R) in the invention will be shown below: however, these examples are not intended to be limiting of the invention.

R1-1

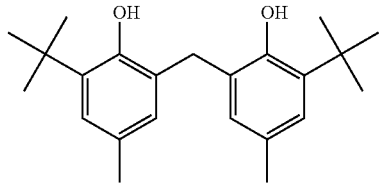

R1-2

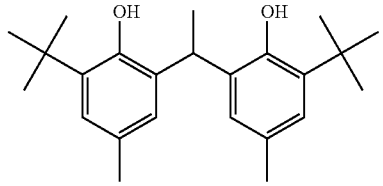

R1-3

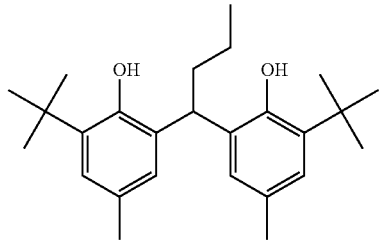

R1-4

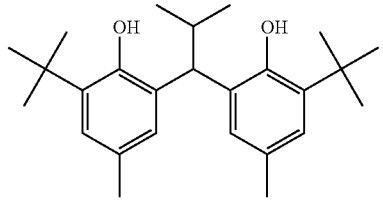

R1-5

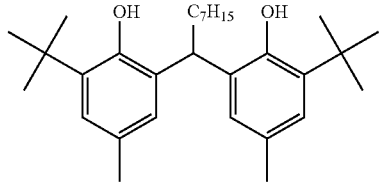

R1-6

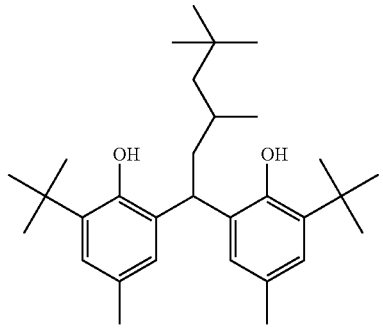

R1-7

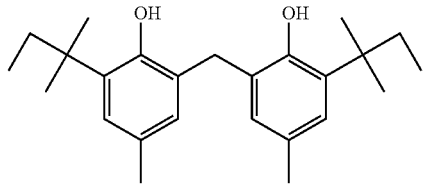

-continued
R1-8
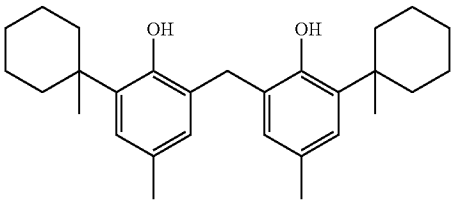
R1-9
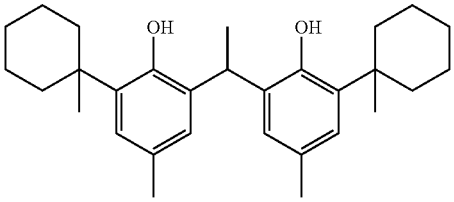
R1-10
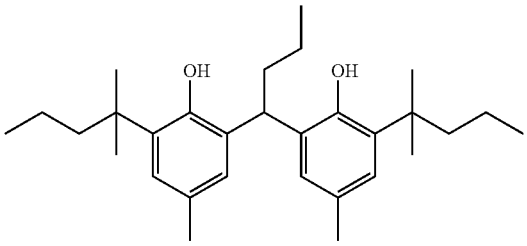
R1-11
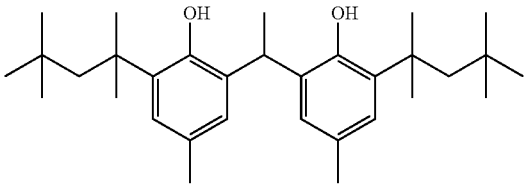
R1-12
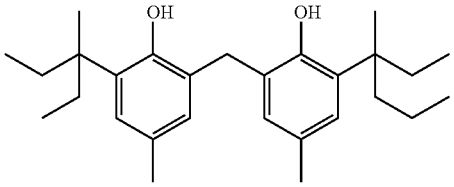
R1-13
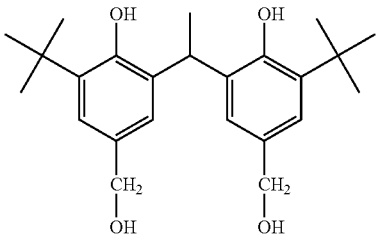
R1-14
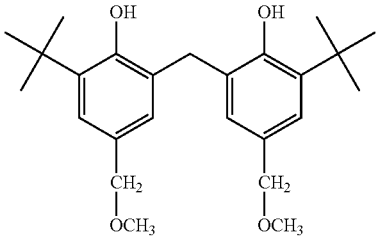
-continued
R1-15
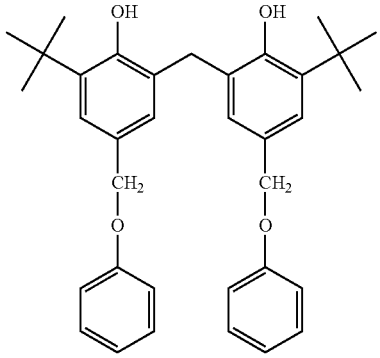
R1-16
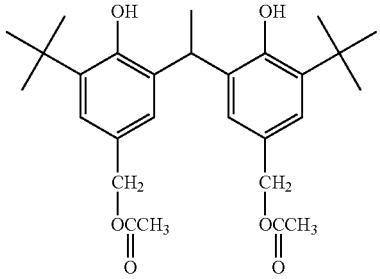
R1-17
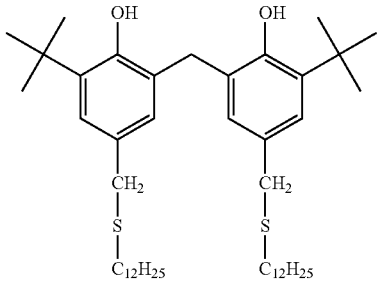
R1-18
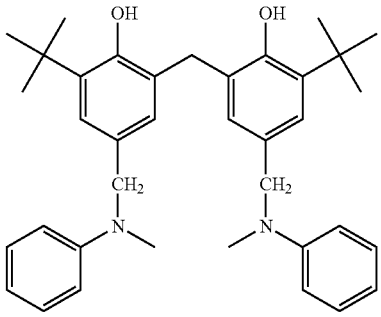
R1-19
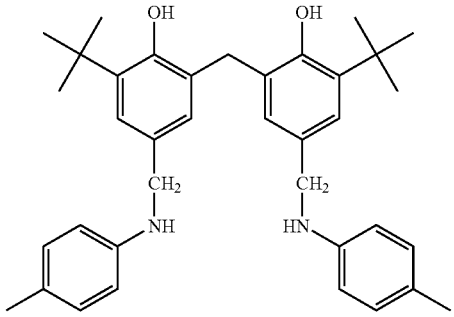

-continued
R1-20
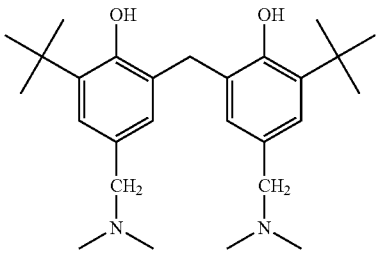
R1-21
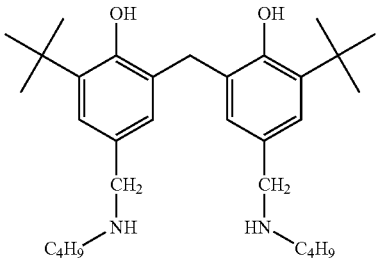
R1-22
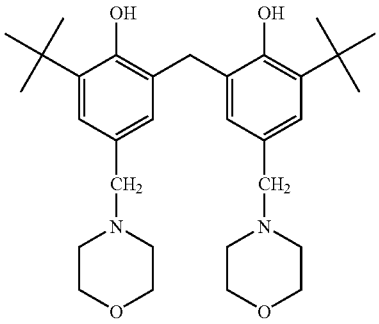
R1-23
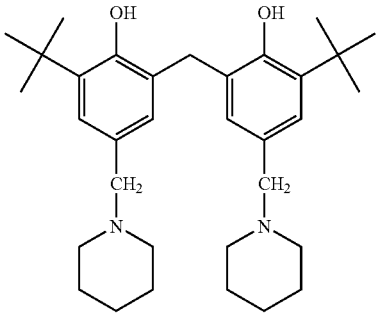
R1-24
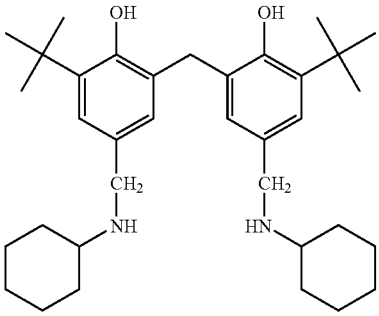
-continued
R1-25
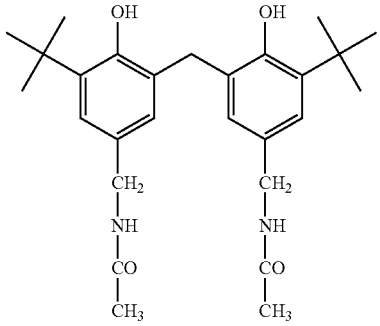
R1-26
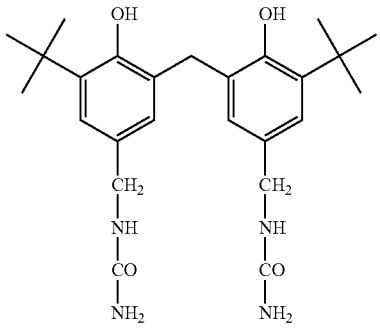
R1-27
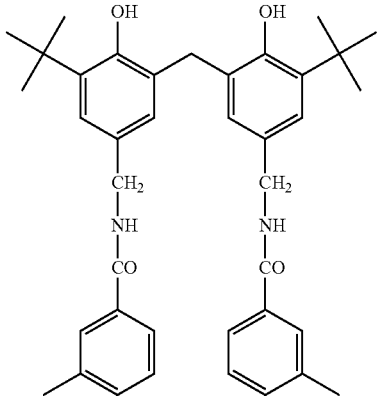
R1-28
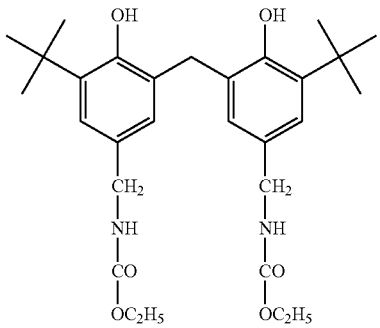

-continued
R1-29
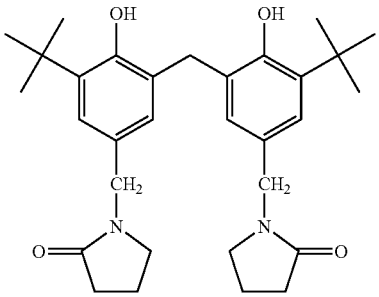
R1-30
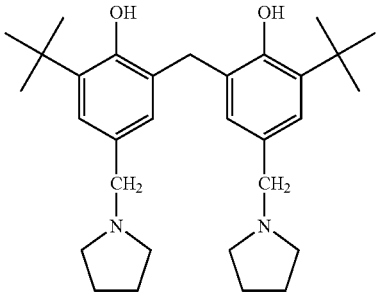
R1-31
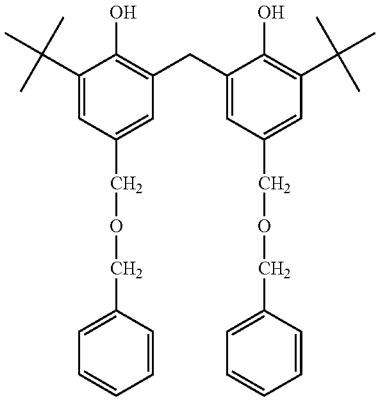
R1-32
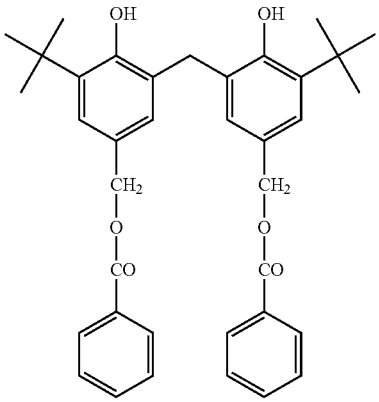
-continued
R1-33
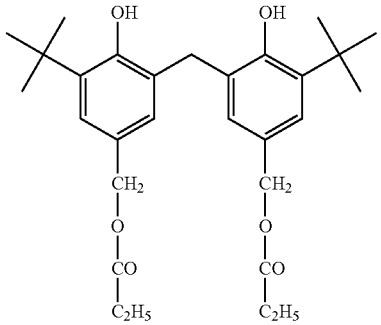
R1-34
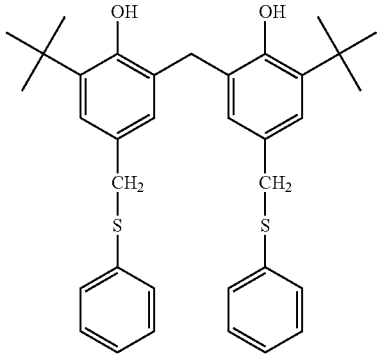
R1-35
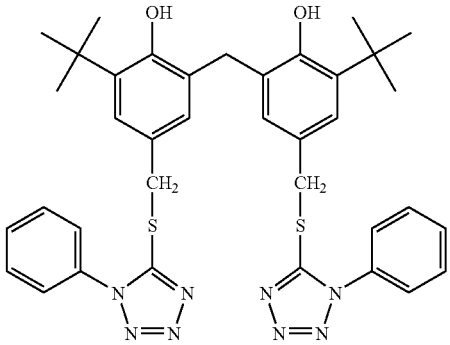
R1-36
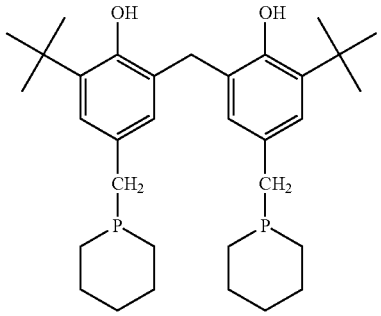

Other than the above compounds, preferable examples of the reducing agent include compounds as described in JP-A Nos. 2001-188314, 2001-209145, 2001-350235 and 2002-156727 and EP1278101A2.

The amount of the reducing agent in the invention is preferably 0.1 $g/m^2$ or more and 3.0 $g/m^2$ or less, more preferably 0.2 $g/m^2$ or more and 2.0 $g/m^2$ or less and still more preferably 0.3 $g/m^2$ or more and 1.0 $g/m^2$ or less. The reducing agent is contained in an amount of preferably 5 mol % or more and 50 mol % or less, more preferably 8 mol % or more and 30 mol % or less and still more preferably 10 mol % or more and 20 mol % or less based on 1 mol of silver on the surface provided with the image forming layer.

The reducing agent is preferably contained in the image forming layer though it may be added in any layer on the surface provided with the image forming layer.

The reducing agent may be contained in the coating solution and in the light-sensitive material by using any method in which it is used, for example, in a solution state, emulsion-dispersion state and solid fine particle dispersion state.

Examples of well-known emulsion-dispersion methods include a method in which the reducing agent is dissolved using an oil such as dibutyl phthalate, tricresyl phthalate, dioctyl sebacate or tri(2-ethylhexyl)phosphate or an auxiliary solvent such as ethyl acetate or cyclohexanone and a surfactant such as sodium dodecylbenzenesulfonate, sodium oleoyl-N-methyltaurate or sodium di(2-ethylhexyl)sulfosuccinate is added to the solution to prepare an emulsion dispersion mechanically. At this time, it is preferable to add a polymer such as an □-methylstyrene oligomer or poly(t-butylacrylamide) for the purpose of controlling the viscosity of oil droplets and refraction index.

As solid fine particle dispersing method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, an antiseptic (for instance, sodium benzoisothiazolinone salt) is added in the water dispersion.

In the invention, furthermore, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 2 μm. In the invention, other solid dispersions are preferably used with this particle size range.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include the same methods as those for the reducing agent and, it is particularly preferred to add as a solid dispersion or an emulsion dispersion. In a case of adding as emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

Q1-NHNH-Q2 Formula (A-1)

(wherein, Q1 represents an aromatic group or a heterocyclic group which bonds to —NHNH—Q2 at a carbon atom, and Q2 represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by Q1 is, preferably, 5 to 7 membered unsaturated ring. Preferred examples include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

These rings may have a substituent. When these rings have two or more substituents, these substituents may be the same or different. Examples of the substituent may include a halogen atom, alkyl group, aryl group, carbonamide group, alkylsulfonamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. When these substituents are substitutable groups, they may further have substituents. Preferable examples of the substituent include a halogen atom, alkyl group, aryl group, carbonamide group, alkylsulfonamide group, arylsulfonamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is carbamoyl groups having preferably 1 to 50 carbon atoms and more preferably 6 to 40 carbon atoms. Examples of the carbamoyl group include an unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl and N-benzylcarbamoyl.

The acyl group represented by $Q_2$ is acyl groups having preferably 1 to 50 carbon atoms and more preferably 6 to 40 carbon atoms. Examples of the acyl group include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl and 2-hydroxymethylbenzoyl. The alkoxycarbonyl group represented by $Q_2$ is alkoxycarbonyl groups having preferably 2 to 50 carbon atoms and more preferably 6 to 40 carbon atoms. Examples of the alkoxycarbonyl group include methoxycarbonyl, ethoxycarbonyl, isobutyloxycarbonyl, cyclohexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably, 6 to 40 carbon atoms and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Then, preferred range for the compounds represented by formula (A-1) is to be described. 5 or 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having a hydrogen atom on the nitrogen atom is particularly preferred.

Formula (A-2)

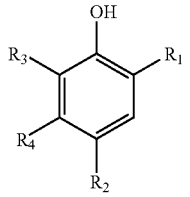

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R^1$ is, preferably, an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including an ureido group and an urethane group) is more preferred. $R_2$ is, preferably, a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are identical with those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

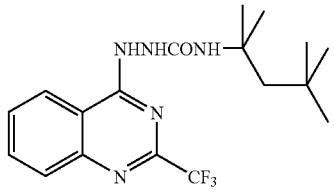

-continued

A-2

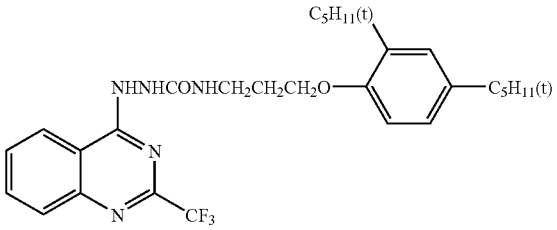

A-3

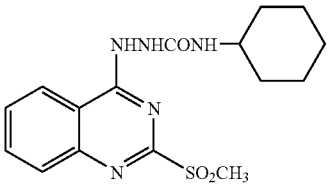

A-4

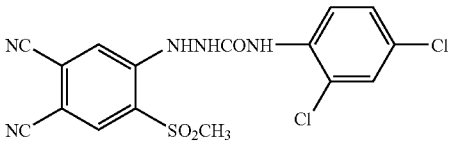

A-5

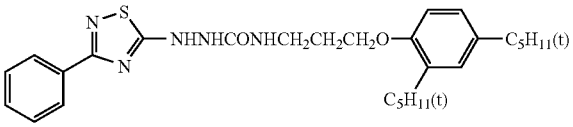

A-6

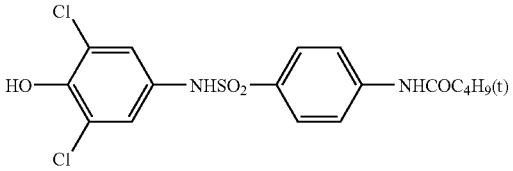

A-7

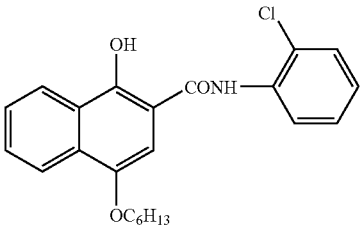

A-8

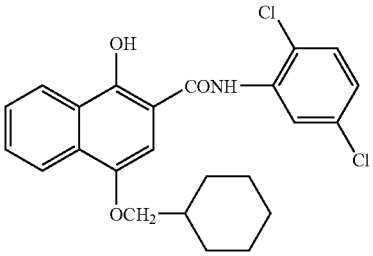

-continued

A-9

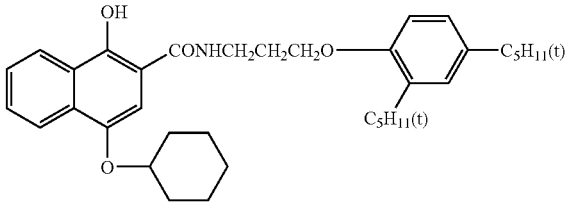

A-10

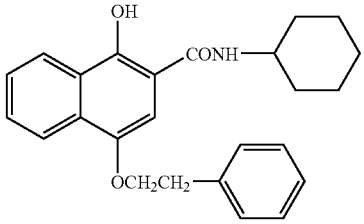

A-11

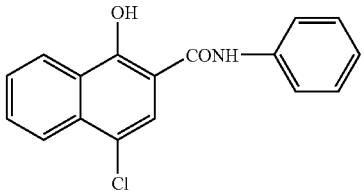

A-12

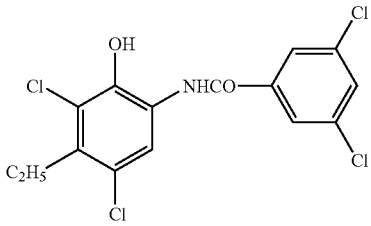

(Hydrogen Bonding Compound)

In the invention, in the case where the reducing agent has an aromatic hydroxy group (—OH) or an amino group (—NHR, R represents each one of a hydrogen atom and an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is a phosphoryl group, a sulfoxido group, an amido group (not having >N—H moiety but being blocked in the form of >N—Ra (where, Ra represents a substituent other than H)), an urethane group (not having >N—H moiety but being blocked in the form of >N—Ra (where, Ra represents a substituent other than H)), and an ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

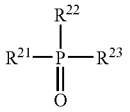

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ is an alkyl group, an aryl group, an alkoxy group, or an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

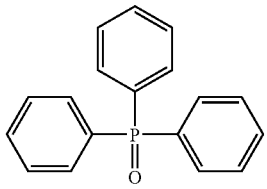

D-2

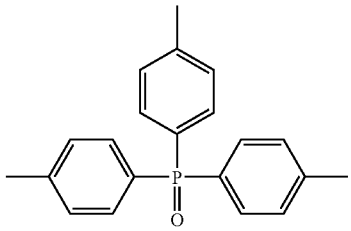

D-3

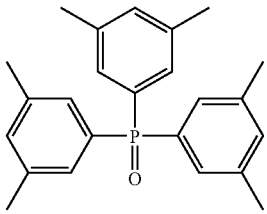

D-4

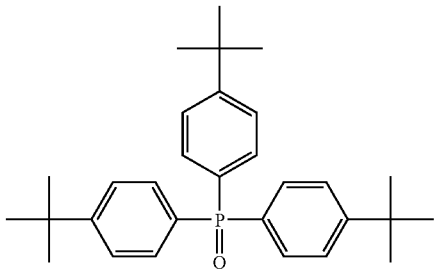

D-5

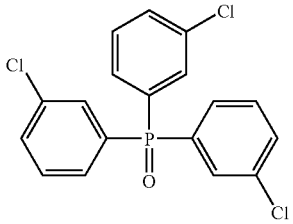

D-6

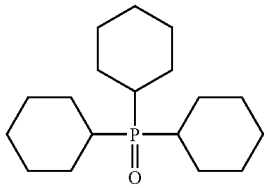

D-7

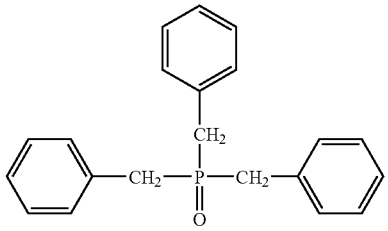

-continued

D-8

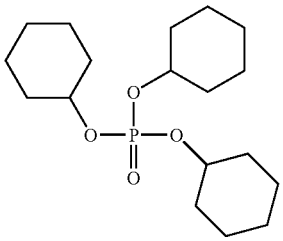

D-9

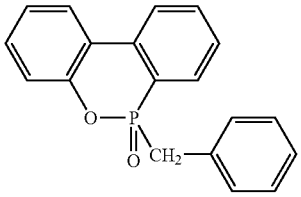

D-10

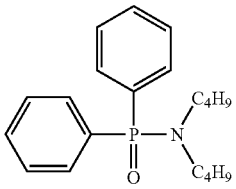

D-11

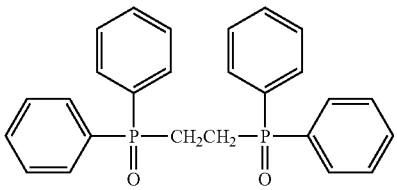

D-12

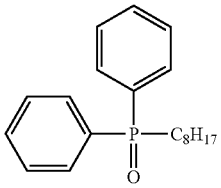

D-13

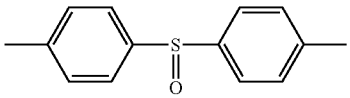

D-14

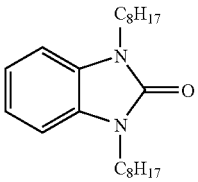

D-15

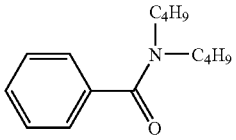

Specific examples of hydrogen bonding compounds other than those enumerated above can be found in those described in EP No. 1096310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and further preferably, from 20 mol % to 100 mol %, with respect to the reducing agent.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projected area of the silver halide grain (projected area of a main plane in a case of a tabular grain).

4) Grain Shape

The shape of the silver halide grain can include, for example, cubic, octahedral, tabular, spherical, rod-like or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the [100] face is rich, because of showing high spectral sensitization efficiency when a spectral sensitizing dye is adsorbed. The ratio is preferably 50% or more, more preferably 65% or more, and further preferably 80% or more. The ratio of the [100] face, Miller indices, can be determined by a method described in T. Tani; J. Imaging Sci., vol. 29, page 165, (1985) utilizing adsorption dependency of the [111] face and [100] face in adsorption of a sensitizing dye.

5) Heavy Metal

The photosensitive silver halide grain of the invention can contain metals or complexes of metals belonging to groups 3 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium or iridium. The metal complex may be used alone, or two or more kinds of complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6,]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having a pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per 1 silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ per 1 mol of silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

10) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mol to 0.5 mol, preferably, from 0.02 mol to 0.3 mol, and further preferably from 0.03 mol to 0.2 mol, per 1 mol of the organic silver salt.

11) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

12) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu" by N. Hamby and M. F. Edwards, translated by Koji Takahashi (Nikkan Kogyo Shinbunsha, 1989).

(Explanations of the Binder)

As the binder in the image forming layer in the invention, any polymer may be used insofar as it is a hydrophilic binder. Preferable binders are transparent or semitransparent and usually colorless. Examples of the binders include polymers and copolymers of natural resins, polymers and copolymers of synthetic resins, and media forming films, for example, gelatins, rubbers, poly(vinylalcohols), hydroxyethyl celluloses, cellulose acetates, poly(vinylpyrrolidones), casein, starch, poly(acrylic acids) and poly(methylmethacrylic acids).

In the invention, preferably 50% by weight or more and 100% by weight or less and particularly preferably 70% by weight or more and 100% by weight or less of the binder which may be used together in the layer containing the organic silver salt is a hydrophilic binder.

Examples of the hydrophilic binder include, though not limited to, gelatins and gelatin derivatives (alkali or acid treated gelatins, acetylated gelatins, gelatin oxides, gelatin phthalates and deionized gelatins), polysilicic acid, acylamide/methacrylamide polymers, acryl/methacryl polymers, polyvinylpyrrolidones, poly(vinylacetates), poly(vinylalcohols), poly(vinyllactams), polymers of sulfoalkylacrylates or methacrylates, hydrolyzed poly(vinyl acetates), polysaccharides (e.g., dextrans and starch ethers) and other essentially hydrophilic (defined above) synthetic or natural vehicles (see, for example, Research Disclosure, Item 38957). Gelatins and gelatin derivatives and poly(vinyl alcohols) are more preferable binders, and gelatins and gelatin derivatives are most preferable.

In the invention, the image forming layer is formed by applying a coating solution comprising a solvent containing preferably 30% by weight or more and more preferably 50% by weight or more of water and drying the applied coating solution to form a film.

The aqueous solvent, so-meant here, which can dissolve or disperse the above polymer is water or a mixture of water and 70% by weight or less of a water-miscible organic solvent. Examples of the water-miscible organic solvent may include alcohol types such as methyl alcohol, ethyl alcohol and propyl alcohol, cellosolve types such as methyl cellosolve, ethyl cellosolve and butyl cellosolve, ethyl acetate and dimethylformamide.

As the binder to be used other than the hydrophilic binder, polymers dispersible in an aqueous medium are preferable. As preferable embodiments of these polymers, hydrophobic polymers such as acryl type polymers, poly(esters), rubbers (e.g., SBR resins), poly(urethanes), poly(vinyl chlorides), poly(vinyl acetates), poly(vinylidene chlorides) and polyolefins may be preferably used. These polymers may be straight-chain polymers, branched polymers, crosslinked polymers, so-called homopolymers obtained by polymerizing single monomers or copolymers obtained by polymerizing two or more types of monomers. In the case of copolymers, these copolymers may be either random copolymers or block copolymers. The molecular weight of each of these polymers is 5,000 or more and 1,000,000 or less and preferably 10,000 or more and 200,000 or less in terms of number average molecular weight. The polymers having too small molecular weight bring about unsatisfactory physical strength of the image forming layer. The polymers having too large molecular weight bring about poor filming characteristics. Therefore, molecular weights out of the above range are undesirable. Also, a crosslinkable polymer latex is used particularly preferably.

As to the amount of the binder in the organic silver salt-containing layer (specifically, the image forming layer), the ratio by weight of the organic acid silver/all binder is in a range from 1/10 to 10/1, preferably 0.6 to 3.0 and more preferably 1.0 to 2.5.

The total amount of the binder in the image forming layer in the invention is preferably 0.2 g/m$^2$ or more and 30 g/m$^2$ or less, more preferably 1 g/m$^2$ or more and 15 g/m$^2$ or less and still more preferably 2 g/m$^2$ or more and 10 g/m$^2$ or less. For example, a crosslinking agent for crosslinking and a surfactant for improving coatability may be added to the image forming layer in the invention.

(Preferred Solvents for the Coating Solution)

The solvent (here, a solvent and a dispersant are collectively designated as a solvent) of the image forming layer coating solution of the light-sensitive material in the invention is preferably an aqueous solvent containing 30% by weight or more of water. As components other than water, desired water-miscible organic solvents such as methyl alcohol, ethyl alcohol, isopropyl alcohol, methyl cellosolve, ethyl cellosolve, dimethylformamide and ethyl acetate may be used. The content of water in the solvent of the coating solution is preferably 50% by weight or more and more preferably 70% by weight or more. Preferable examples of the composition of the solvent include only water, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (values: % by weight).

(Explanations of a Fogging Preventive)

Examples of the fogging preventive, stabilizer and stabilizer precursor which may be used in the invention include the compounds described in JP-A No. 10-62899, Paragraph No. 0070 and EP Laid-Open No. 0803764A1, page 20, line 57 to page 21, line 7, the compounds described in JP-A Nos. 9-281637 and 9-329864 and the compounds described in U.S. Pat. No. 6,083,681 and EP No. 1048975.

1) Organic Polyhalogen Compound

Preferable organic polyhalogen compounds which may be used in the invention will be hereinafter explained in detail. The preferable polyhalogen compound in the invention is compounds represented by the following formula (H).

$$Q\text{-}(Y)_n\text{—}C(X1)(X2)Z \qquad \text{Formula (H)}$$

In the formula (H), Q represents an alkyl group, an aryl group or a heterocyclic group, Y represents a divalent connecting group, n denotes 0 or 1, Z represents a halogen atom and X1 and X2 respectively represent a hydrogen atom or an electron attractive group.

In the formula (H), Q is preferably an alkyl group having 1 to 6 carbon atoms, an aryl group having 6 to 12 carbon atoms or a heterocyclic group (e.g., a pyridine or quinoline group) containing at least one nitrogen atom.

When Q is an aryl group in the formula (H), Q represents a phenyl group substituted with an electron attractive group having a positive value as the Hammett's substituent constant □p. As to the Hammett's substituent constant □p, Journal of Medicinal Chemistry, 1973, Vol. 16, No. 11, 1207-1216 and the like may be used as references. Examples of such an electron attractive group include halogen atoms, alkyl groups substituted with an electron attractive group, aryl groups substituted with an electron attractive group, heterocyclic groups, alkyl or arylsulfonyl groups, acyl groups, alkoxycarbonyl groups, carbamoyl groups and sulfamoyl groups. As the electron attractive group, halogen atoms, carbamoyl groups and arylsulfonyl groups are particularly preferable, and carbamoyl groups are especially preferable.

At least one of X1 and X2 is preferably an electron attractive group. The electron attractive group is preferably halogen atoms, aliphatic or aryl or heterocyclic sulfonyl groups, aliphatic or aryl or hetero cyclic acyl groups, aliphatic or aryl or heterocyclic oxycarbonyl groups, carbamoyl groups or sulfamoyl groups, more preferably halogen atoms or carbamoyl groups and particularly preferably a bromine atom.

Z is preferably a bromine atom or iodine atom and more preferably a bromine atom.

Y preferably represents —C(═O)—, —SO—, —$SO_2$—, —C(═O)N(R)— or —$SO_2$N(R)—, more preferably —C(═O)—, —$SO_2$— or —C(═O)N(R)— and particularly preferably —$SO_2$— or —C(═O)N(R)—. R so-designated here represents a hydrogen atom, an aryl group or an alkyl group, more preferably a hydrogen atom or an alkyl group and particularly preferably a hydrogen atom.

n denotes 0 or 1 and preferably 1.

In the formula (H), Y is preferably —C(═O)N(R)— when Q is an alkyl group and Y is preferably —$SO_2$— when Q is an aryl group or a heterocyclic group.

In the formula (H), structures in which residual groups obtained by eliminating a hydrogen atom from the compounds are combined with each other (called a bis type, tris type or tetrakis type) may also be preferably used.

In the formula (H), those having, as a substituent, a dissociable group (e.g., a COOH group or its salt, $SO_3H$ group or its salt, $PO_3H$ group or its salt), group containing a quaternary nitrogen cation (e.g., an ammonium group or pyridinium group), polyethyleneoxy group or hydroxyl group are also preferable embodiments.

Specific examples of the compound of the formula (H) in the invention will be shown below.

(H-1)

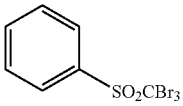

(H-2)

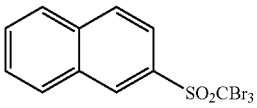

(H-3)

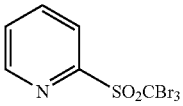

(H-4)

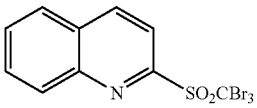

(H-5)

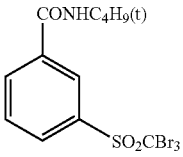

(H-6)

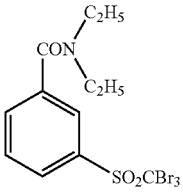

-continued (H-7)

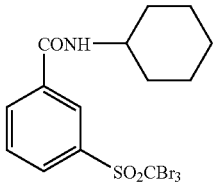

(H-8)

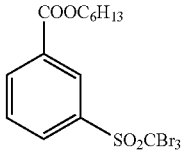

(H-9)

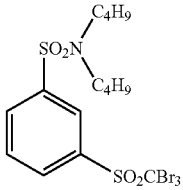

(H-10)

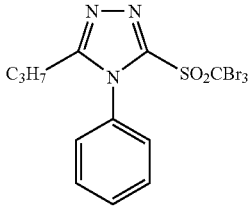

(H-11)

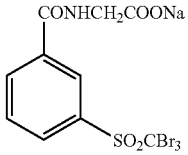

(H-12)

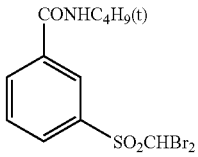

(H-13)

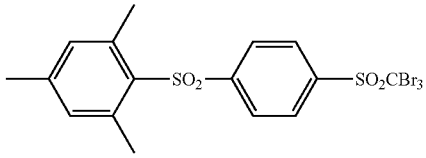

(H-14)

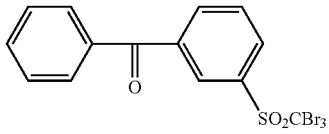

(H-15)

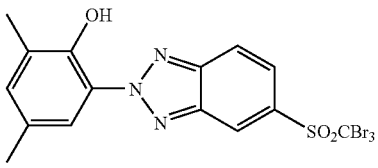

-continued (H-16)

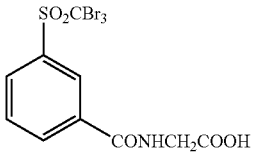

(H-17)

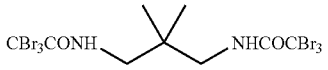

(H-18)

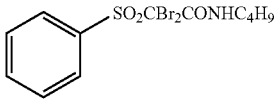

(H-19)

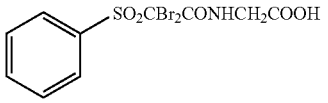

(H-20)

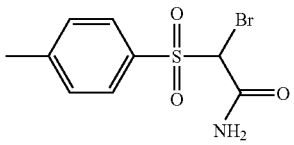

(H-21)

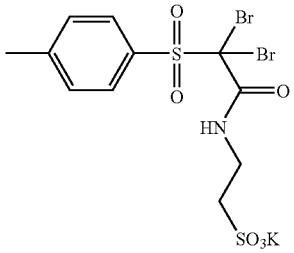

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and similarly, for the organic polyhalogen compound, it is preferably added in the form of a solid fine particle dispersion.

2) Other Fogging Preventive s

As other fogging preventives, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to Claim 9 of JP-A No. 11-352624, a compound expressed by general formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to select a layer on the side having thereon the image forming layer, and more preferred is to select the image forming layer. The azolium salt may be added at any time of the process of preparing the coating solution; in the case where the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like. In the invention, the azolium salt may be added at any amount, but preferably, it is added in a range from $1\times10^{-6}$ mol to 2 mol, and more preferably, from $1\times10^{-3}$ mol to 0.5 mol per 1 mol of silver.

(Explanations of the Compound Represented by the Formula (II) or (III))

Formula (II)

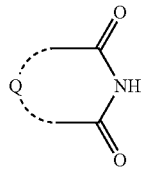

Formula (III)

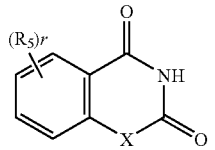

In the formula (II), Q represents an atomic group necessary to form a five- or six-membered imide ring. In the formula (III), $R_5$s respectively represent hydrogen, an alkyl group, a cycloalkyl group, an alkoxy group, an alkylthio group, an arylthio group, a hydroxy group, a halogen group or a $N(R_8R_9)$ group or an atomic group necessary to form an aromatic, heteroaromatic, alicyclic or heterocyclic condensed ring by a combination of optional two $R_5$s, where $R_8$ and $R_9$ respectively represent hydrogen, an alkyl group, an aryl group, a cycloalkyl group, an alkenyl group or a heterocyclic group or an atomic group necessary to form a substituted or unsubstituted five- to seven-membered heterocyclic ring by a combination of $R_8$ and $R_9$, X represents O, S, Se or $N(R_6)$ where $R_6$ represents hydrogen, an alkyl group, an aryl group, a cycloalkyl group, an alkenyl group or a heterocyclic group, and r denotes 0, 1 or 2.

1) Explanations of the Formula (II)

Nitrogen atoms and carbon atoms constituting Q may have a branch bonded to a hydrogen atom, amino group, alkyl group having 1 to 4 carbon atoms, halogen atom, keto oxygen atom or aryl group. Specific examples of the compound having an imide ring and represented by the formula (II) include uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urazol, hydantoin, 5,5-dimethylhydantoin, glutarimide, glutaconimide, citrazinic acid, succinimide, 3,4-dimethylsuccinimide, maleimide, phthalimide and naphthalimide: however, the invention is not limited to these compounds. In the invention, among the compounds having an imide ring and represented by the formula (II), succinimide, phthalimide, naphthalimide and 3,4-dimethylsuccinimide are preferable and succinimide is particularly preferable.

2) Explanations of the Formula (III)

In the formula (III), $R_5$s respectively represent hydrogen, an alkyl group, a cycloalkyl group, an alkoxy group, an alkylthio group, an arylthio group, a hydroxy group, a halogen group or a $N(R_8R_9)$ group. $R_5$s may represent an atomic group necessary to form an aromatic, heteroaromatic, alicyclic or heterocyclic condensed ring by a combination of optional two $R_5$s. When $R_5$s respectively represent an amino group $N(R_8R_9)$, $R_8$ and $R_9$ respectively represent hydrogen, an alkyl group, an aryl group, a cycloalkyl group, an alkenyl group or a heterocyclic group or an atomic group necessary to form a substituted or unsubstituted five- to seven-membered heterocyclic ring by a combination of $R_8$ and $R_9$. In the formula (III), X represents O, S, Se or $N(R_6)$ where $R_6$ represents hydrogen, an alkyl group, an aryl group, a cycloalkyl group, an alkenyl group or a heterocyclic group. r denotes 0, 1 or 2.

The alkyl group useful as $R_5$, $R_6$, $R_8$ and $R_9$ may be a linear, branched or cyclic one and may have 1 to 20 carbon atoms and preferably 1 to 5 carbon atoms. Alkyl groups having 1 to 4 carbon atoms (e.g., methyl, ethyl, iso-propyl, n-butyl, t-butyl and sec-butyl) are very desirable.

The aryl group useful as $R_5$, $R_6$, $R_8$ and $R_9$ may have 6 to 14 carbon atoms in an aromatic ring (one or plural). Preferable examples of the aryl group include a phenyl group or a substituted phenyl group.

The cycloalkyl group useful as $R_5$, $R_6$, $R_8$ and $R_9$ may have 5 to 14 carbon atoms in the center cyclic system. Preferable examples of the cycloalkyl group include cyclopentyl and cyclohexyl.

A useful one as the alkenyl group or alkynyl group may be branched or linear and has 2 to 20 carbon atoms. The alkenyl group is preferably allyl.

The heterocyclic group useful as $R_5$, $R_6$, $R_8$ and $R_9$ may have 5 to 10 carbon, oxygen, sulfur and nitrogen atoms in the center cyclic system and may have a condensed ring.

These alkyl, aryl, cycloalkyl and heterocyclic groups may be further substituted with, though not limited to, one or more groups including a halo group, alkoxycarbonyl group, hydroxy group, alkoxy group, cyano group, acyl group, acyloxy group, carbonyloxyester group, sulfonate group, alkylthio group, dialkylamino group, carboxy group, sulfo group, phosphono group and other groups that are obvious to a person skilled in the art.

The alkoxy group, alkylthio group and arylthio group useful as $R_5$ are those having an alkyl or aryl group as mentioned above. Preferable examples of the halogen group include chloro and bromo. Typical compounds of the formula (III) are the following compounds III-1 to III-10. The compounds III-1 are most preferable.

(III-1)

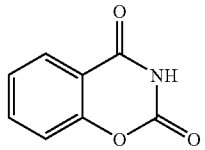

(III-2)

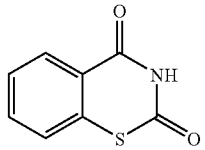

(III-3)

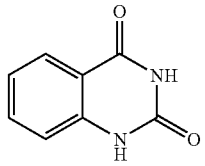

(III-4)

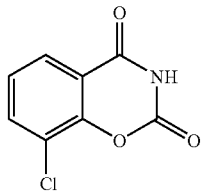

(III-5)

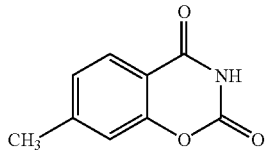

(III-6)

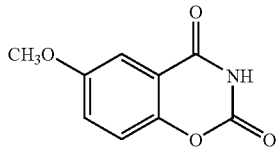

(III-7)

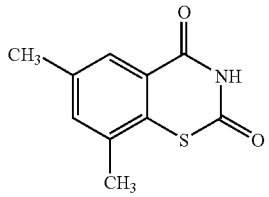

(III-8)

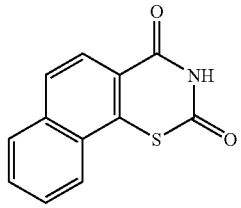

-continued (III-9)

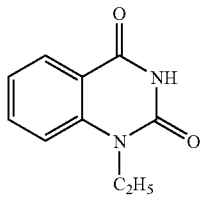

(III-10)

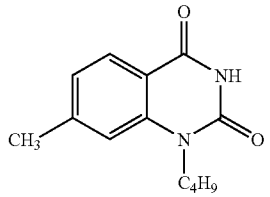

Other useful substituted benzoxazinediones are described in the specification of U.S. Pat. No. 3,951,660 (Hagemann et. al.). These compounds represented by the formulae (II) and (III) are preferably used as color regulators. As the color regulator used in combinations with the compound of the formula (II) or (III), combinations of phthalazinone or phthalazinone derivatives or metal salts of these derivatives, for example, 4-(1-naphthyl)phthalazinone, 6-chlorophthalazinone, 5,7-dimethoxyphthalazinorie and 2,3-dihydro-1,4-phthalazinedione; or phthalazine or phthalazine derivatives (e.g., 5-isopropylphthalazine) and phthalic acid derivatives (e.g., phthalic acid, 4-methylphthalic acid, 4-nitrophthalic acid and tetrachlorophthalic acid) may be used.

The compound represented by the formula (II) or (III) is used in an amount of preferably $10^{-4}$ mol or more and 1 mol or less and more preferably $10^{-3}$ mol or more and 0.5 mol or less and still more preferably $1\times10^{-2}$ mol or more and 0.3 mol or less based on 1 mol of the light-insensitive silver salt of the image forming layer.

Examples of a method of compounding the compound of the formula (II) or (III) according to the invention in the photothermographic material include the method described above as the method of compounding the reducing agent. A compound soluble in water is preferably added in a solution state and a compound insoluble in water is preferably added by dispersing the compound as solid fine particles.

The compound represented by the formula (II) or (III) in the invention is preferably added to the image forming layer or a neighboring protective layer or an intermediate layer and particularly preferably to the image forming layer.

(Plasticizer and Lubricant)

In the invention, a known plasticizer and lubricant may be used to improve film physicality. Particularly, it is preferable to use lubricants such as liquid paraffin, long-chain fatty acid, fatty acid amide and fatty acid esters to improve handling characteristics during production and scratch resistance during heat developing. Particularly, liquid paraffin from which low-boiling point components are removed and fatty acid esters having a branched structure and a molecular weight of 1,000 or more are preferable.

The plasticizers and lubricants which may be used in the image forming layer and non-image forming layer are preferably those described in JP-A No. 11-65021, Paragraph No. 0117, JP-A No. 2000-5137 and Japanese Patent Application Nos. 2003-8015, 2003-8071 and 2003-132815.

(Core Forming Agent)

In the photothermographic material of the invention, a core forming agent is preferably added to the image forming layer. The core forming agent, a method of adding the core forming agent and the amount of the core forming agent to be added are described in the publication of JP-A No. 11-65021, Paragraph No. 0118, the publication of JP-A No. 11-223898, Paragraphs No. 0136 to No. 0193, as compounds represented by the formula (H), formulae (1) to (3) and formulae (A) and (B) in the specification of JP-A No. 2000-284399 and as compounds represented by the formulae (III) to (V) in the specification of JP-A No. 2000-347345. A core forming promoter are described in the publication of JP-A No. 11-65021, Paragraph No. 0102 and the publication of JP-A No. 11-223898, Paragraphs No. 0194 to No. 0195.

In the case of using formic acid or a formate as a strong fogging material, these materials are added to the side having the image forming layer containing the light-sensitive silver halide, in an amount of 5 mmol or less and preferably 1 mmol or less based on 1 mol of silver.

When the core forming agent is used in the photothermographic material of the invention, it is preferable to use an acid produced by hydration of phosphorous pentoxide or a salt of the acid together. Examples of the acid produced by hydration of phosphorous pentoxide or salts of the acid may include methaphosphoric acid (salt), pyrophosphoric acid (salt), orthophosphoric acid (salt), triphosphoric acid (salt), tetraphosphoric acid (salt) and hexamethaphosphoric acid. Particularly preferable examples of the acid produced by hydration of phosphorous pentoxide or salts of the acid include orthophosphoric acid (salt) and hexamethaphosphoric acid. Specific examples of the salts include sodium orthophosphate, sodium dihydrogen orthophosphate, sodium hexamethaphosphate and ammonium hexamethaphosphate.

The amount (coating amount per 1 $m^2$ of the light-sensitive material) of the acid produced by hydration of phosphorous pentoxide or salts of the acid is preferably 0.1 $mg/m^2$ or more and 500 $mg/m^2$ or less and more preferably 0.5 $mg/m^2$ or more and 100 $mg/m^2$ or less though it may be a desired one according to the qualities of the light-sensitive material such as sensitivity and fogging.

The reducing agent, hydrogen bonding compound, developing promoter and the polyhalogen compound are respectively preferably used in the form of a solid dispersion and preferable methods of producing these solid dispersions are described in JP-A No. 2002-55405.

(Preparation and Application of Coating Solutions)

The temperature at which the image forming layer coating solution is prepared in the invention is preferably 30° C. or more and 65° C. or less, more preferably 35° C. or more and less than 60° C. and still more preferably 35° C. or more and 55° C. or less. Also, it is preferable that the temperature of the image forming layer coating solution just after the polymer latex is added be kept at a temperature of 30° C. or more and 65° C. or less.

(Layer Structure and Structural Component)

The photothermographic material of the invention has the non-image forming layer in addition to the image forming layer. The non-image forming layer may be classified by its location into the following layers:

(a) a surface protective layer disposed on (on the side most apart from a support) an image forming layer;

(b) an intermediate layer disposed between plural image forming layers or between an image forming layer and a protective layer;

(c) an undercoating layer disposed between an image forming layer and a support; and (d) a back layer disposed on the side opposite to an image forming layer.

The surface protective layer may be constituted of one layer or plural layers. In the invention, the photothermographic material is preferably provided with the outermost layer in which 70% by weight or more of the binder is a hydrophilic binder as the outermost layer disposed on the side formed with the image forming layer.

Also, a layer that functions as an optical filter may be disposed. In this case, this layer will be formed as the layer of (a) or (b). An antihalation layer is formed as the layer of (c) or (d) on the light-sensitive material.

1) Outermost Layer (Hydrophilic Polymer)

In the invention, the binder in the non-image forming layer contains a hydrophilic polymer in an amount of preferably 70% by weight or more, more preferably 80% by weight or more and still more preferably 90% by weight or more.

The hydrophilic polymer is preferably a water-soluble polymer derived from animal proteins from the point that it has setting characteristics and traps generated organic acids efficiently though it may be a hydrophilic polymer derived from animal proteins or a hydrophilic polymer which is not derived from animal proteins.

<Hydrophilic Polymer Derived from Animal Proteins>

In the invention, the hydrophilic polymer derived from animal proteins means natural or chemically modified polymers such as glue, casein, gelatin and albumen.

Among these polymers, gelatins are preferable. There are acid-treated gelatins and alkali-treated gelatins (treated with lime) which may be both preferably used. It is preferable to use a gelatin having a molecular weight of 10,000 to 1,000,000. Also, denatured gelatins obtained by denaturing treatment utilizing an amino group or carboxyl group of gelatins may also be used (e.g., gelatin phthalate).

An aqueous gelatin solution is made into a sol when it is heated to 30° C. or more and then gelled so that it loses fluidity when the temperature of the sol solution is dropped to less than 30° C. Such a sol-gel transformation takes place reversely by a change in temperature. Therefore, the aqueous gelatin solution which is a coating solution has such setting characteristics that it loses fluidity when it is cooled to a temperature of 30° C. or less.

Also, the water-soluble polymer derived from animal proteins may be used together with the following water-soluble polymer which is not derived from animal proteins and/or a hydrophobic polymer.

<Hydrophilic Polymer which is not Derived from Animal Proteins>

The water-soluble polymer which is not derived from animal proteins, such as gelatins, are natural polymers (polysaccharide type, microorganism type and animal type) other than animal proteins and semi-synthetic polymers (cellulose type, starch type and alginic acid type). Synthetic polymers including polyvinyl alcohols and natural or semi-synthetic polymers using, as raw materials, celluloses derived from vegetables as will be described later fall in this category. Among these polymers, polyvinyl alcohols and acrylic acid/vinyl alcohol copolymers are preferable. Because the water-soluble polymer which is not derived from animal proteins has no setting characteristic, it is preferably used together with a gelling agent as will be explained later when it is used in a layer adjacent to the outermost layer.

As the water-soluble polymer which is not derived from animal proteins, polyvinyl alcohols are preferable. Examples of the polyvinyl alcohol (PVA) that is preferably used in the invention include those having various saponification degrees, degree of polymerization and degrees of neutralization, various modifications and copolymers of these polyvinyl alcohols and various monomers.

The denatured polyvinyl alcohol may be selected from cationic modifications, anionic modifications, products modified by a —SH compound, products modified by an alkylthio compound and products modified by silanol. Besides the above, modified polyvinyl alcohols as described in Nagano Koichi et. al. "Poval", published by Polymer Publishing Association may be used.

As to the polyvinyl alcohol, its viscosity can be regulated or stabilized by a minute amount of solvent or inorganic salts to be added to a solution of the polyvinyl alcohol. Specifically, as these solvent and inorganic salts, those described in the above reference, Nagano Koichi et. al. "Poval", published by Polymer Publishing Association, pp 144-154 may be used. In one of typical examples, boric acid may be compounded to improve the quality of coating surface. The amount of boric acid is 0.01% by weight or more and 40% by weight or less based on the polyvinyl alcohol.

Also, it is described in the above reference "Poval" that the polyvinyl alcohol is improved in the degree of crystallization and water resistance by heat treatment. It is therefore preferable to heat when a coating layer is dried or to carry out additional heat treatment after a coating layer is dried to improve water resistance.

In order to further improve water resistance, a water resistance improver as described in the same reference pp 256-261 is preferably added. Examples of the water resistance improver include aldehydes, methylol compounds (e.g., N-methylol urea and N-methylolmelamine), activated vinyl compounds (e.g., divinylsulfone and its derivatives), bis(□-hydroxyethylsulfone), epoxy compounds (e.g., epichlorohydrin and its derivative), polyvalent carboxylic acids (e.g., dicarboxylic acid, polyacrylic acid as polycarboxylic acid, methyl vinyl ether/maleic acid copolymers and isobutylene/maleic acid anhydride copolymers), diisocyanates and inorganic type crosslinking agents (compounds of, for example, Cu, B, Al, Ti, Zr, Sn, V or Cr).

Preferable examples of the water resistance improver include inorganic crosslinking agents. Among these agents, boric acid or its derivatives are preferable and boric acid is particularly preferable.

Examples of the water-soluble polymer which is not derived from animal proteins may include the following polymers besides the aforementioned polyvinyl alcohols.

Given as specific examples of the water-soluble polymer which is not derived from animal proteins are vegetable type polysaccharides including gum arabic, κ-carrageenan, ι-carrageenan, λ-carrageenan, guar gum (trade name: Supercol and the like, manufactured by Squalon), locust bean gum, pectin, tragacanth gum, corn starch (trade name: Purity-21 and the like, manufactured by National Starch & Chemical Co.) and starch phosphate (trade name: National 78-1898 and the like, manufactured by National Starch & Chemical Co.,).

Given as specific examples of the water-soluble polymer are also microorganism type polysaccharides including xanthane gum (trade name: Keltrol T and the like: manufactured by Kelco) and dextrin (trade name: Nadex 360 and the like, manufactured by National Starch & Chemical Co.). Given as specific examples of the water-soluble polymer are also animal type polysaccharides including sodium chondroitin sulfate (trade name: Cromoist CS and the like manufactured by Croda).

Examples of the cellulose type polymer include ethyl cellulose (trade name: Cellofas WLD and the like, manufactured by I.C.I.), carboxymethyl cellulose (trade name: CMC and the like, manufactured by Daicel Chemical Industries, Ltd.), hydroxyethyl cellulose (trade name: HEC and the like, manufactured by Daicel Chemical Industries, Ltd.), hydroxypropyl cellulose (trade name: Klucel and the like, manufactured by Aqualon), methyl cellulose (trade name: Viscontran and the like, manufactured by Henkel), nitrocellulose (trade name: Isopropyl Wet and the like, manufactured by Hercules) and cationic cellulose (trade name: Crodacel QM and the like, manufactured by Croda).

Examples of the alginic acid type include sodium alginate (trade name: Keltone and the like, manufactured by Kelco) and propylene glycol alginate. Examples of the water-soluble polymer in other categories include cationic guar gum (trade name: Hi-care 1000 and the like, manufactured by Alcolac) and sodium hyaluronic acid (trade name: Hyalure and the like, manufactured by Lifecare Biomedial).

Other examples may include agar, furselran, guar gum, karaya gum, larch gum, guar seed gum, silume seed gum, kins seed gum, tamarind gum, jelutong gum and tara gum. Among these compounds, those which are highly soluble in water are preferable and those which are transformed in 24 hours from a sol to a gel reversely by a change in temperature within a temperature range from 5° C. to 95° C. are preferably used.

Given as examples of the synthetic polymer are an acryl type including sodium polyacrylate, polyacrylic acid copolymers, polyacrylamides and polyacrylamide copolymers, a vinyl type including polyvinyl pyrrolidone and polyvinyl pyrrolidone derivatives and other polymers including polyethylene glycol, polypropylene glycol, polyvinyl ether, polyethyleneimine, polystyrenesulfonic acid or its copolymer, polyvinylsulfonic acid or its copolymers, polyacrylic acid or its copolymers, acrylic acid or its copolymers, maleic acid copolymers, maleic acid monoester copolymers and acryloylmethylpropanesulfonic acid or its copolymer.

Also, high-water absorptive polymers as described in the specification of U.S. Pat. No. 4,960,681 and the publication of JP-A No. 62-245,260, specifically, homopolymers of vinyl monomers having a —COOM or —$SO_3M$ (M represents a hydrogen atom or an alkali metal) group or copolymers among these vinyl monomers or copolymers of these vinyl monomers and other vinyl monomers (e.g., sodium methacrylate, ammonium methacrylate and Sumica Gel L-5H manufactured by Sumitomo Chemical Co., Ltd.) may also be used.

Among these compounds, the hydrophilic polymer which is not derived from animal proteins and preferably used is Sumica Gel L-5H manufactured by Sumitomo Chemical Co., Ltd.

<Gelling Agent and Gelling Promoter>

The gelling agent in the invention is a material which is to be added to the water-soluble polymer which is not derived from animal proteins in the invention and cooled to cause the solution to gel or a material which causes the solution to gel by combining with a gelling promoter. The gelation results in significantly reduced fluidity.

Specific examples of the gelling agent include the following water-soluble polysaccharides. Specifically, the water-soluble polysaccharide is at least one type selected from agar, κ-carrageenan, ι-carrageenan, alginic acid, alginate, agarose, furselran, jelutong gum, gluconodeldeltalactone, Azotobacter bineran digum, xanthane gum, pectin, guar gum, locust bean gum, tara gum, cassia gum, glucomannan, tragacanth gum, karaya gum, pullulan, gum arabic, arabinogalactan, dextran, carboxymethyl cellulose sodium salt, methyl cellulose, silume seed gum, starch, chitin, chitosan and cardlan.

Examples of the material which is gelled by cooling after it is heated to dissolve include agar, carrageenan and jelutong gum.

Among these gelling agents, κ-carrageenan (e.g., trade name: K-9F, manufactured by Taito Co., Ltd., and trade name: K-15, K-21 to K-24, I-3, manufactured by Nitta Gelatin Inc.), ι-carrageenan and agar are given as preferable examples and κ-carrageenan is given as particularly preferable examples.

The gelling agent is used in an amount of 0.01% by weight or more to 10.0% by weight or less, preferably 0.02% by weight or more to 5.0% by weight or less and more preferably 0.05% by weight or more and 2.0% by weight or less.

The gelling agent is preferably used together with a gelling promoter. The gelling promoter in the invention is a compound which promotes gelation when it is brought into contact with the gelling agent and its function is exhibited by a specified combination with the gelling agent. In the invention, as the combination of the gelling agent and the gelling promoter, the following combinations may be utilized.

i) A combination of an alkali metal ion such as potassium or an alkali earth metal such as calcium or magnesium as the gelling promoter and carrageenan, alginate, jelutong gum, Azotobacter bineran digum, pectin or carboxymethyl cellulose sodium salt as the gelling agent.

ii) A combination of boric acid or other boron compound as the gelling promoter and guar gum, locust bean gum, tara gum or cassia gum as the gelling agent.

iii) A combination of an acid or alkali as the gelling promoter and an alginate, glucomannan, pectin, chitin, chitosan and cardlan as the gelling agent.

iv) Water-soluble promoters that react with a gelling agent to form a gel are used as the gelling promoter. Specifically, a combination of xanthane gum used as the gelling agent and cassia gum used as the gelling promoter and a combination of carrageenan used as the gelling agent and locust bean gum used as the gelling promoter may be exemplified.

Specific examples of these combinations of gelling agents and gelling promoters may include the following combinations a) to g).

a) A combination of κ-kcarrageenan and potassium.

b) A combination of ι-carrageenan and calcium.

c) A combination of low methoxyl pectin and calcium.

d) A combination of sodium alginate and calcium.

e) A combination of jelutong gum and calcium.

f) A combination of jelutong gum and an acid.

g) A combination of locust bean gum and xanthane gum.

These combinations may be used in combinations of two or more at the same time.

Although the gelling promoter and the gelling agent may be added in the same layer, they are preferably added in different layers to allow the both to act on each other. It is more preferable to add the gelling promoter to a layer which is not in direct contact with the layer containing the gelling agent. Specifically, it is more preferable to provide a layer containing neither the gelling agent nor the gelling promoter between the layer containing the gelling agent and the layer containing the gelling promoter.

The gelling promoter is preferably used in an amount of 0.1% by weight or more and 200% by weight or less and preferably 1.0% by weight or more and 100% by weight or less based on the gelling agent.

<Use of a Combination of a Hydrophilic Polymer and a Hydrophobic Polymer>

In the binder of the non-image forming layer, a hydrophobic polymer may be used together with the aforementioned hydrophilic polymer in an amount range not exceeding 30% by weight. The hydrophobic polymer which may be used together is preferably a polymer dispersible in an aqueous solvent.

Preferable examples of the polymer dispersible in an aqueous solvent may include synthetic resins, polymers and copolymers, and other media forming films, for example, cellulose acetates, cellulose acetate butyrates, poly(methylmethacrylic acids), poly(vinyl chlorides), poly(methacrylic acids), styrene/maleic acid anhydride copolymers, styrene/acrylonitrile copolymers, styrene/butadiene copolymers, poly(vinylacetals) (e.g., poly(vinylformal) and poly(vinylbutyral)), poly(esters), poly(urethanes), phenoxy resins, poly(vinylidene chlorides), poly(epoxides), poly(carbonates), poly(vinyl acetates), poly(olefins), cellulose esters and poly(amides).

<Coating Amount of the Binder>

The total coating amount of the binder (including a hydrophilic polymer and a latex polymer) of the non-image forming layer is preferably 0.3 g/m or more and 5.0 g/m$^2$ or less and more preferably 0.3 g/m$^2$ or more and 2.0 g/m$^2$ or less.

<Additive>

Besides the binder, various additives may be added to the non-image forming layer. Examples of these additives include a surfactant, pH regulator, antiseptic and mildew proofing agent.

Also, when the non-image forming layer is a surface protective layer, it is preferable to use a lubricant such as liquid paraffin or aliphatic ester. The amount of the lubricant to be used is in a range from 1 mg/m$^2$ or more to 200 mg/m$^2$ or less, preferably 10 mg/m$^2$ or more to 150 mg/m$^2$ or less and more preferably 20 mg/m$^2$ or more to 100 mg/m$^2$ or less.

2) Back Layer

The back layer which may be applied to the invention is described in JP-A No. 11-65021, Paragraph Nos. 0128 to 0130.

In the photothermographic material of the invention, the halation-preventive layer preferably a layer containing the aforementioned metal phthalocyanine compound.

In the invention, it is possible to add a colorant having an absorption maximum at a wavelength range from 300 nm to 450 nm for the purpose of improving a silver tone and a deterioration of an image with time. Such a colorant is described in, for example, JP-A Nos. 62-210458, 63-104046, 63-103235, 63-208846, 63-306436, 63-314535, 01-61745 and 2001-100363.

Such a colorant is used in amount of generally 0.1 mg/m$^2$ to 1 g/m$^2$ and the colorant is preferably added to the back layer disposed on the side opposite to the image forming layer.

The photothermographic material of the invention is preferably a one-side light-sensitive material provided with at least one image forming layer containing silver halide emulsion on one side of a support and a back layer on the other side of the support.

3) Matting Agent

In the invention, it is preferable to add a matting agent for improving the transfer characteristics. The matting agent is described in JP-A No. 11-65021, Paragraph Nos. 0126 to 0127. The amount of the matting agent is preferably 1 mg/m$^2$ or more and 400 mg/m$^2$ or less and more preferably 5 mg/m$^2$ or more and 300 mg/m$^2$ or less as a coating amount per 1 m$^2$ of the light-sensitive material.

The matting agent in the invention may have any form, for example, non-amorphous or amorphous forms and preferably a non-amorphous form, and a sphere form is preferably used.

The volume average of the matting agent used in the surface of the image forming layer is preferably 0.3 μm or more and 10 μm or less and more preferably 0.5 μm or more and 7 μm or less. The coefficient of variation of the size distribution of the matting agent is preferably 5% or more and 80% or less and more preferably 20% or more and 80% or less. Here, the coefficient of variation means the value given by the equation: (Standard deviation of particle diameters)/(Average of particle diameters)×100. As the matting agent in the surface of the image forming layer, two or more types of matting agents differing in particle size may be used. In this case, the difference in particle size between a matting agent having a largest average particle size and a matting agent having a smallest particle size is preferably 2 μm or more and 8 μm or less and more preferably 2 μm or more and 6 μm or less.

The volume average of the sphere equivalent diameter of the matting agent used in the back surface is preferably 1 μm or more and 15 μm or less and more preferably 3 μm or more and loom or less. The coefficient of variation of the size distribution of the matting agent is preferably 3% or more and 50% or less and more preferably 5% or more and 30% or less. As the matting agent in the back surface, two or more types of matting agents differing in particle size may be used. In this case, the difference in particle size between a matting agent having a largest average particle size and a matting agent having a smallest particle size is preferably 2 μm or more and 14 μm or less and more preferably 2 μm or more and 9 μm or less.

The matt degree on the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standard (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more; and further preferably, 500 seconds or less and 40 seconds or more when expressed by Beck's smoothness.

In the present invention, a matting agent is preferably contained in an outermost layer, in a layer which can be function as an outermost layer, or in a layer nearer to outer surface, and also preferably is contained in a layer which can function as so-called protective layer.

4) Polymer Latex

A polymer-latex is preferably used in the surface protective layer and the back layer of the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

5) Surface pH

The surface pH of the photothermographic material according to the invention preferably yields a pH of 7.0 or lower, and more preferably, 6.6 or lower, before a thermal developing process. Although there is no particular restriction concerning the lower limit, the lower limit of pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

6) Hardener

A hardener may be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048 and the like.

The hardener is added as a solution, and the solution is added to the coating solution for forming the protective layer 180 minutes before coating to just before coating, and preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Hamby, M. F. Edwards, A. W. Nienow (translated by Koji Takahashi) "Liquid Mixing Technology" (Nikkan Kogyo Shinbunsha, 1989), and the like.

7) Surfactant

As for the surfactant, the solvent, the support, antistatic agent and the electrically conductive layer, and the method for obtaining color images applicable in the invention, there can be mentioned those disclosed in paragraph Nos. 0132, 0133, 0134, 0135, and 0136, respectively, of JP-A No. 11-65021.

In the invention, it is preferred to use a fluorocarbon surfacant. Specific examples of fluorocarbon surfacants can be found in those described in JP-A Nos. 10-197985, 2000-19680, and 2000-214554. Polymer fluorocarbon surfacants described in JP-A 9-281636 can be also used preferably. For the photothermographic material in the invention, the fluorocarbon-surfacants described in JP-A Nos. 2002-82411, 2003-57780, and 2001-264110 are preferably used. Especially, the usage of the fluorocarbon surfacants described in JP-A Nos. 2003-57780 and 2001-264110 in an aqueous coating solution is preferred viewed from the standpoint of capacity in static control, stability of the coating surface state and sliding facility. The fluorocarbon surfactant described in JP-A No. 2001-264110 is mostly preferred because of high capacity in static control and that it needs small amount to use.

According to the invention, the fluorocarbon surfactant can be used on either side of image forming layer surface side or back layer surface side, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 $mg/m^2$ to 100 $mg/m^2$ on each surface side of image forming layer and back layer, more preferably from 0.3 $mg/m^2$ to 30 $mg/m^2$, and further preferably from 1 $mg/m^2$ to 10 $mg/m^2$. Especially, the fluorocarbon surfactant described in JP-A No. 2001-264110 is effective, and used preferably in a range of from 0.01 $mg/m^2$ to 10 $mg/m^2$, and more preferably from 0.1 $mg/m^2$ to 5 $mg/m^2$.

8) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like;

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or plate-like shape. The needle-like particles, with the rate of (the major axis)/(the minor axis) is more than 2.0, and more preferably, 3.0 to 50, is preferred viewed from the standpoint of the electric conductivity effect. The metal oxides is used preferably in a range from 1 mg/$m^2$ to 1000 mg/$m^2$, more preferably from 10 mg/$m^2$ to 500 mg/$m^2$, and further preferably from 20 mg/$m^2$ to 200 mg/$m^2$.

The antistatic layer can be laid on either side of the image forming layer surface side or the back layer surface side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

9) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like. The moisture content of the support is preferably 0.5% by weight or less when coating for image forming layer and back layer is conducted on the support.

10) Other Additives

Furthermore, antioxidant, stabilizing agent, plasticizer, UV absorbent, or a coating aid may be added to the photothermographic material. Each of the additives is added to either of the image forming layer or the non-photosensitive layer. Reference can be made to WO No. 98/36322, EP-A No. 803764A1, JP-A Nos. 10-186567 and 10-18568, and the like.

11) Coating Method

The photothermographic material of the invention may be coated by any method. More specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the layer containing organic silver salt in the invention at a shear velocity of 0.1 S−1 is preferably from 400 mPa·s to 100,000 mPa·s, and more preferably, from 500 mPa·s to 20,000 mPa·s. At a shear velocity of 1000 S−1, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

12) Wrapping Material

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 mL·atm-1 m-2 day-1 or lower at 25° C., more preferably, 10 mL·atm-1 m-2 day-1 or lower, and further preferably, 1.0 mL·atm-1 m-2 day-1 or lower. Preferably, vapor transmittance is 10 g·atm-1 m-2 day-1 or lower, more preferably, 5 g·atm-1 m-2 day-1 or lower, and further preferably, 1 g·atm-1 m-2 day-1 or lower. As specific examples of a wrapping material having low oxygen transmittance and/or vapor transmittance, reference can be made to, for instance, the wrapping material described in JP-A Nos. 8-254793 and 2000-206653.

13) Other Applicable Techniques

Techniques which can be used for the photothermographic material of the invention also include those in EP-A No. 803764A1, EP-A No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

In the multicolor photothermographic material, each image forming layer is generally kept discriminated from the others by using a functional or nonfunctional barrier layer between each image forming layer and the others as described in U.S. Pat. No. 4,460,681.

The structure of the multicolor photothermographic material may include such combinations of two layers for each color, and also, all components may be contained in a single layer as described in U.S. Pat. No. 4,708,928.

(Image Forming Method)

1) Exposure

A He—Ne laser emitting infrared to near-infrared light, red semiconductor laser, or blue to green light emitting $Ar^+$, He—Ne, He—Cd laser or blue semiconductor laser is used. A infrared to near-infrared semiconductor laser is preferable and the peak wavelength of laser light is 600 nm to 900 nm and preferably 620 nm to 850 nm. It is more preferable that the laser power be high power and an infrared semiconductor laser (780 nm, 810 nm) be used from the point that the photothermographic material of the invention is made to be transparent.

In the meantime, with recent development of, particularly, modules and blue semiconductor laser obtained by combining SHG (Second Harmonic Generator) elements and semiconductor lasers, laser output devices working in a short wavelength range have been given a great deal of attention. The blue semiconductor laser enables highly precise image recording and an increase in recording density and ensures long-life and stable output. Therefore, demands for this blue semiconductor laser are expected to expand in the future. The peak wavelength of the blue laser light is preferably 300 nm to 500 nm and particularly 400 nm to 500 nm.

Laser light which oscillates with a vertical multi waveform by frequency superposition is preferably used.

2) Heat Developing

The photothermographic material of the invention is usually developed by raising the temperature of the light-sensitive material which has been exposed imagewise though it may be developed by any method. The developing temperature is preferably 80 to 250° C., more preferably 100 to 140° C. and still more preferably 110 to 130° C. The developing time is preferably 1 second to 60 seconds, more preferably 3 seconds to 30 seconds, still more preferably 5 seconds to 25 seconds and particularly preferably 7 seconds to 15 seconds. As the system of heat developing, the light-sensitive material is preferably developed by a drum heater though any of a drum type heater and plate type heater may be used. Also, when a protective layer is disposed on the image forming layer, it is preferable to carry out heat treatment by bringing the protective layer side surface into contact with a heating means from the viewpoint of heat efficiency and operability to attain uniform heating. A developing method in which the light-sensitive material is transported and heat-treated with bringing that surface into contact with a heater.

3) System

Examples of medical laser imagers provided with an exposing part and a heat developing part may include imagers (trade name: Dry Laser Imager FM-DPL and DRYPIX 7000, manufactured by Fuji Medical and trade name: Dry View 8700 Laser Imager Plus, manufactured by Eastman Kodak Co.,). There are descriptions concerning the above FM-DPL in Fuji Medical Review No. 8, pp 39-55. Of course, these technologies may be applied to a laser imager used for the photothermographic material of the invention. Also, the photothermographic material of the invention may be applied to a photothermographic material for a laser imager in "AD network" proposed by Fuji Film Medical Co., Ltd. as a network system suitable for DICOM standard.

(Application of the Invention)

The photothermographic material of the invention is preferably used in various photothermographic materials for forming a black-white image made of a silver image, for example, photothermographic materials for medical diagnosis, photothermographic materials for industrial photography, heat developing materials for printing and heat developing light-system materials for COM and more preferably used for photothermographic materials for medical diagnosis.

EXAMPLES

The present invention is specifically explained by way of Examples below, which should not be construed as limiting the invention thereto.

Example 1

(Preparation of PET Support)

(1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm2 to obtain a roll having the thickness of 175 μm.

(2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m2 was executed, judging from the readings of current and voltage on that occasion. The frequency upon this treatment was 9.6 kHz, and the gap clearance between the electrode and dielectric roll was 1.6 mm.

3) Undercoating

| Formulation (1) (for the image forming layer side undercoat layer) | |
|---|---|
| Pesresin A-520 (30 wt % solution) manufactured by Takamatsu Oil & Fat Co., Ltd.) | 46.8 g |
| Bironal MD-1200 manufactured by Toyobo Co., Ltd. | 10.4 g |
| Polyethylene glycol monononylphenyl ether (average ethylene oxide number = 8.5) 1 wt % solution | 11.0 g |
| MP-1000 (PMMA polymer fine particles manufactured by Soken Chemical & Engineering Co., Ltd., average particle diameter: 0.4 μm) | 0.91 g |
| Distilled water | 931 ml |
| **Formulation (2) (for the backside first layer)** | |
| Styrene-butadiene copolymer latex (solid content: 40% by weight, ratio by weight of styrene/butadiene = 68/32) | 130.8 g |
| Aqueous 8 wt % solution of sodium 2,4-dichloro-6-hydroxy-S-triazate | 5.2 g |
| Aqueous 1 wt % solution of sodium laurylbenzenesulfonate | 10 ml |
| Polystyrene particle dispersion (average particle diameter 2 μm, 20 wt %) | 0.5 g |
| Distilled water | 854 ml |
| **Formulation (3) (for the backside second layer)** | |
| $SnO_2$/SbO (9/1 (weight ratio), average particle diameter: 0.5 μm, 17 wt % dispersion) | 84 g |
| Gelatin | 7.9 g |
| Metorose TC-5 (aqueous 2 wt % solution), manufactured by Shin-Etsu Chemical Co., Ltd.) | 10 g |
| Aqueous 1 wt % solution of sodium dodecylbenzenesulfonate | 10 ml |
| NaOH (1 wt %) | 7 g |
| Proxel (manufactured by Abicia) | 0.5 g |
| Distilled water | 881 ml |

Both surfaces of the biaxial oriented polyethylene terephthalate support 175 μm in thickness were respectively subjected to the aforementioned corona discharge treatment. Then, the aforementioned undercoating layer coating solution (1) was applied to one surface (image forming layer side) of the support by a wire bar such that the wet coating amount was 6.6 ml/$m^2$ (per one surface) and dried at 180° C. for 5 minutes. Then, the above undercoating coating solution (2) was applied to the back surface by a wire bar such that the wet coating amount was 5.7 ml/$m^2$ (per one surface) and dried at 180° C. for 5 minutes. Further, the above undercoating coating solution (3) was applied to the back surface by a wire bar such that the wet coating amount was 8.4 ml/$m^2$ per one surface) and dried at 180° C. for 6 minutes, to manufacture an undercoated support.

(Back Layer)

1) Preparation of a Back Layer Coating Solution

<<Preparation of a Dye A Dispersion Solution>>

250 g of water was added to 15 g of the dye A and 6.4 g of Demol N manufactured by Kao Corporation and thoroughly mixed to form slurry. 800 g of zirconia beads having an average diameter of 0.5 mm were prepared and placed in a vessel together with the slurry to disperse in a dispersing machine (trade name: 1/4 G Sand Grinder Mill, manufactured by IMEX) for 25 hours. To the slurry was added water such that the dye concentration was 5% by weight to obtain dye dispersion.

<<Preparation of a Halation Preventive Layer Coating Solution>>

The container was kept at 40° C. and 37 g of a gelatin (trade name: PZ gelatin, manufactured by Miyagi Kagaku Kogyo (K.K.)) having an isoelectric point of 4.8, 0.1 g of benzoisothiazolinone and water were added in the container to dissolve the gelatin. 43 ml of an aqueous 3 wt % sodium polystyrenesulfonate solution, 82 g of a 10 wt % SBR latex (styrene/butadiene/acrylic acid copolymer: weight ratio 68.3/28.7/3.0) solution and 40 g of the dye A dispersion solution were added to the gelatin solution, to prepare a halation preventive coating solution.

2) Preparation of a Backsurface Side Protective Layer Coating Solution

The container was kept at 40° C. and 43 g of a gelatin (trade name: PZ gelatin, manufactured by Miyagi Kagaku Kogyo (K.K.)) having an isoelectric point of 4.8, 0.21 g of benzoisothiazolinone and water were added in the container to dissolve the gelatin. 8.1 ml of 1 mol/l aqueous sodium acetate solution, 0.93 g of monodisperse poly(ethylene glycol dimethacrylate/co-methylmethacrylate) fine particles (average particle size: 7.7 μm, standard deviation of particle diameter: 0.3 μm), 5 g of a 10 wt % liquid paraffin emulsion, 10 g of a 10 wt % dipentaerythritol hexaisostearate emulsion, 10 ml of an aqueous 5 wt % sodium (2-ethylhexyl) sulfosuccinate solution, 17 ml of a 3 wt % sodium polystyrenesulfonate solution, 2.4 ml of a 2 wt % fluorine type surfactant (F-1) solution, 2.4 ml of a 2 wt % fluorine type surfactant (F-2) solution and 30 ml of a 20 wt % ethylacrylate/acrylic acid copolymer (copolymerization ratio by weight: 96.4/3.6) latex were mixed in the above gelatin solution. 50 ml of an aqueous 4 wt % N,N-ethylenebis (vinylsulfonacetamide) was added to the mixture just before coated, to prepare a back surface protective layer coating solution having a complete amount of 855 ml.

(Dye A)

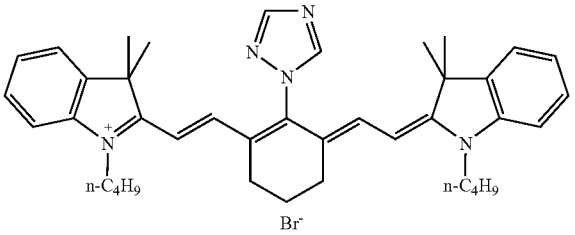

(F-1)

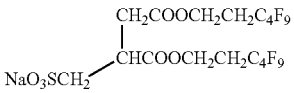

(F-2)

Mixture of

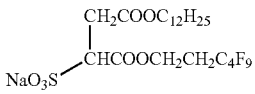

and

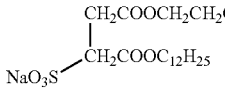

3) Application of the Back Layer

The anti-halation layer coating solution and the back surface protective layer coating solution were overlaid simultaneously on the undercoated support such that the amounts of gelatin to be applied were 1.0 g/m$^2$ and 1.0 g/m$^2$ respectively and then dried to manufacture a back layer.

(Image Forming Layer and Surface Protective Layer)

1. Preparation of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of 0.5 mol/L sulfuric acid and 31.7 g of phthalated gelatin was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion-1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted. The precipitation/desalting/water washing/dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion-2. The grains in the silver halide emulsion-2 were pure cubic silver bromide grains having a mean equivalent spherical diameter of 0.080 μm and a variation coefficient of an equivalent spherical diameter distribution of 20%.

<<Preparation of Silver Halide Emulsion-3>>

Preparation of silver halide emulsion-3 was conducted in a similar manner to the process in the preparation of the silver halide emulsion-1 except that the temperature of the liquid upon the grain forming process was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizing dye A and the spectral sensitizing dye B was changed to the solid dispersion (aqueous gelatin solution) at a molar ratio of 1:1 with the amount to be added being $6.0\times10^{-3}$ mol in total of the spectral sensitizing dye A and spectral sensitizing dye B per 1 mol of silver; the amount of the tellurium sensitizer C to be added was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. The grains in the silver halide emulsion-3 were silver iodide bromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight, and the silver halide emulsion-3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparations of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

(1) Preparation of Silver Behenate Nano-Particle Dispersion-1

A reactor was charged with 1,900 ml of deionized water, 36 ml of a 10% dodecylthiopolyacrylamide surfactant solution and the above recrystallized behenic acid (46.6 g). The content in the reactor was stirred at 150 rpm and heated to 70° C. while a 10 wt % KOH solution (70.6 g) was poured into the reactor. Then, the content in the reactor was heated to 80° C. and then kept for 30 minutes in this condition until the solution was clouded. Then, the reaction mixture was cooled to 70° C. and then a silver nitrate solution (100% solution, 21.3 g) constituted of silver nitrate was added in the reactor over 30 minutes with controlling the addition speed. Then, the content in the reactor was kept at the reaction temperature for 30 minutes and then cooled to ambient temperature, followed by decanting. A nano-particle silver behenate dispersion having a median grain size of 150 nm was thus obtained (solid content: 3%).

The resulting nano-particle silver behenate dispersion (2 kg) having a solid content of 3% by weight was charged in a diafiltration/ultrafiltration apparatus (equipped with an Osmonics model 21-HZ20-S8J osmosis membrane cartridge having an effective surface area of 0.34 $m^2$ and a nominal molecular weight cutoff of 50,000). An aqueous 0.18 wt % dodecylthiopolyacrylamide surfactant solution was used as substitution water. The apparatus was operated such that pressure applied to the osmosis membrane was 3.5 $kg/cm^2$ (50 $lb/in^2$). The penetrant was replaced with deionized water until 24 kg of the penetrant was removed from the dispersion. At this stage, the supply of the substitution water was stopped and then the apparatus was operated until the dispersion had a solid concentration of 28% by weight, to obtain a nano-particle silver behenate dispersion.

3) Preparation of Reducing Agent Dispersion

<<Preparation of Reducing Agent-1 Dispersion>>

10 kg of water was added to 10 kg of a reducing agent-1 (6,6'-di-t-butyl-4,4'-dimethyl-2,2'-butylidenediphenol) and 16 kg of an aqueous 10 wt % denatured polyvinyl alcohol (trade name: Poval MP203, manufactured by Kuraray Co., Ltd.) and these components were thoroughly mixed to form a slurry. This slurry was fed using a diaphragm pump to a horizontal sand mill (trade name: UVM-2, manufactured by IMEX filled with zirconia beads having an average diameter of 0.5 mm, where the mixture was dispersed for 3 hours. Then, the dispersion was adjusted by adding 0.2 g of a benzoisothiazolinone sodium salt and water such that the concentration of the reducing agent was 25% by weight. This dispersion solution was treated under heating for 5 hours to obtain reducing agent-1 dispersion. The reducing agent particles contained in the reducing agent dispersion thus obtained had a median diameter of 0.40 μm and a maximum particle diameter of 1.4 μm or less. The resulting reducing agent dispersion was subjected to filtration using a polypropylene filter having a pore diameter of 3.0 μm to remove foreign matter such as dusts and then stored.

4) Preparations of Organic Polyhalogen Compound Dispersion

<Organic Polyhalogen Compound-1 Dispersion>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Organic Polyhalogen Compound-2 Dispersion>

10 kg of organic polyhalogen compound-2 (N-butyl-3-tribromomethane sulfonylbenzoamide), 20 kg of a 10% by weight aqueous solution of modified polyvinyl alcohol (manufactured by Kuraray Co., Ltd., Poval MP203) and 0.4 kg of a 20% by weight aqueous-solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.]

5) Irradiation Preventive Dye

<<Preparation of Pigment-1 Dispersion>>

250 g of water was added to 64 g of C.I. Pigment Blue 60 and 6.4 g of Demol N manufactured by Kao Corporation and thoroughly mixed to form slurry. 800 g of zirconia beads having an average diameter of 0.5 mm were prepared and placed in a vessel together with the slurry to disperse in a dispersing machine (trade name: 1/4 G Sand Grinder Mill, manufactured by IMEX) for 25 hours. To the slurry was added water such that the pigment concentration was 5% by weight to obtain pigment-1 dispersion. The pigment particles contained in the pigment dispersion thus obtained was 0.21 μm.

<<Preparation of an Aqueous Dye Solution>>

An aqueous solution containing 5% by weight of the following dye was prepared.

Comparative water-soluble dye A: Kayafecttercoise RN liquid 150 (manufactured by Nippon Kayaku Co., Ltd.). Following structure:

Blue Dye Compound-1

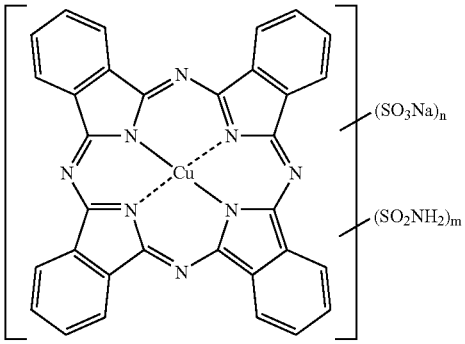

n = 0.5~2.0
m = 0.5~2.5

6) Preparation of an Aqueous Solution

An aqueous solution of the following each compound was prepared and added.

An aqueous 5 wt % succinimide solution was prepared.

An aqueous 5 wt % 4-methylphthalic acid solution was prepared.

7) Preparation of a SBR Latex Solution

The SBR latex (TP-1) was prepared in the following manner.

A polymerization kettle of a gas monomer reactor was charged with 287 g of distilled water, 7.73 g of a surfactant (trade name: Pionin A-43-S, manufactured by Takemoto Oil & Fat Co., Ltd., solid content: 48.5% by weight), 14.06 ml of 1 mol/L NaOH, 0.15 g of tetrasodium ethylenediaminetetraacetate, 255 g of styrene, 11.25 g of acrylic acid and 3.0 g of tert-dodecylmercaptan. The reactor was closed to stir the mixture in the container at a stirring speed of 200 rpm. The reactor was deaerated using a vacuum pump and substitution of nitrogen was repeated several times. Then, 108.75 g of 1,3-butadiene was introduced into the reactor under pressure and the inside temperature was raised to 60° C. A solution prepared by dissolving 1.875 g of ammonium persulfate in 50 ml of water was added to the mixture, which was then stirred for 5 hours as it was. The temperature of the mixture was raised to 90° C. to stir the mixture for 3 hours. After the reaction was finished, the inside temperature was dropped to ambient temperature and then the mixture was adjusted to pH 8.4 by adding 1 mol/L NaOH and $NH_4OH$ ($Na^+$ ion: $NH_4^+$ ion=1:5.3 (molar ratio). Thereafter, the reaction mixture was subjected to filtration using a polypropylene filter having a pore diameter of 1.0 μm to remove foreign substances such as dusts and stored, and 774.7 g of SBR latex TP-1 was thus obtained.

The concentration of halogen ions was measured by ion chromatography to find the concentration of chloride ions to be 3 ppm. The concentration of chelating agents was measured by high-performance liquid chromatography to find that it was 145 ppm.

The above latex had the following properties: average particle diameter: 90 nm, Tg=17° C., solid concentration: 44% by weight, equilibrium moisture content at 25° C. under 60% RH: 0.6% by weight, ionic conductivity: 4.80 mS/cm (ionic conductivity was measured at 25° C. by using a conductometer, trade name: CM-30S, manufactured by DKK-TOA Corporation).

2. Preparation of Coating Solutions 1-1) Preparation of Image Forming Layer Coating Solutions 1 to 8

A container kept at 40° C. was charged with 450 ml of water and 200 g of a gelatin to dissolve gelatin. Then, a fatty acid silver dispersion, a pigment-1 dispersion, an organic polyhalogen compound-1 dispersion, an organic polyhalogen compound-2 dispersion, an aqueous succinimide solution, a reducing agent dispersion, sodium iodide and an irradiation preventive dye (shown in Table 1) were added to the mixture one by one. A silver halide mixture emulsion A was added to the above mixture just before application, followed by thoroughly mixing to obtain an image forming layer coating solution, which was then fed to a coating die as it was.

The amount of zirconium in the coating solution was 0.18 mg per 1 g of silver.

1-2) Preparation of Image Forming Layer Coating Solutions 9 to 16

A fatty-acid silver dispersion, a pigment-1 dispersion, an organic polyhalogen compound-1 dispersion, an organic polyhalogen compound-2 dispersion, an aqueous succinimide solution, a reducing agent dispersion, sodium iodide, an irradiation preventive dye (shown in Table 1) and the SBR latex (TP-1) were added one by one. A silver halide mixture emulsion A was added to the above mixture just before application, followed by thoroughly mixing to obtain an image forming layer coating solution, which was then fed to a coating die as it was.

The amount of zirconium in the coating solution was 0.18 mg per 1 g of silver.

2) Preparation of a Surface Protective Layer Coating Solution

A container kept at 40° C. was charged with 2,400 ml of water and 300 g of a gelatin to dissolve gelatin. Then, 60 g of an aqueous 5 wt % sodium (2-ethylhexyl)sulfosuccinate solution, 900 g of an aqueous succinimide solution and 220 g of an aqueous solution of 4-methylphthalic acid solution were added one by one, followed by thoroughly stirring to prepare a surface protective layer coating solution.

3. Production of Photothermographic Materials 1 to 16

An image forming layer and a surface protective layer were applied to the undercoat layer in this order on the side opposite to the back surface by simultaneous multiplication coating in a slide beads coating system to manufacture a sample of a photothermographic material. At this time, each coating solution for the image forming layer and the surface protective layer were adjusted to a temperature of 37° C.

The coating amount (g/m$^2$) of each compound in the image forming layer is as follows. Also, the surface protective layer was applied such that the coating amount of gelatin after the coating solution was dried was 2.0 (g/m$^2$).

| | |
|---|---|
| Fatty acid silver | 5.42 |
| Pigment (C.I. Pigment Blue 60) | 0.036 |
| Polyhalogen compound-1 | 0.10 |
| Polyhalogen compound-2 | 0.34 |
| Succinimide | 0.54 |
| Gelatin or SBR latex (TP-1) | 3.90 |
| Sodium iodide | 0.04 |
| Reducing agent-1 | 0.75 |
| Irradiation preventive dye | shown in Table 1 |
| Silver halide (as Ag) | 0.10 |

-continued

Spectral Sensitizing Dye A

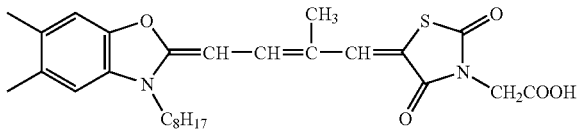

Spectral Sensitizing Dye B

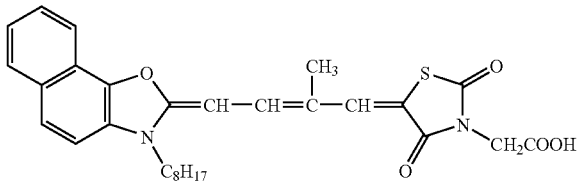

TABLE 1

| Sample No. | Irradiation preventive dye Type | Amount to be added (mg/m$^2$) | Binder in the image forming layer | Photographic performance Sensitivity | Sharpness | Tint | Remarks |
|---|---|---|---|---|---|---|---|
| 1 | Pigment dispersion-1 | 82 | Gelatin | 0 | 0.77 | 2 | Comparative Example |
| 2 | Comparative dye A | 110 | Gelatin | −0.02 | 0.81 | 1 | Comparative Example |
| 3 | 11 in the formula (PC-1) | 40 | Gelatin | −0.01 | 0.95 | 4 | Present invention |
| 4 | 31 in the formula (PC-1) | 40 | Gelatin | −0.01 | 0.96 | 4 | Present invention |
| 5 | 48 in the formula (PC-1) | 40 | Gelatin | −0.02 | 0.95 | 4 | Present invention |
| 6 | 61 in the formula (PC-1) | 40 | Gelatin | −0.01 | 0.95 | 4 | Present invention |
| 7 | 80 in the formula (PC-1) | 40 | Gelatin | −0.01 | 0.95 | 4 | Present invention |
| 8 | 136 in the formula (PC-1) | 40 | Gelatin | −0.01 | 0.96 | 4 | Present invention |
| 9 | Pigment dispersion-1 | 82 | SBR latex | 0 | 0.78 | 2 | Comparative Example |
| 10 | Comparative dye A | 110 | SBR latex | −0.01 | 0.8 | 1 | Comparative Example |
| 11 | 11 in the formula (PC-1) | 40 | SBR latex | 0 | 0.85 | 4 | Comparative Example |
| 12 | 31 in the formula (PC-1) | 40 | SBR latex | 0 | 0.86 | 4 | Comparative Example |
| 13 | 48 in the formula (PC-1) | 40 | SBR latex | −0.01 | 0.85 | 4 | Comparative Example |
| 14 | 61 in the formula (PC-1) | 40 | SBR latex | 0 | 0.84 | 4 | Comparative Example |
| 15 | 80 in the formula (PC-1) | 40 | SBR latex | −0.01 | 0.82 | 4 | Comparative Example |
| 16 | 136 in the formula (PC-1) | 40 | SBR latex | 0 | 0.86 | 4 | Comparative Example |

The chemical structure of the compound used in the examples of the invention will be shown below.

Tellurium Sensitizer C

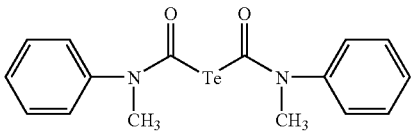

-continued (Reducing Agent-1)

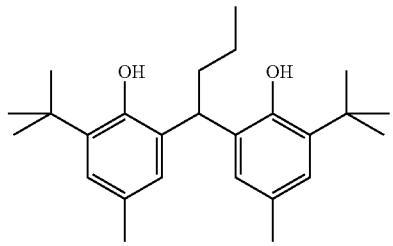

-continued (Polyhalogen Compound-1)

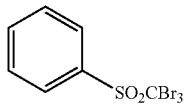

(Polyhalogen Compound-2)

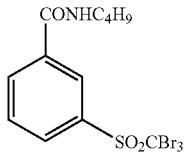

3. Evaluation of Each Performance

1) Preparation

The resulting samples were cut into a half size (length: 43 cm and width: 35 cm) and packaged in the following package material in the circumstance of 25° C. and 50% RH, stored at ambient temperature for 2 weeks and then evaluated in the following manner.

<Package Material>

A laminate film comprising PET 10 μm/PE 12 μm/aluminum foil 9 μm/Ny 15 μm/polyethylene 50 μm containing 3% by weight of carbon:

Oxygen permeability: 0.02 ml/atm·$m^2$·25° C.·day; and

Moisture permeability: 0.10 g/atm·$m^2$·25° C.·day.

2) Exposure and Developing of the Light-Sensitive Material

Each sample was exposed to light by using a 660 nm laser exposure machine and thermally developed at 124° C. for 15 seconds.

3) Evaluation Items

Sensitivity: this was expressed by a logarithmic value of the inverse number of exposure amount giving a density of 1.2 and shown by a relative value when the value of the sample 1 was set to 0.

Sharpness: each sample was exposed to a MTF measuring pattern and thermally developed in the aforementioned condition to find the value at 2 cycle/mm by a usual MTF method.

Tint: the tint of each sample after treated was evaluated by observing the unexposed portion visually. Evaluation was made according to five ranks from 1 to 5, wherein the rank 5 shows the most preferable tint whereas the rank 1 shows the worst. A practically allowable level is the rank 4.

4) Results of Evaluation

The results are shown in Table 1.

The photothermographic material of the invention had high sharpness and a desirable tint after treated.

Example 2

<Example Using Magenta Dye Together>

A magenta dye was further added to the sample 4 in Example 1 as shown in Table 2 to make a sample. The obtained sample was evaluated in the same manner as in Example 1. The results are shown in Table 2.

TABLE 2

| | Magenta dye | | | Photographic performance | | | |
|---|---|---|---|---|---|---|---|
| Sample No. | Type | Amount to be added ($mg/m^2$) | Fogging | Sensitivity | Sharpness | Tint |
| 4 | — | — | 0.17 | −0.01 | 0.95 | 4 |
| 17 | Formula (IV)-(1) | 10 | 0.18 | −0.01 | 0.95 | 5 |
| 18 | Formula (IV)-(4) | 10 | 0.18 | −0.01 | 0.95 | 5 |
| 19 | Formula (IV)-(25) | 10 | 0.18 | −0.01 | 0.95 | 5 |

The combined use of a magenta dye resulted in the production of a photothermographic material having a more preferable tint.

Example 3

<Example Using a Mordant>

A mordant was further added to the sample 17 in Example 2 as shown in Table 3 to make a sample. The obtained sample was evaluated in the same manner as in Example 1. The results are shown in Table 3.

TABLE 3

| | Mordant | | Photographic performance | | | | |
|---|---|---|---|---|---|---|---|
| Sample No. | Type | Amount to be added ($mg/m^2$) | Fogging | Sensitivity | Sharpness | Tint | Remarks |
| 4 | — | — | 0.17 | −0.01 | 0.95 | 4 | Presenmt invention |
| 17 | — | — | 0.17 | −0.01 | 0.95 | 5 | Present invention |
| 20 | B-1 | 90 | 0.17 | −0.01 | 0.98 | 5 | Present invention |
| 21 | B-2 | 90 | 0.17 | −0.01 | 0.97 | 5 | Present invention |
| 22 | B-3 | 90 | 0.17 | −0.01 | 0.98 | 5 | Present invention |

The combined use of a mordant resulted in the production of a photothermographic material having higher sharpness.

Mordant in the Invention

B-1

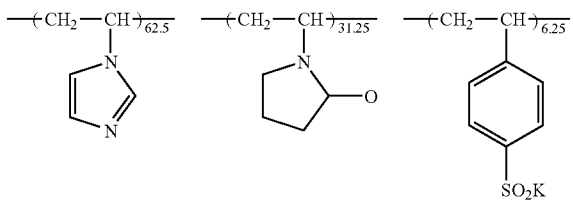

B-2

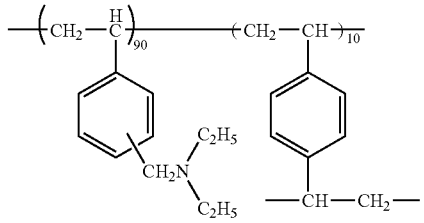

-continued

B-3

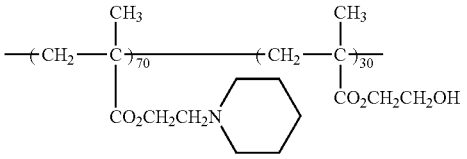

Example 4

The irradiation preventive dye was added not to the image forming layer but to the surface protective layer to make a sample in the sample 4 of Example 1. The obtained sample was evaluated in the same manner as in Example 1. The same good results as those in Example 1 were obtained.

What is claimed is:

1. A photothermographic material comprising an image forming layer containing at least a light-sensitive silver halide, a light-insensitive organic silver salt, a reducing agent and binder, and a non-image forming layer on at least one surface of a support, wherein, 70% by weight or more of the binder in the image forming layer is a hydrophilic binder, and the photothermographic material further comprises a metal phthalocyanine compound represented by the following formula (PC-1):

Formula (PC-1)

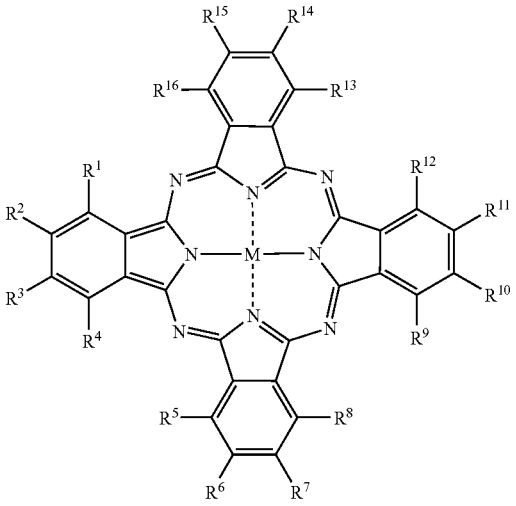

wherein M represents a metal atom, $R^1$, $R^4$, $R^5$, $R^8$, $R^9$, $R^{12}$, $R^{13}$ and $R^{16}$ respectively represent a hydrogen atom or a substituent selected from a halogen atom, alkyl group, alkenyl group, alkynyl group, aryl group, heterocyclic group, acyl group, alkoxycarbonyl group, aryloxycarbonyl group, carbamoyl group, carboxy group or its salts, sulfonylcarbamoyl group, acylcarbamoyl group, sulfamoylcarbamoyl group, carbazoyl group, oxalyl group, oxamoyl group, cyano group, thiocarbamoyl group, hydroxy group, alkoxy group, aryloxy group, heterocyclic oxy group, acyloxy group, carbonyloxy group, carbamoyloxy group, sulfonyloxy group, amino group, acylamino group, sulfonamide group, ureide group, thioureide group, imide group, carbonylamino group, sulfamoylamino group, semicarbazide group, thiosemicarbazide group, hydrazino group, ammonio group, oxamoylamino group, sulfonylureide group, acylureide group, acylsulfamoylamino group, nitro group, mercapto group, thio group, sulfonyl group, sulfinyl group, sulfo group or its salts, sulfamoyl group, acylsulfamoyl group, sulfonylsulfamoyl group or its salts, a group containing a phosphoric acid amide or phosphate ester structure, silyloxy group and silyl group, where at least one of $R^1$, $R^4$, $R^5$, $R^8$, $R^9$, $R^{12}$, $R^{13}$ and $R^{16}$ is an electron attractive group and $R^2$, $R^3$, $R^6$, $R^7$, $R^{10}$, $R^{11}$, $R^{14}$ and $R^{15}$ respectively represent a hydrogen atom.

2. The photothermographic material of claim 1, wherein at least one of $R^1$, $R^4$, $R^5$, $R^8$, $R^9$, $R^{12}$, $R^{13}$ and $R^{16}$ groups of the metal phthalocyanine compound represented by the formula (PC-1) is a group represented by the following formula (I):

$$—L^1—R^{17}$$ Formula (I)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—* or **—$COCONR_N$—*, where ** indicates the position at which a phthalocyanine skeleton is bound and * indicates the position at which $R^{17}$ is bound, $R_N$ represents a hydrogen atom, an alkyl group, an aryl group, a heterocyclic group, an acyl group, an alkoxycarbonyl group, a carbamoyl group, a sulfonyl group or a sulfamoyl group and $R^{17}$ represents a hydrogen atom, an alkyl group, an aryl group or a heterocyclic group.

3. The photothermographic material of claim 1, wherein four or more among $R^1$, $R^4$, $R^5$, $R^8$, $R^9$, $R^{12}$, $R^{13}$ and $R^{16}$ of the metal phthalocyanine compound represented by the formula (PC-1) are groups represented by the formula (I).

4. The photothermographic material of claim 1, wherein the metal phthalocyanine compound represented by the formula (PC-1) is soluble in water.

5. The photothermographic material of claim 1, wherein the metal phthalocyanine compound has an absorption maximum in a wavelength range from 620 nm to 700 nm.

6. The photothermographic material of claim 1, wherein the metal phthalocyanine compound is contained in the image forming layer.

7. The photothermographic material of claim 1, wherein the metal phthalocyanine compound is contained in the non-image forming layer.

8. The photothermographic material of claim 1, the light-sensitive material further comprising a magenta dye.

9. The photothermographic material of claim 8, wherein at least one layer among the layer(s) containing the metal phthalocyanine compound contains the magenta dye.

10. The photothermographic material of claim 1, wherein the hydrophilic binder is a polyvinyl alcohol.

11. The photothermographic material of claim 1, wherein the hydrophilic binder is a gelatin or a gelatin derivative.

12. The photothermographic material of claim 1, wherein at least one layer among the layers containing the metal phthalocyanine compound contains a mordant.

13. The photothermographic material of claim 1, wherein the light-insensitive organic silver salt contains at least one dispersant selected from a polyacrylamide of its derivative.

14. The photothermographic material of claim 13, wherein the light-insensitive organic silver salt is nanoparticles.

15. The photothermographic material of claim 1, the light-sensitive material further comprising at least one compound represented by the following formula (II) or (III):

Formula (II)

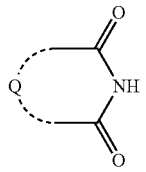

wherein Q represents an atomic group necessary to form a five or six-membered imide ring;

Formula (III)

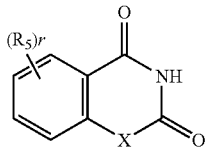

wherein $R_5$ independently represents a hydrogen atom, an alkyl group, a cycloalkyl group, an alkoxy group, an alkylthio group, an arylthio group, a hydroxy group, a halogen atom or a $N(R_8R_9)$ group, where $R_8$ and $R_9$ respectively independently represent a hydrogen atom, an alkyl group, an aryl group, a cycloalkyl group, an alkenyl group or a heterocyclic group, r denotes 0, 1 or 2, $R_8$ and $R_9$ may be combined with each other to form a substituted or unsubstituted five to seven-membered hetero ring and two $R^5$s may be combined with each other to form an aromatic, hetero aromatic, alicyclic or heterocyclic condensed ring, X represents O, S, Se or $N(R_6)$, where $R_6$ represents a hydrogen atom, an alkyl group, an aryl group, a cycloalkyl group, an alkenyl group or a heterocyclic group.

16. The photothermographic material of claim 1, wherein the non-image forming layer is formed on the same side as the image forming layer with respect to the support and 70% by weight or more of the binder is hydrophilic binder.

17. The photothermographic material of claim 16, wherein the hydrophilic binder is a gelatin or a gelatin derivative.

* * * * *